US006905199B2

(12) United States Patent
Miyazawa et al.

(10) Patent No.: US 6,905,199 B2
(45) Date of Patent: Jun. 14, 2005

(54) INK CARTRIDGE FOR INK JET RECORDING DEVICE

(75) Inventors: Hisashi Miyazawa, Nagano (JP); Yasuto Sakai, Nagano (JP); Satoshi Shinada, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/836,158

(22) Filed: Apr. 29, 2004

(65) Prior Publication Data

US 2004/0201655 A1 Oct. 14, 2004

Related U.S. Application Data

(63) Continuation of application No. 10/045,703, filed on Oct. 19, 2001, now abandoned.

(30) Foreign Application Priority Data

| | | |
|---|---|---|
| Oct. 20, 2000 | (JP) | P2000-320319 |
| Oct. 20, 2000 | (JP) | P2000-321207 |
| Feb. 9, 2001 | (JP) | P2001-033074 |
| Feb. 9, 2001 | (JP) | P2001-033075 |
| May 17, 2001 | (JP) | P2001-147418 |
| May 17, 2001 | (JP) | P2001-148296 |
| May 17, 2001 | (JP) | P2001-148297 |
| May 18, 2001 | (JP) | P2001-149315 |
| May 18, 2001 | (JP) | P2001-149787 |
| Jul. 19, 2001 | (JP) | P2001-220340 |
| Oct. 15, 2001 | (JP) | P2001-316455 |

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | |
|---|---|---|---|
| 2,526,019 | A | 10/1950 | Fowler |
| 3,270,771 | A | 9/1966 | Morgan et al. |
| 3,354,902 | A | 11/1967 | Obermaier |

(Continued)

FOREIGN PATENT DOCUMENTS

| | | |
|---|---|---|
| DE | 1 009 870 | 6/1955 |
| DE | 1 152 583 | 9/1958 |
| DE | 1 852 284 | 11/1961 |

(Continued)

OTHER PUBLICATIONS

U.S. Appl. No. 09/525,477, filed Mar. 15, 2000, Miyazawa.
U.S. Appl. No. 10/778,766, filed Feb. 13, 2004, Miyazawa et al.
U.S. Appl. No. 10/819,759, filed Apr. 6, 2004, Miyazawa.
U.S. Appl. No. 10/841,694, filed May 7, 2004, Seino et al.
U.S. Appl. No. 09/525,477, Miyazawa.
U.S. Appl. No. 10/383,328, Iida.

*Primary Examiner*—Anh T.N. Vo
(74) *Attorney, Agent, or Firm*—Stroock & Stroock & Lavar

(57) ABSTRACT

An ink cartridge for an ink jet recording device, includes: a container having an ink supply port; at least two ink chambers partitioned in the container, one being located substantially in an upper section and the other being located substantially in a lower section; an ink suction passage connecting a bottom region of the lower section ink chamber to a bottom region of the upper section ink chamber; and a negative pressure generating mechanism provided to a flow passage connecting the upper section ink chamber to the ink supply port.

14 Claims, 42 Drawing Sheets

U.S. PATENT DOCUMENTS 3,779,274 A 12/1973 Kelly
3,941,149 A 3/1976 Mittleman
4,152,710 A 5/1979 Matsuba et al.
4,183,031 A 1/1980 Kyser et al.
4,419,678 A 12/1983 Kasugayama et al.
4,514,742 A 4/1985 Suga et al.
4,520,369 A 5/1985 Shackleton
4,677,447 A 6/1987 Nielsen
4,700,202 A 10/1987 Kuranishi et al.
4,869,282 A 9/1989 Sittler et al.
4,893,138 A 1/1990 Terasawa et al.
4,971,527 A 11/1990 Dick
5,039,997 A 8/1991 Pullen et al.
5,040,002 A 8/1991 Pollacek et al.
5,138,344 A 8/1992 Ujita
5,280,300 A 1/1994 Fong et al.
5,305,795 A 4/1994 Forberg
5,343,226 A 8/1994 Niedermeyer et al.
5,367,328 A 11/1994 Erickson
5,388,615 A 2/1995 Edlund et al.
5,426,459 A 6/1995 Kaplinsky
5,453,772 A 9/1995 Aono et al.
5,477,963 A 12/1995 Mochizuki et al.
5,500,663 A 3/1996 Ujita et al.
5,539,437 A 7/1996 Penwell
5,646,664 A 7/1997 Pawlowski, Jr.
5,653,251 A 8/1997 Handler
5,657,058 A 8/1997 Mochizuki et al.
5,691,753 A 11/1997 Hilton
5,736,992 A 4/1998 Pawlowski, Jr.
5,737,001 A 4/1998 Taylor
5,751,319 A 5/1998 Robertson et al.
5,777,646 A 7/1998 Barinaga et al.
5,796,419 A 8/1998 Clark et al.
5,847,735 A 12/1998 Betschon
5,923,353 A * 7/1999 Boyd et al. ..... 347/85
5,969,737 A 10/1999 Koyama et al.
6,000,788 A 12/1999 Iida
6,010,211 A 1/2000 Betschon
6,010,212 A 1/2000 Yamashita et al.
6,095,643 A * 8/2000 Cook et al. ..... 347/87
6,130,696 A 10/2000 Mashita et al.
6,145,967 A * 11/2000 Langford et al. ..... 347/85
6,193,364 B1 2/2001 Iida
6,238,042 B1 5/2001 Kobayashi et al.
6,302,531 B1 10/2001 Usui et al.
6,332,481 B1 12/2001 Shinada et al.
6,383,436 B1 5/2002 Nishimuro et al.
6,390,611 B1 5/2002 Kobayashi et al.
6,416,152 B1 7/2002 Matsuzaki et al.
6,422,691 B2 7/2002 Kobayashi et al.
6,460,984 B1 10/2002 Matsumoto et al.
6,505,923 B1 * 1/2003 Yamamoto et al. ..... 347/85
6,550,901 B2 4/2003 Iida
6,585,358 B2 7/2003 Usui et al.
6,648,459 B2 11/2003 Usui et al.
6,666,551 B2 12/2003 Kobayashi et al.
2001/0020971 A1 9/2001 Usui et al.
2002/0044184 A1 4/2002 Kobayashi et al.
2002/0063758 A1 5/2002 Usui et al.
2002/0089083 A1 7/2002 Nishimuro et al.
2002/0109760 A1 8/2002 Miyazawa et al.
2002/0135646 A1 9/2002 Usui
2002/0154200 A1 10/2002 Miyazawa et al.
2002/0158948 A1 10/2002 Miyazawa et al.
2002/0171721 A1 11/2002 Ota et al.
2002/0171722 A1 11/2002 Hara et al.
2002/0171723 A1 11/2002 Ota et al.
2002/0180849 A1 12/2002 Sakai et al.
2003/0007043 A1 1/2003 Ota et al.
2003/0058312 A1 3/2003 Iida
2003/0058313 A1 3/2003 Iida
2003/0085970 A1 5/2003 Sakai et al.
2003/0103119 A1 6/2003 Sakai et al.
2003/0107627 A1 6/2003 Seino et al.
2003/0107629 A1 6/2003 Kobayashi et al.
2003/0128261 A1 7/2003 Usui et al.
2003/0146959 A1 8/2003 Iida
2004/0051766 A1 3/2004 Miyazawa et al.
2004/0056936 A1 3/2004 Usui et al.
2004/0085415 A1 5/2004 Kobayashi et al.

FOREIGN PATENT DOCUMENTS

DE 1 550 194 8/1969
DE 2 230 642 12/1972
DE 3 202 796 A1 8/1983
DE 195 45 775 A1 6/1997
EP 0 112 701 A2 7/1984
EP 0 116 466 A2 8/1984
EP 0 238 829 A2 9/1987
EP 0 336 307 A2 10/1989
EP 0 339 770 A2 11/1989
EP 0 412 643 A1 2/1991
EP 0 424 133 A2 4/1991
EP 0 509 686 A2 10/1992
EP 0 529 880 B1 3/1993
EP 0 562 717 A1 9/1993
EP 0 631 874 A2 1/1995
EP 0 709 207 A2 5/1996
EP 0 760 288 A1 3/1997
EP 0 794 059 A2 9/1997
EP 0 827 836 A1 3/1998
EP 0 879 702 A2 11/1998
EP 0 903 236 A2 3/1999
EP 0 919 384 A2 6/1999
EP 0 956 958 A2 11/1999
EP 1 016 533 A1 7/2000
EP 1 125 747 A2 8/2001
EP 1 199 178 A1 4/2002
EP 1 258 358 A1 11/2002
EP 1 270 235 A1 1/2003
FR 1 145 605 10/1957
FR 1 268 227 6/1961
FR 2 391 405 A1 12/1978
GB 751 289 6/1956
GB 2 147 975 5/1985
GB 2 323 332 A 9/1998
JP 55-146766 11/1980
JP 56-013183 2/1981
JP 57-006777 1/1982
JP 57-197176 A 12/1982
JP 58-036457 A 3/1983
JP 59-176545 10/1984
JP 62-231759 10/1987
JP 2-072271 3/1990
JP 2-198862 8/1990
JP 4-073158 3/1992
JP WO 92/12371 7/1992
JP 5-050609 3/1993
JP 5-162324 A 6/1993
JP 5-201018 8/1993
JP 5-229137 9/1993
JP 8-174860 7/1996
JP 9-290514 11/1997
JP 10-086402 4/1998
JP 10-244685 9/1998
JP 10-315504 12/1998
JP 11-58772 3/1999
JP 11-091122 4/1999
JP 11-170558 6/1999
JP 11-179932 7/1999

| | | |
|---|---|---|
| JP | 2001-270129 | 10/2001 |
| JP | 2002-103642 | 4/2002 |
| WO | WO 00/03877 A1 | 1/2000 |
| WO | WO 01/78988 A1 | 10/2001 |

* cited by examiner

FIG. 19 (II)

FIG. 19 (III)

FIG. 19 (IV)

INK CARTRIDGE FOR INK JET RECORDING DEVICE

CROSS-REFERENCE TO RELATED APPLICATION

This application is a continuation of an application filed on Apr. 16, 2004, the number of which is not yet known, which is a continuation of application Ser. No. 10/045,703, filed on Oct. 19, 2001, now abandoned.

BACKGROUND OF THE INVENTION

The present invention relates to an ink cartridge which supplies ink at an appropriate negative pressure to a recording head which ejects ink droplets in response to print signals applied thereto.

The ink jet recording device is usually constructed such that an ink jet recording head for ejecting ink droplets in response to print signals is mounted on a carriage which is reciprocatively moved in the width direction of a recording sheet, and ink is supplied from an ink tank, located outside, to the recording head. In the recording device of the small type, an ink storage container, such as an ink tank, is detachably attached to the carriage to secure easy handling.

In general, the ink storage container contains a porous member in order to prevent ink from leaking out of the recording head. The porous member is impregnated with ink, whereby the ink is held by a capillary force.

Improvement of print quality and printing speed is demanded in the market. Thus, there is a tendency that the number of nozzle openings of the recording head is increased, and an amount of ink consumed per unit time is increased.

To meet this tendency, it is necessary to increase the amount of ink stored in the ink storage container. As a result, the volume of the porous member is increased. However, in view of holding ink by the capillary force of the porous member, a height, or a water head, is limited in increase, and consequently, the bottom area need to be increased. This results in the increase of the carriage size, and thus the recording device.

There is an approach in which the ink holding capability is increased by using a porous member small in average pore diameter. However, this approach increases fluid resistance against the ink flow, causing difficulty not only in stably supplying ink correspondingly to the amount of ink consumed by the recording head, but also in reliably supplying, to the recording head, ink in a region distanced from an ink supply port. As a result, the ink contained in the ink container is not consumed completely and left therein as waste ink.

To solve the problem, such an ink storage container is proposed, as disclosed in JP-A-8-174860, that an ink storage chamber is located in the upper part, and a normally closed-membrane (film) valve is provided between the ink storage chamber and the ink supply port so that the valve is opened by a negative pressure caused with the ink consumption by the recording head.

Since the membrane valve can prevent the leakage of ink, the amount of stored ink can be increased. However, a pressure corresponding to the ink amount acts on the membrane valve since the ink storage chamber is located in the upper part. Therefore, to increase the amount of the stored ink without increasing the bottom area, the negative pressure for opening the membrane valve must be increased. As a result, the print quality is degraded at a time point that the remaining ink amount is small, that is, the water head pressure of the ink is decreased below a predetermined level. On the other hand, if the print quality must be ensured, the remaining ink amount is increased.

Further, if printing is continued while disregarding the print quality in order to decrease the waste ink, an excess negative pressure required to open the membrane valve acts on the recording head to destroy the meniscuses at the nozzles of the recording head, making the printing impossible.

SUMMARY OF THE INVENTION

The present invention was made in view of the above-noted circumstances, and an object of the present invention is to provide an ink cartridge, which can reduce a water head pressure of ink acting on a membrane valve to be as small as possible without increasing the bottom area of a container storing ink.

A further advantage of the present invention is to provide an ink cartridge, which can increase the effectively usable ink storage amount without degrading the print quality.

Still another advantage of the present invention is to provide ink cartridges, which can be mainly constructed using common parts to thereby readily change an ink storage amount.

The present invention provides, for example, an ink cartridge for an ink jet recording device having a recording head, comprising: a container including: a lower section ink chamber; an upper section ink chamber; an ink supply port for supplying ink to the recording head; an ink suction passage connecting the lower section ink chamber to the upper section ink chamber; an ink flow passage connecting the upper section ink chamber to the ink supply port; and an air communication portion communicating the lower section ink chamber with the atmosphere; and a negative pressure generating mechanism stored in the container, and disposed in the ink flow passage, for example, midway of same.

Ink is sucked up from the lower section ink chamber to the upper section ink chamber, and then supplied via the negative pressure generating mechanism to the recording head. Therefore, it is possible to reduce pressure variation applied to the negative pressure generating mechanism due to ink amount within the ink cartridge in association with ink consumption.

The present disclosure relates to the subject matter contained in Japanese patent application Nos.:

2000-321207 (filed on Oct. 20, 2000);
2000-320319 (filed on Oct. 20, 2000);
2001-033075 (filed on Feb. 9, 2001);
2001-147418 (filed on May 17, 2001);
2001-148296 (filed on May 17, 2001):
2001-149315 (filed on May 18, 2001);
2001-149787 (filed on May 18, 2001);
2001-220340 (filed on Jul. 19, 2001);
2001-198297 (filed on May 17, 2001);
2001-033074 (filed on Feb. 9, 2001); and
2001-316455 (filed on Oct. 15, 2001), which are expressly incorporated herein by reference in their entireties.

DESCRIPTION OF THE PREFERRED EMBODIMENT

The present invention will be described in detail by way of example with reference to preferred embodiments illustrated in the accompanying drawings.

First Embodiment

Figure 1A:
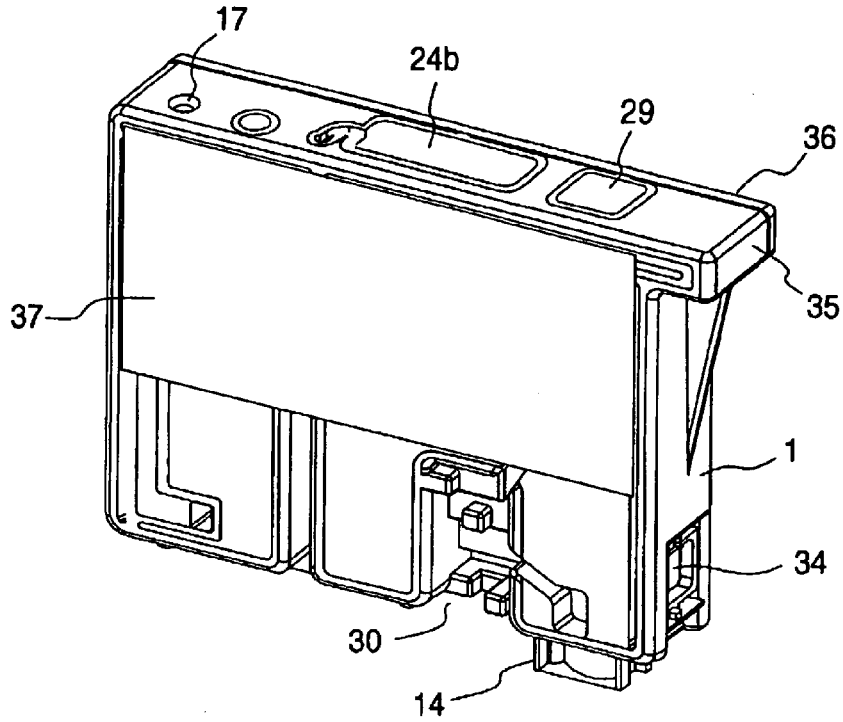
FIGS. 1A and 1B are perspective views showing front and rear surface structures of an ink cartridge which constitutes one exemplary embodiment of the present invention.
Figure 1B:
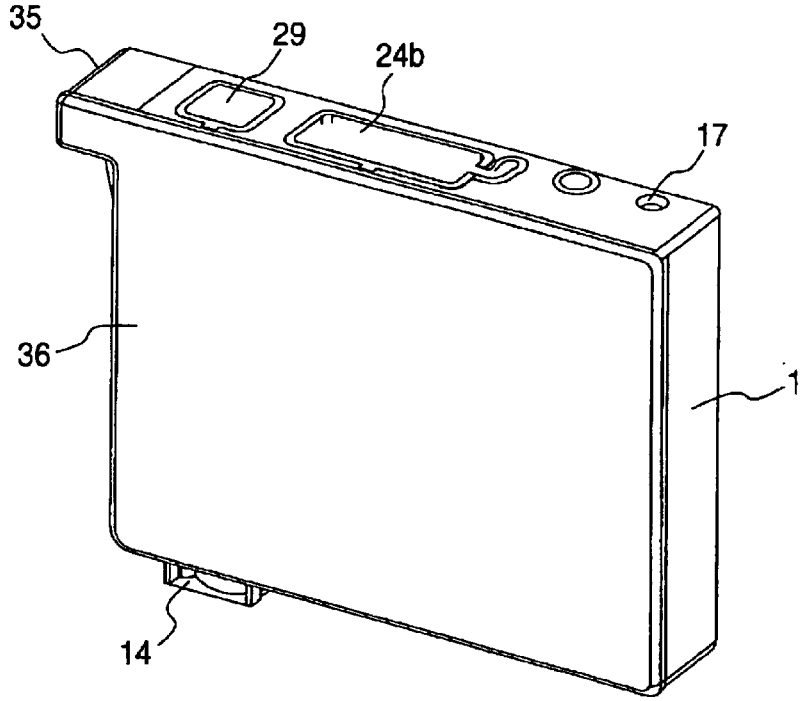
Figure 2A:
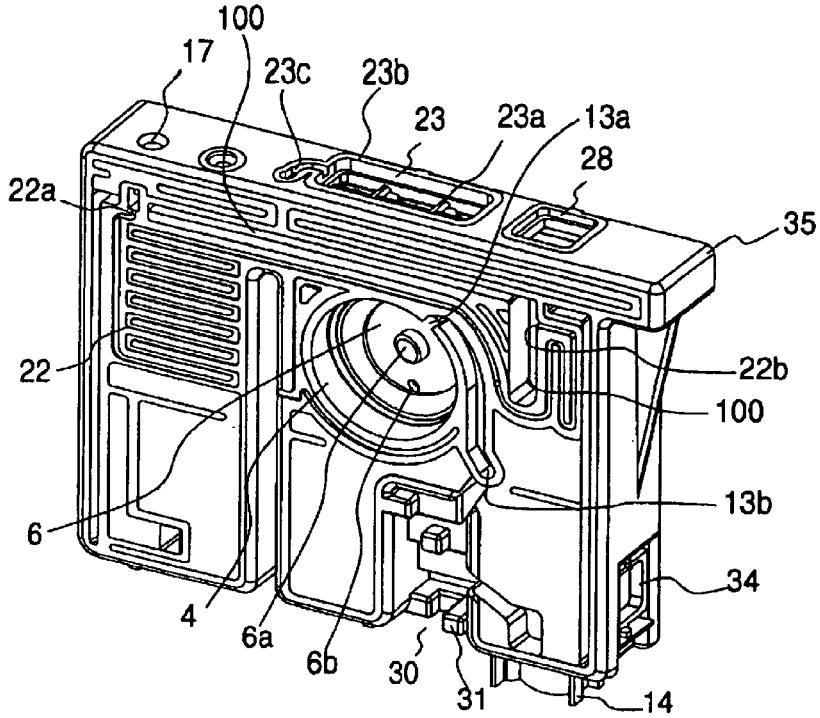
FIGS. 2A and 2B are perspective views showing the ink cartridge of FIG. 1 in a state that side surface forming members for sealing the ink cartridge are removed.

FIGS. 1A, 1B, 2A and 2B show the front and rear structures of a container body 1 forming an ink cartridge, which constitutes a first embodiment of the present invention. FIG. 3 shows the bottom structure of the container body 1. The interior of the container body 1 is vertically divided by a wall 2, extending substantially horizontally, into a lower section region and an upper section region. In the lower section region, a first ink chamber 3 serving as a lower section ink chamber is formed in a lower section region. In the upper section region, there are formed: a differential pressure valve storage chamber 4, serving as a negative pressure generating mechanism to be described later; a filter chamber 5 for storing a filter; and a second ink chamber 8 serving as an upper section ink chamber and including first and second ink storage portions 15 and 16.

The differential pressure valve storage chamber 4 and the filter chamber 5 are partitioned one from the other by a wall 6 located at a substantially central portion in the thickness direction of the container body 1. The wall 6 is formed with a protruded valve seat 6*a* on the differential pressure valve chamber (4) side, and with through-holes 6*b* (see also FIGS. 6A and 6B). A frame portion 10 is formed on the filter chamber (5) side so as to fix a filter 18 thereto (see also FIGS. 6A and 6B)

Figure 9:
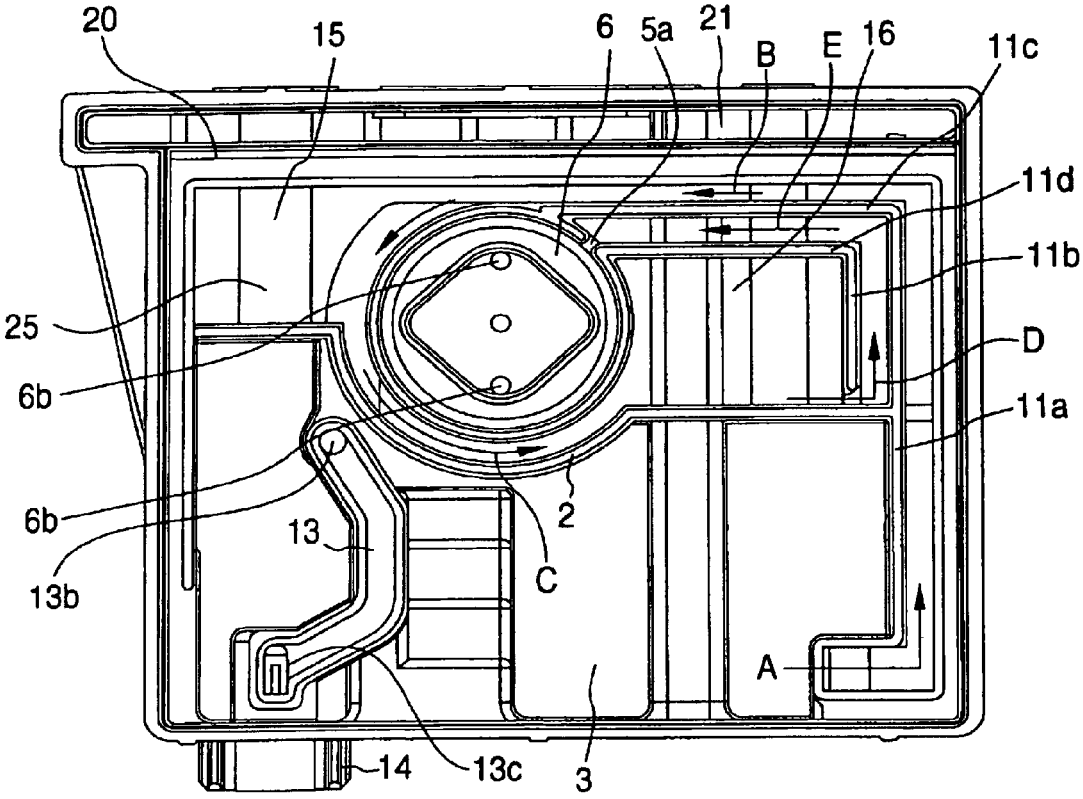
FIG. 9 is an elevational view mainly showing an ink flow passage provided in a filter chamber side in the ink cartridge of FIG. 1.

The upper and lower section chambers are communicated with an upper section region opening 5*a* of the filter chamber 5 via a circuitous flow passage (in more detail, a passage turning on and along a vertical plane) defined by vertically extending walls 11*a*, 11*b* and horizontally extending walls 11*c*, 11*d* located at one side of the container body 1 (see FIG. 9).

The differential pressure valve storage chamber 4, connected via the through-holes 6*b* to the filter chamber 5, is communicated with an ink supply port 14 via a flow passage 13 formed to be separated from the first ink chamber 3. That is, a part of the outer periphery of the differential pressure valve storage chamber 4 is communicated via the flow passage 13, including an opening 13*a*, a through-hole 13*b* and an opening 3*c*, with the ink supply port 14. The first and second upper section ink storage portions 15 and 16 are located opposite from each other with respect to the differential pressure valve storage chamber 4 and the filter chamber 5. Air bubbles raised and conveyed along with ink from the first ink chamber 3 are trapped by these upper section ink storage portions 15 and 16.

Figure 2B:
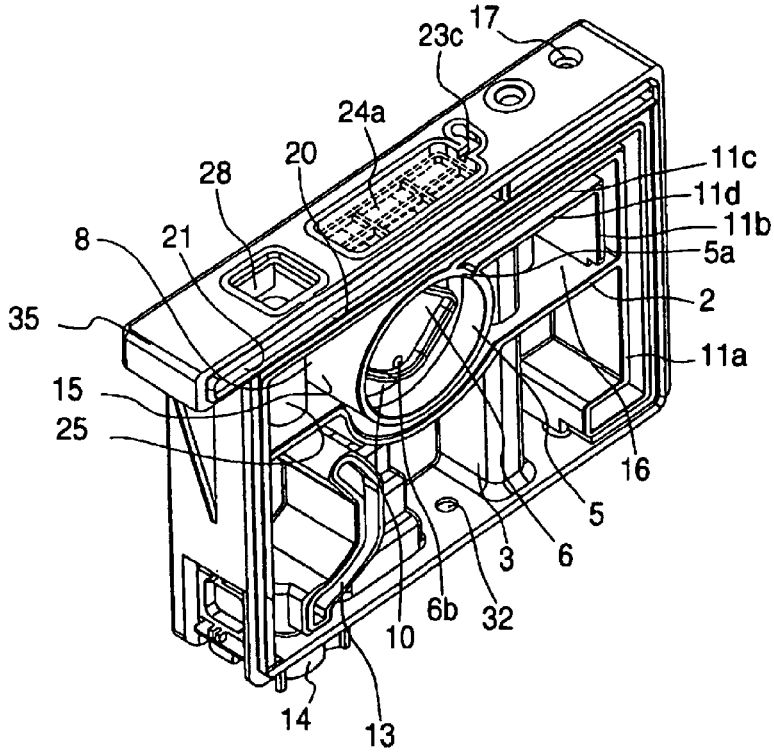
Figure 3:
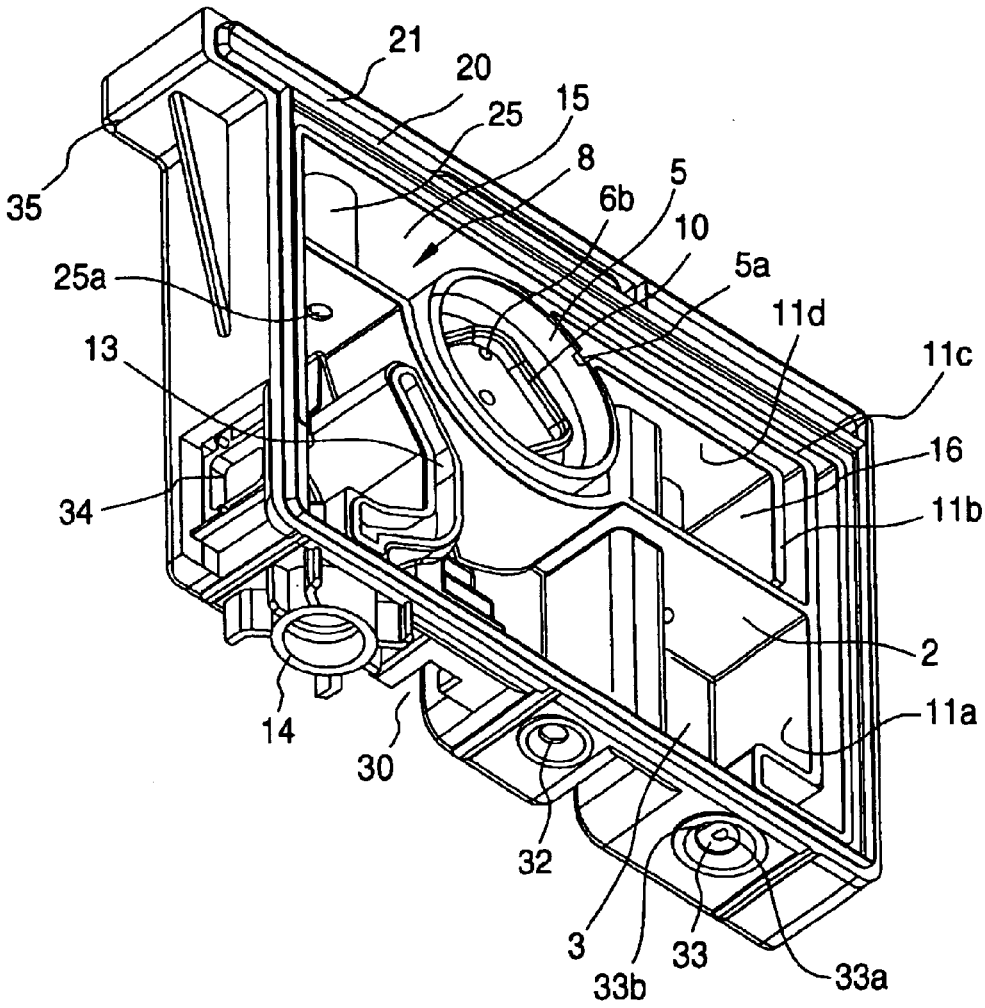
FIG. 3 is a perspective view showing a bottom structure of the ink cartridge of FIG. 1.

As shown in FIGS. 2B and 3, a horizontally extending wall 20 is formed to be slightly distanced from the outer wall of the container body 1, to thereby define an air chamber 21. The air chamber 21 is communicated via a vertically extending through-hole 25*a* of a cylindrical portion 25 with the first ink chamber 3 (as shown in FIG. 4, a valve member described later is installed within the through-hole 25*a* of the cylindrical portion 25). The air chamber 21 is also communicated with a recessed portion 23 (FIG. 2A) where an air permeable film 24*a* (FIG. 2B) is provided. As shown in FIG. 2A, the recessed portion 23 is communicated via a groove 23*c* with a passage 100 to which one end 22*b* of a capillary 22 is connected. The capillary 22 is formed on the differential pressure valve storage chamber side surface of the container body 1. The other end 22*a* of the capillary 22 is connected to an air communication port 17 to be opened to the atmosphere. That is, the first ink chamber 3 is connected via the cylindrical portion 25, the air chamber 21, the air permeable film 24*a*, the capillary 22, etc. to the air communication port 17. In addition, FIG. 2A shows a state before the air permeable film 24*a* is provided in the recessed portion 23, whereas FIG. 2B shows a state after the air permeable film 24*a* is provided in the recessed portion 23.

Figure 4A:
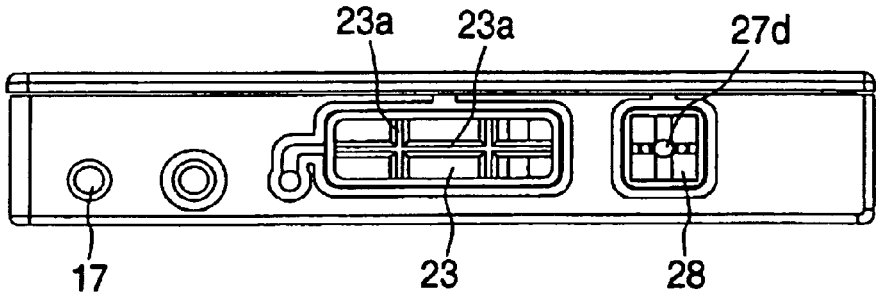
FIGS. 4A and 4B are an upper surface view and an elevational view for showing an air communication passage in the ink cartridge of FIG. 1.
Figure 4B:
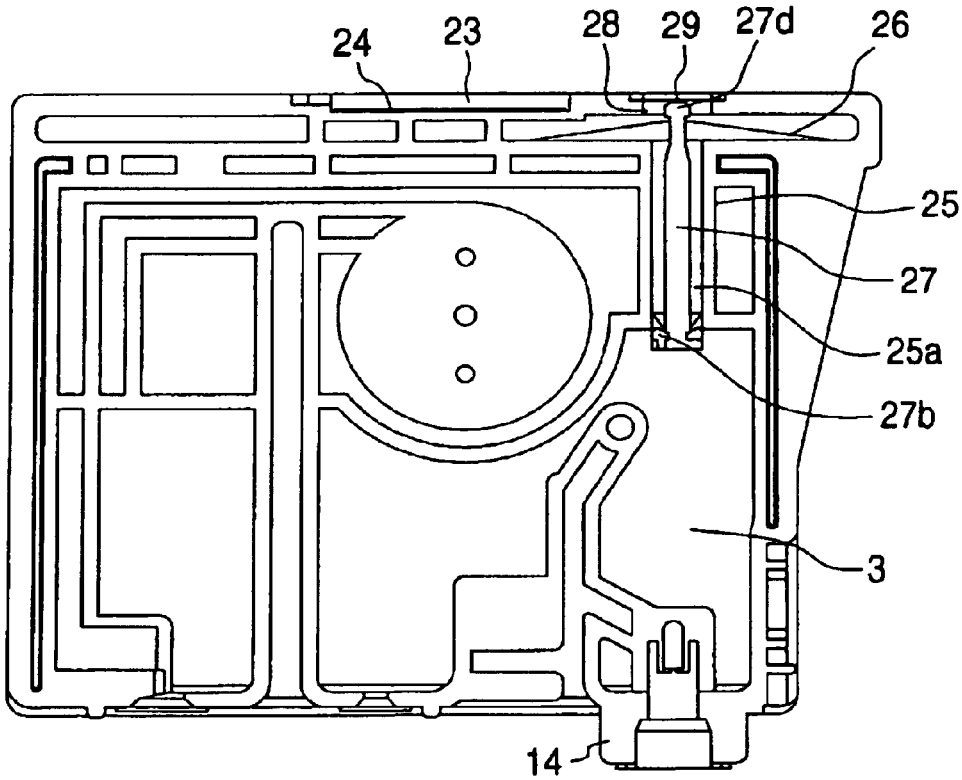

The capillary 22 is formed by sealing a circuitous groove, formed in the differential pressure valve storage chamber side surface of the container body 1, with an air impermeable film 37 (FIG. 1A). The end 22*a* is connected to the air communication port 17, and the opposite end 22*b* is communicated via the passage 100 and the groove 23*c* (connected to the passage 100 in the inside of the container body) with a region defined between the air permeable film 24*a* and an air impermeable film 24*b*. The air permeable film 24*a* is stretched over a middle stage of the recessed portion 23 formed in the container body 1. More specifically, as shown in FIG. 4A, a film support member 23*a* is formed at the middle stage of the recessed portion 23, and the air permeable film 24*a* is bonded to the film support member 23*a*. Further, the air impermeable film 24*b* is bonded to an upper surface periphery 23*b* of the recessed portion 23 (FIG. 2A) so that the interior of the recessed portion 23 is separated from the atmosphere.

Figure 8:
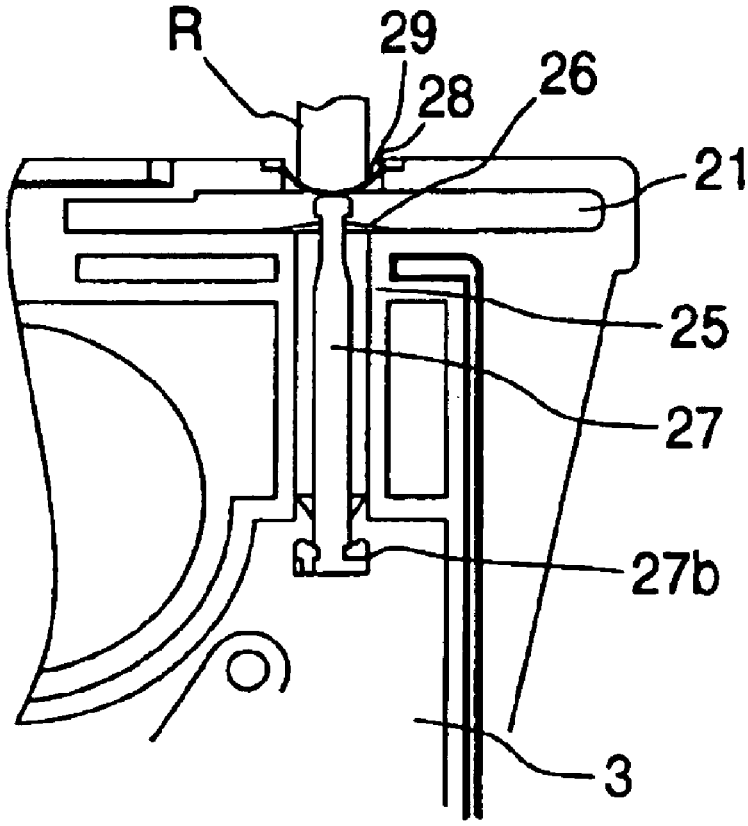
FIG. 8 shows a position of the valve member in a state that the ink cartridge of FIG. 1 is mounted to a recording device and opened to the atmosphere.

The air chamber 21 is communicated with the first ink chamber 3 via the cylindrical portion 25 that is located to be substantially opposite to the ink supply port 14. An opening 28 is located above the cylindrical portion 25 (see FIG. 4B), and the opening 28 is sealed by an elastically deformable, air impermeable film 29, As shown in FIG. 8, a valve member 27 is stored in the cylindrical portion 25. The valve member 27 is urged upwardly by a plate spring 26 to normally seal the first ink chamber 3.

With this arrangement, an operation rod R of a recording device, which advances when the ink cartridge 1 is mounted to the recording device, elastically deforms the air impermeable seal 29 to put the valve member 27 into a valve-open state, whereby the first ink chamber 3 is brought into communication with the air chamber 21.

Figure 5A:
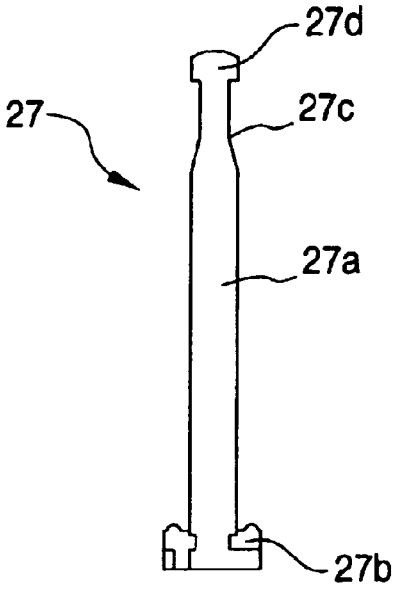
FIGS. 5A and 5B show a valve member and a spring for constructing the air communication passage of FIG. 4.
Figure 5B:
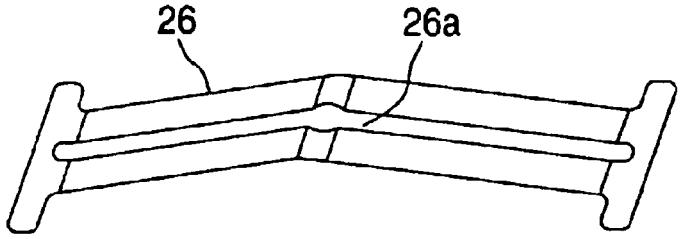

As shown in FIGS. 5A and 5B, the valve member 27 includes a slider 27*a* for penetrating through the cylindrical portion 25, and a valve 27*b* formed of elastic material. One end 27*d* of the slider 27*a* is exposed to the opening 28 formed in the upper surface of the ink cartridge and communicated with the air chamber 21, and the other end of the slider 27*a* is exposed to the first ink chamber 3. A portion 27*c* (below the one end 27*d*) of the slider 27*a* is attached to a fixed portion 26*a* of the plate spring 26, and the valve 27*b* is fixed to the other end of the slider 27*a*. The opening 28 is sealed by the elastically deformable, air impermeable film 29.

With reference to FIG. 3, the lower surface of the ink cartridge, where the ink supply port 14 is provided, is formed with a recessed portion 30 which is opened to the lower surface side and located just below the differential pressure valve storage chamber 4. In this embodiment, the recessed portion 30 defines a region where protrusions, 31 (see FIG. 2A) for ink cartridge identification purpose can be formed. As shown in FIG. 3, this lower surface is further formed with ink injection ports 32 and 33 through which ink is filled into the ink cartridge when the ink cartridge is manufactured. In FIG. 3, reference numeral 33*a* designates an opening of an ink suction flow passage A (FIG. 9) defined between the wall 11*a* and the outer wall of the ink cartridge, and a reference numeral 33*b* designates an opening of the first ink chamber 3. After ink injection, the ink injection port 32 is sealed by an air impermeable film or plug, and the ink injection port 33 is sealed by the same or another air impermeable film or plug while securing communication between the openings 33*b* and 33*a*. Reference numeral 34 designates a recessed portion for storing a memory device, which is formed in the side wall of the ink cartridge in the vicinity of the ink supply port 14. Reference numeral 35 designates a protrusion for assisting the attachment and detachment of the ink cartridge to and from the carriage of the recording device.

Figure 6A:
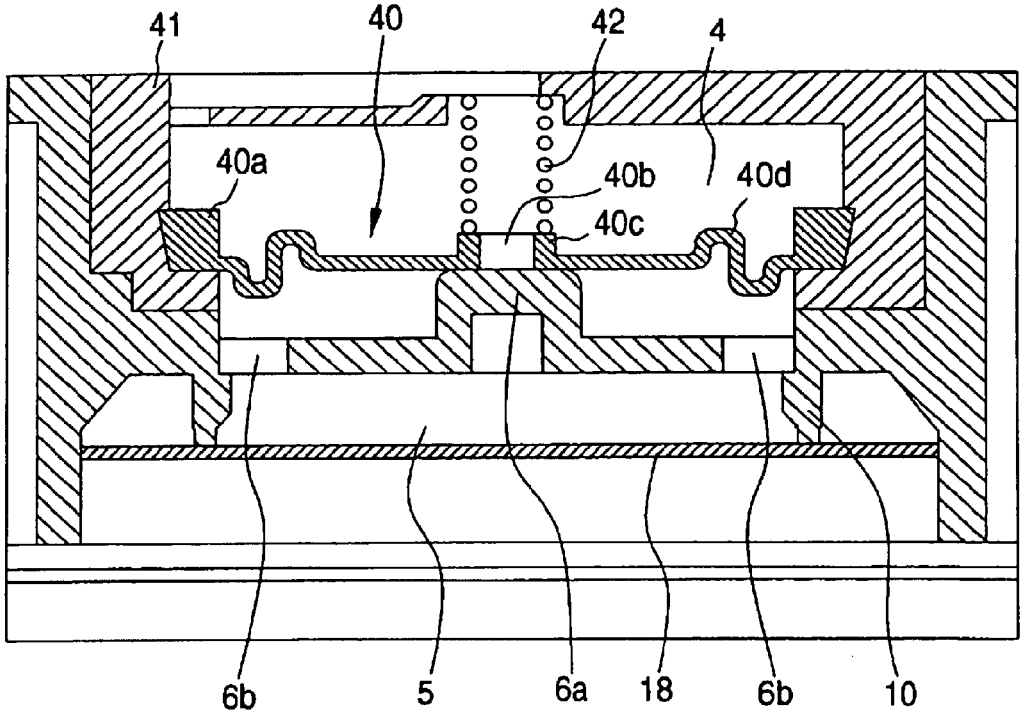
FIGS. 6A and 6B are sectional views showing an example of a differential pressure valve which constitutes a negative pressure generating mechanism.
Figure 6B:
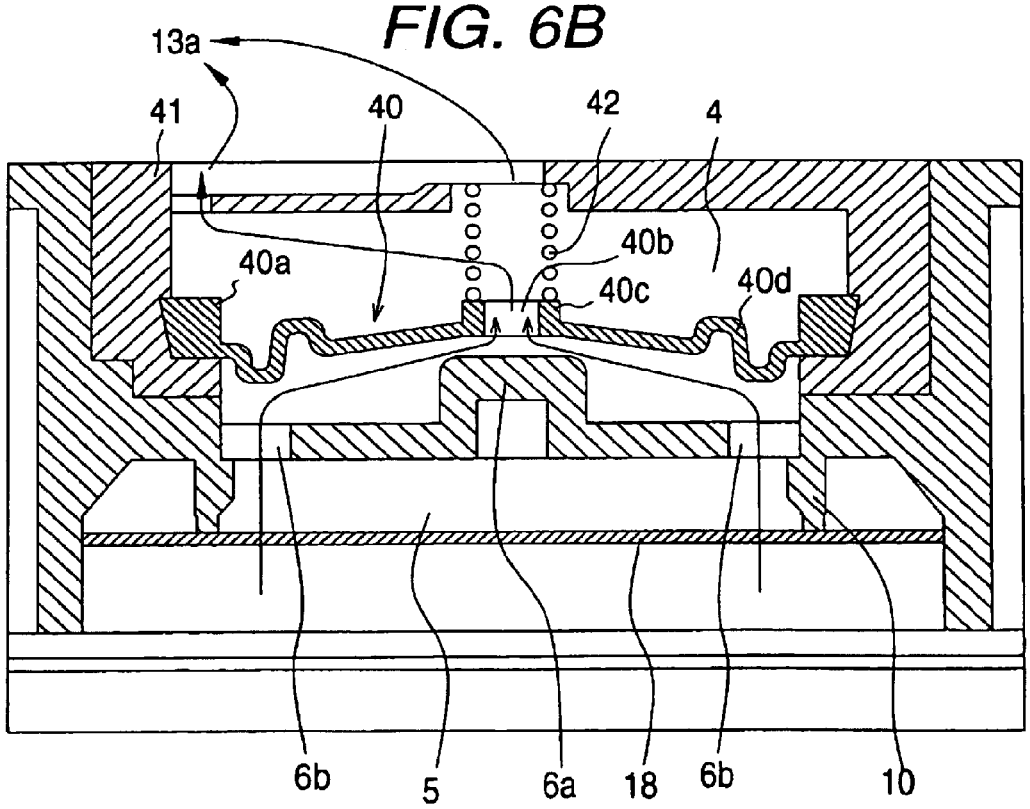

FIGS. 6A and 6B show an example of a differential pressure valve mechanism serving as negative pressure generating means (the negative pressure generating mechanism), wherein FIG. 6A shows a valve-closed state, and FIG. 6B shows a valve-open state. A membrane valve (a diaphragm valve) 40 includes an annular thick portion 40*a* along an outer periphery, a central thick portion. 40*c* having a through-hole 40*b* at its center and a bent portion 40*d* shaped into a substantially S-shape in section and located close to the annular thick portion 40*a*. The membrane valve 40 is fixedly fitted to a cylindrical holder 41, thereby being stored in the differential pressure valve storage chamber 4. A coiled spring 42 is inserted and interposed between the central thick portion 40*c* and the container body 1. The coiled spring 42 functions to permit separation of the membrane valve 40 from the valve seat 6*a* at the time when a predetermined negative pressure acts on the ink supply port 14 due to ink consumption by a recording head (see FIG. 6B), and to put the membrane valve 40 in elastic contact with the valve seat 6*a* at the time when ink supply to the recording head is complete (see FIG. 6A). To this end, the elastic force (the elasticity) of the spring is adjusted accordingly.

With reference to FIGS. 1A and 1B, the filter chamber side surface of the container body 1 is sealingly closed by a cover member 36, and the differential pressure valve storage chamber side surface thereof is sealingly closed by the air impermeable film 37, to thereby construct a sealed container.

To finish the ink cartridge thus constructed, the ink injection ports 32 and 33 are connected to an ink injection device to fill the ink cartridge with ink in a state that the ink supply port 14 is sealed with a film breakable by insertion of the ink supply needle, and after the filling of ink, these ink injection ports 32 and 33 are sealed by the plug(s) or air impermeable film(s).

Figure 7A:
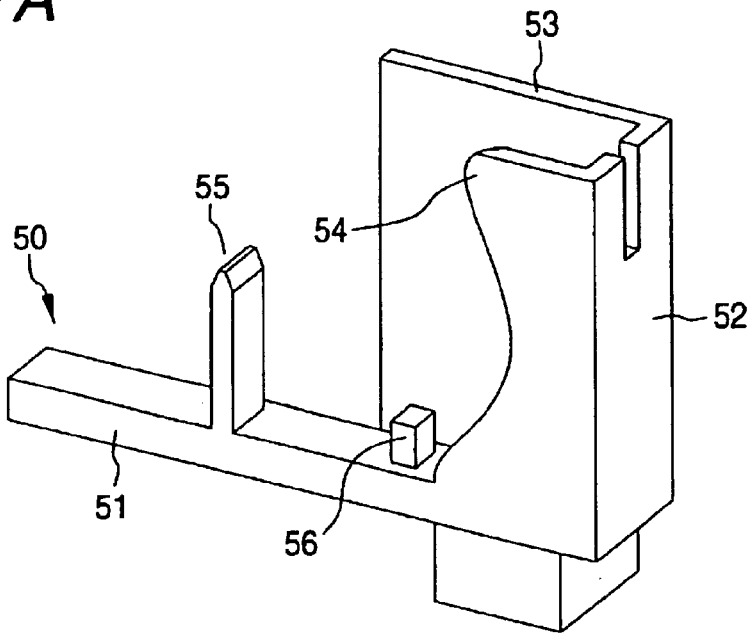
FIGS. 7A is a partially cut-away, perspective view showing an example of a cartridge holder suitable for the ink cartridge of FIG. 1.

FIG. 7A shows an example of a cartridge holder 50 suitable for the ink cartridge described above. The cartridge holder 50 includes a base portion 51, walls 52, 53, 54 provided on the base portion 51 to be in conformity with a front surface and side surfaces; adjacent to the front surface, of the ink cartridge, and a protruded portion 55 provided on the base portion 51 to be located at a position corresponding to a vertical recessed portion of the ink cartridge. If necessary, a protrusion(s) 56 for cartridge identification purposes (for identifying a kind of the ink cartridge) may be formed on the base portion 51.

In this embodiment, in a state where the ink cartridge is not mounted to a recording device, the valve 27*b* of the valve member 27 sealingly closes a first ink chamber side opening portion of the cylindrical member 25 by the urging force of the spring 26, and thus the first ink chamber 3 is isolated from the atmosphere. Consequently, evaporation and leakage of ink can be eliminated.

Figure 7B:
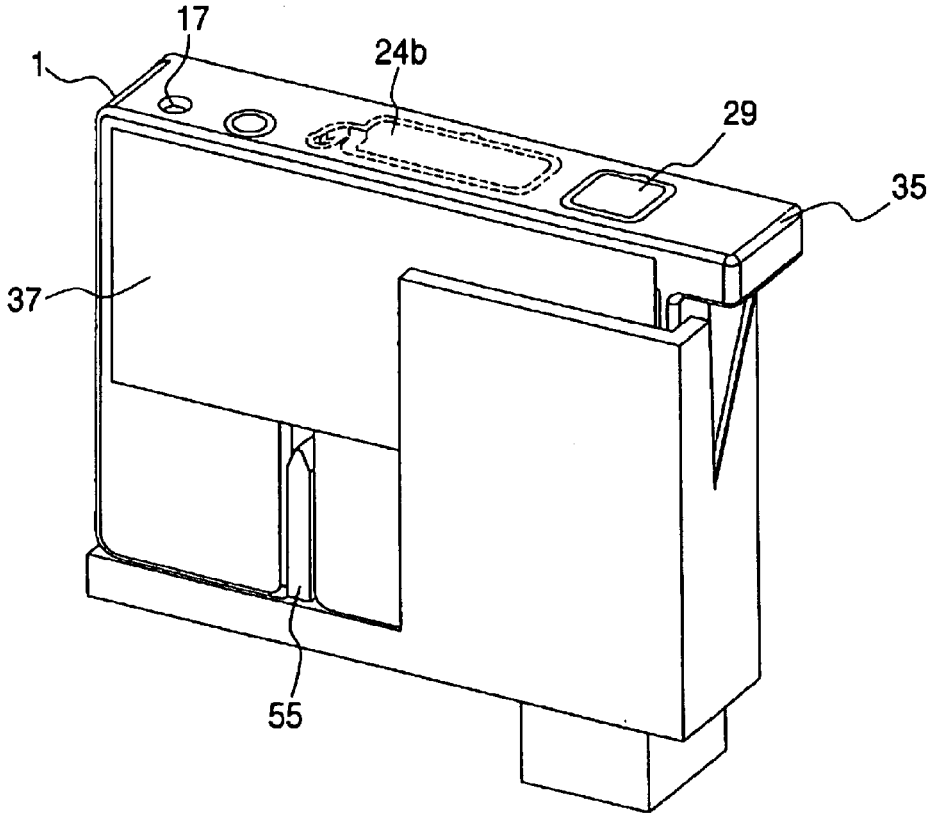
FIG. 7B is a perspective view showing a state that the ink cartridge is mounted to the holder.

On the other hand, when the ink cartridge is mounted to the cartridge holder 50, the front surface side three surfaces of the ink cartridge and recessed portion thereof are respectively guided by the walls 52, 53 and 54 and the protruded portion 55, so that the ink cartridge is positioned at a predetermined location as shown in FIG. 7B, and further, an operation rod R provided to the recording device depresses the valve member 27 through the air, impermeable film 29 to open the valve as shown in FIG. 8. Consequently, the first ink chamber 3 is communicated via the air chamber 21, the air permeable film 24*a*, the capillary 22 and the air communication port 17 with the atmosphere.

Under this condition, as the ink is consumed by the recording head so that a negative pressure acts on the ink supply port 14, the membrane valve 40 receives a differential pressure to be separated from the valve seat 6*a* against the urging force of the coiled spring 42. Ink in the first ink chamber 3 passes through the filter 18, flows into the differential pressure valve storage chamber 4 through the through-holes 6*b*, passes through the through-hole 40*b* of the membrane valve 40, and then flows through the flow passage 13 into the ink supply port 14.

The ink flow from the first ink chamber 3 to the filter chamber 5 will be discussed in more detail. When the negative pressure acts on the filter chamber 5 due to the flow-out of ink from the ink supply port 14, as shown in FIG. 9, ink in the first ink chamber 3 is sucked up and flows via passages defined by the walls 11, i.e. a flow passage A extending substantially vertically, a flow passage B extending horizontally at the uppermost portion, a flow passage C formed between the wall defining the filter chamber and the substantially horizontally extending wall 2, a vertical flow passage D and a horizontal passage E, into the upper portion of the filter chamber 5. Since ink in the first ink chamber 3 flows into the two upper section ink storage portions 15 and 16, and flows out of the ink storage portions 15 and 16 from bottom portions of the ink storage portions 15 and 16, air bubbles in the ink are trapped in the upper portions of the upper section ink storage portions 15 and 16. Accordingly, the air bubbles can be removed from ink as much as possible before the ink flows into the filter chamber 5.

Here, since both flow-in and flow-out of ink are conducted at the bottom portion of the upper section ink storage portion 16, it is possible to make constant a pressure (a water head pressure) acting on the differential pressure valve during the time period in which ink is consumed in the upper section ink storage chamber 16. That is, it is possible to reduce the variation of the water head pressure.

In this manner, during ink consumption, ink in the first ink chamber 3 located at the lower section is sucked up to the upper section filter chamber 5, and then supplied via the differential pressure valve mechanism to tho ink supply port 14. Therefore, ink pressure acting on the back surface of the membrane valve 40 is not so influenced by pressure variation stemming from the motion of ink stored in the first ink chamber 3, and thus an optimal negative pressure can be maintained to supply ink to the recording head.

If the ink cartridge is detached because ink is completely consumed or the ink kind is to be changed, the valve member 27 is closed because of the absence of the support by the operation rod provided on the recording device, and the membrane valve 40 is elastically contacted with the valve seat 6*a* by the urging force of the coil spring 42. Therefore, leakage of ink from the ink supply port 14 is prevented.

In the first exemplary embodiment, the differential pressure valve mechanism serving as the negative pressure generating means (the negative pressure generating mechanism) is stored in the second ink chamber 8 located in the upper section. However, the present invention should not be restricted thereto or thereby. That is, the differential pressure valve mechanism may be located at any portion of the passage connecting the second ink chamber 8 to the ink supply port 14. It is apparent that, regardless of the storage position of the differential pressure valve mechanism, the differential pressure valve mechanism can apply a negative pressure to ink stored in the upper section ink chamber 8 to supply the ink to the ink supply port 14.

In the first embodiment, a case that an identification block is mounted to (or the protrusion 31 is provided at) the recessed portion of the ink cartridge to prevent erroneous mounting of the ink cartridge, has been described. However, the present invention should not be restricted thereto or thereby. In a case where such erroneous mounting is not conceivable, for example, in a case of a cartridge (a black ink cartridge) different in outer configuration from other cartridges (yellow ink cartridge, cyan ink cartridge, and magenta ink cartridge) used together, such an identification block or protrusion can be dispensed with.

Figure 10:
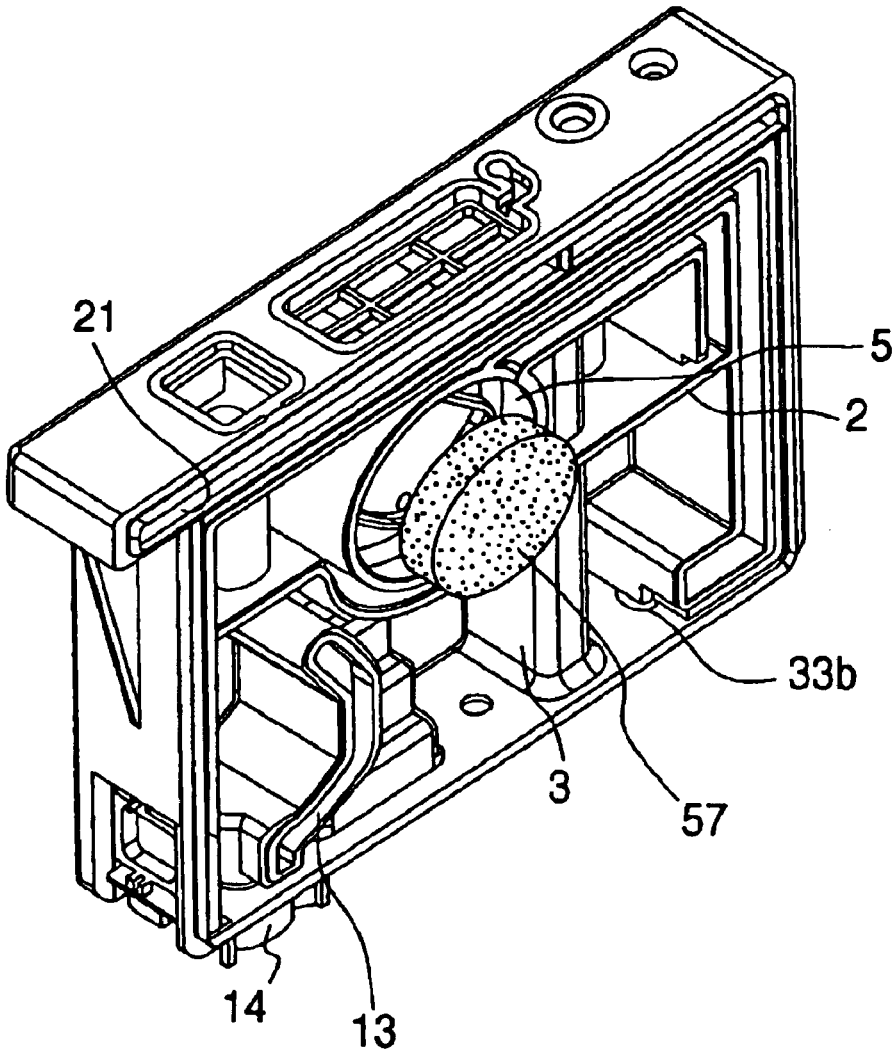
FIG. 10 is a perspective view showing a modification directed to but not limited to the ink cartridge of the first embodiment.

Further, as shown in FIG. 10, if a porous member 57 is fillingly inserted into the filter chamber 5 without the use of the filter 18 or in combination with the filter 18 overlapping the porous member 57, it is possible to more positively eliminate adverse effects caused by foreign substances, such as air bubbles, hindering the printing, and the short cycle pressure variation of ink. In case the porous member is used alone, it is possible to dispense with a welding process for the filter, and thus the manufacture is easy. Further, if the porous member is made of the same material as that of the container body, then a recycling ability can be enhanced.

Figure 11A:
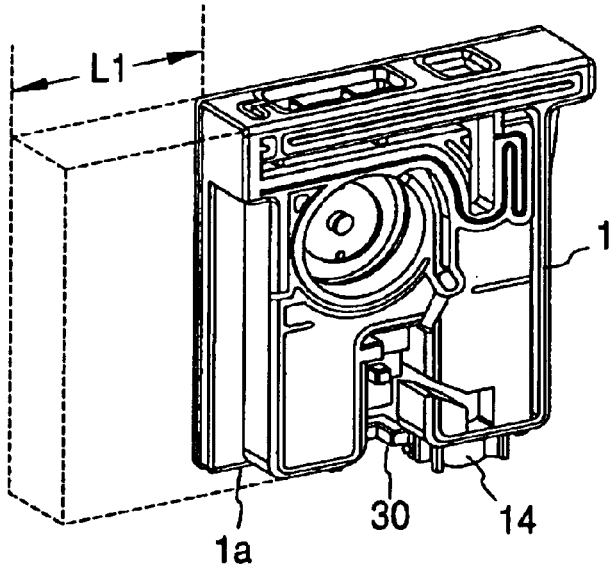
FIGS. 11A and 11B are perspective view showing other modifications directed to but not limited to the ink cartridge of the first embodiment, in which capacity of the ink cartridge is changed.
Figure 11B:
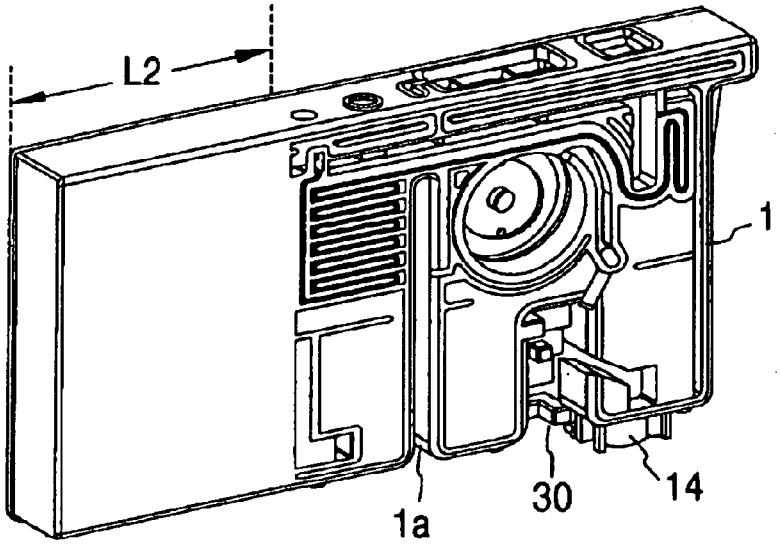

Further, as shown in FIGS. 11A and 11B, an ink storage amount of the ink cartridge can be changed without any change in ink cartridge attachment/detachment capability and characteristics of ink supply to the recording head, by simply changing a volume (the length L1, L2) of an ink storage portion located opposite the identification piece (identification protrusion) of the recessed portion 30.

In addition, the lower section ink chamber (i.e. the first ink chamber 3 in this first embodiment) serves as a buffer chamber.

That is, during the use of the ink cartridge, even if air bubbles trapped in the upper section ink storage portion (i.e. the second ink chamber 8 in this embodiment) are expanded due to temperature change, ink in the upper section ink storage portion is returned through the ink suction passage (the flow passage A in this embodiment) into the lower section ink storage portion (the first ink chamber 3 in this embodiment) communicated with the atmosphere without being forced into the differential pressure valve storage chamber. Therefore, it is possible to avoid the leakage of the ink from the ink supply port. The ink returned to the lower section ink storage portion is again sucked up by the ink suction passage into the upper section ink storage portion as ink is consumed by the recording head, and therefore ink in the ink cartridge can be consumed efficiently.

Second Embodiment

Figure 12A:
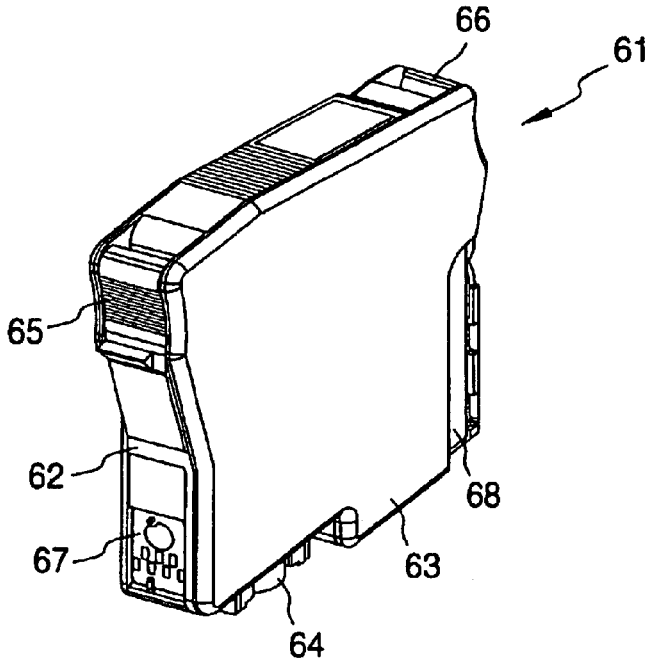
FIGS. 12A and 12B are perspective views showing an external appearance of an ink cartridge which constitutes a second embodiment of the present invention.
Figure 12B:
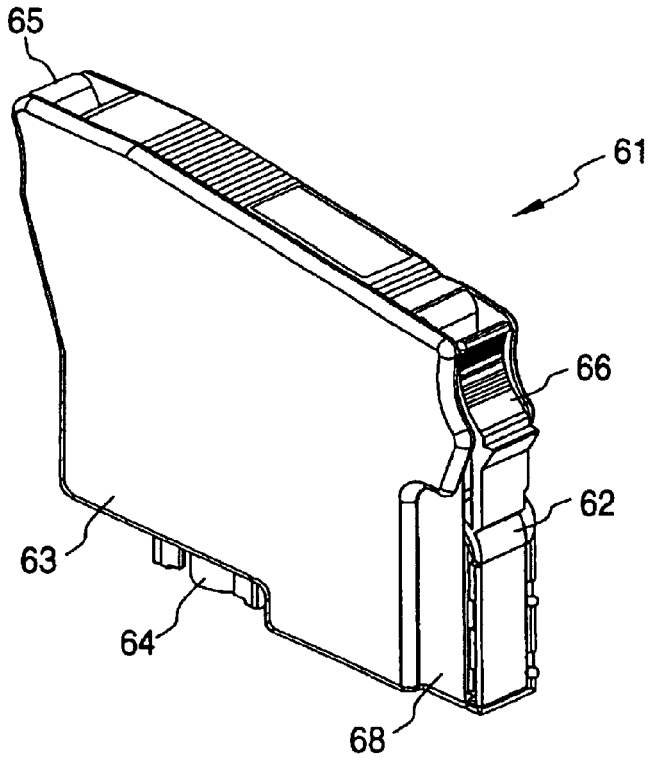

FIGS. 12A and 12B show an external appearance of an ink cartridge which constitutes a second exemplary embodiment of the present invention. The ink cartridge 61 is mainly constructed of a flat, rectangular container body 62 whose one side is opened, and a cover member 63 for sealingly closing the opening. The container body 62 is integrally formed with an ink supply port 64 at the forward end thereof as viewed in the cartridge insertion direction (the lower end in this embodiment), and retaining members 65 and 66 at the corners of the upper part thereof. A memory device 67 is provided under the retaining member 65, which is located on the ink supply port (64) side. A valve storage chamber 68 is provided under the other retaining member 66. A valve member (not shown) is stored in the ink supply port 64 so as to be opened when an ink supply needle is inserted into the ink supply port 64.

Figure 13:
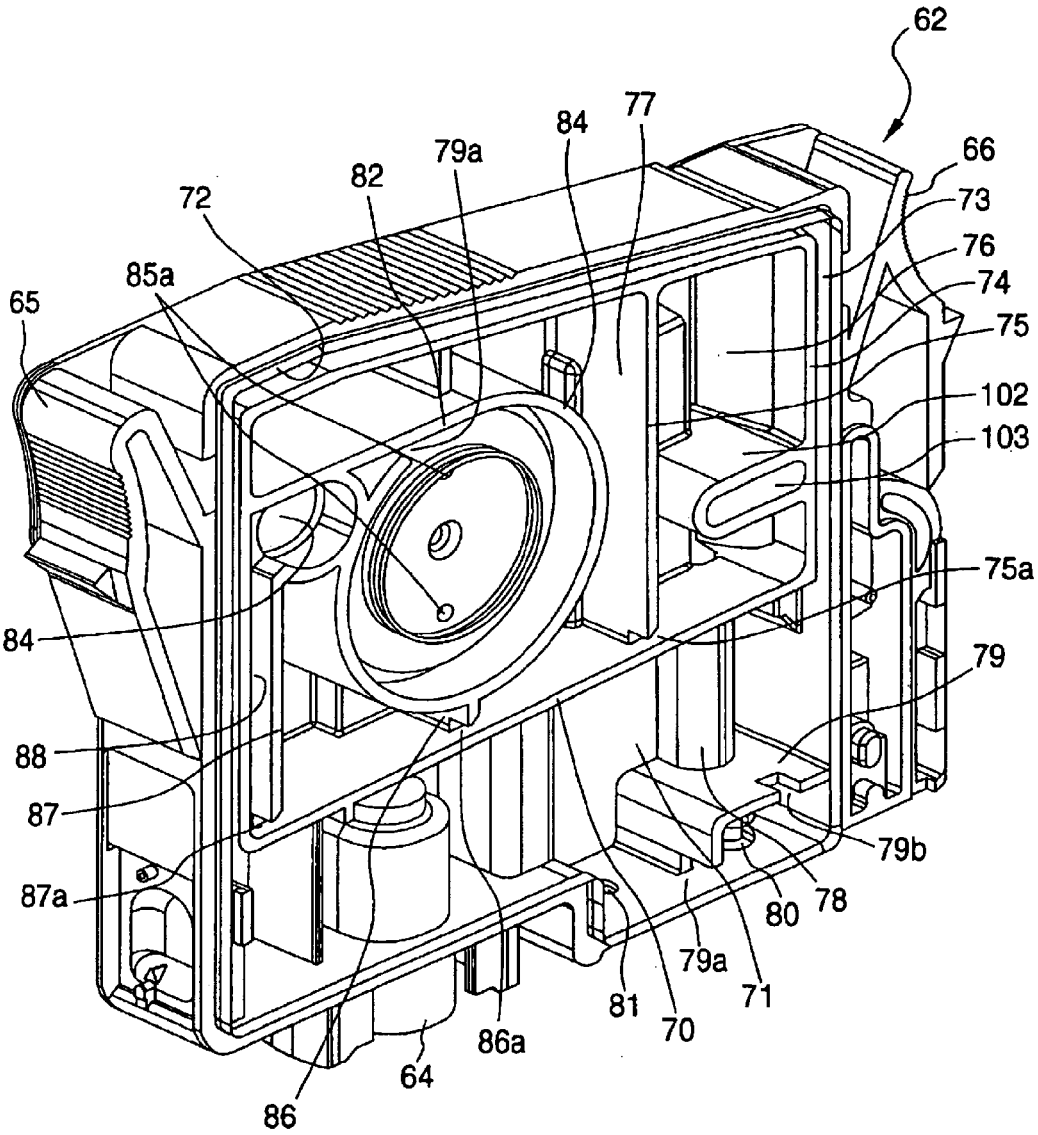
FIG. 13 is a perspective view showing an opened side structure of a container body of the ink cartridge of FIG. 12.
Figure 14:
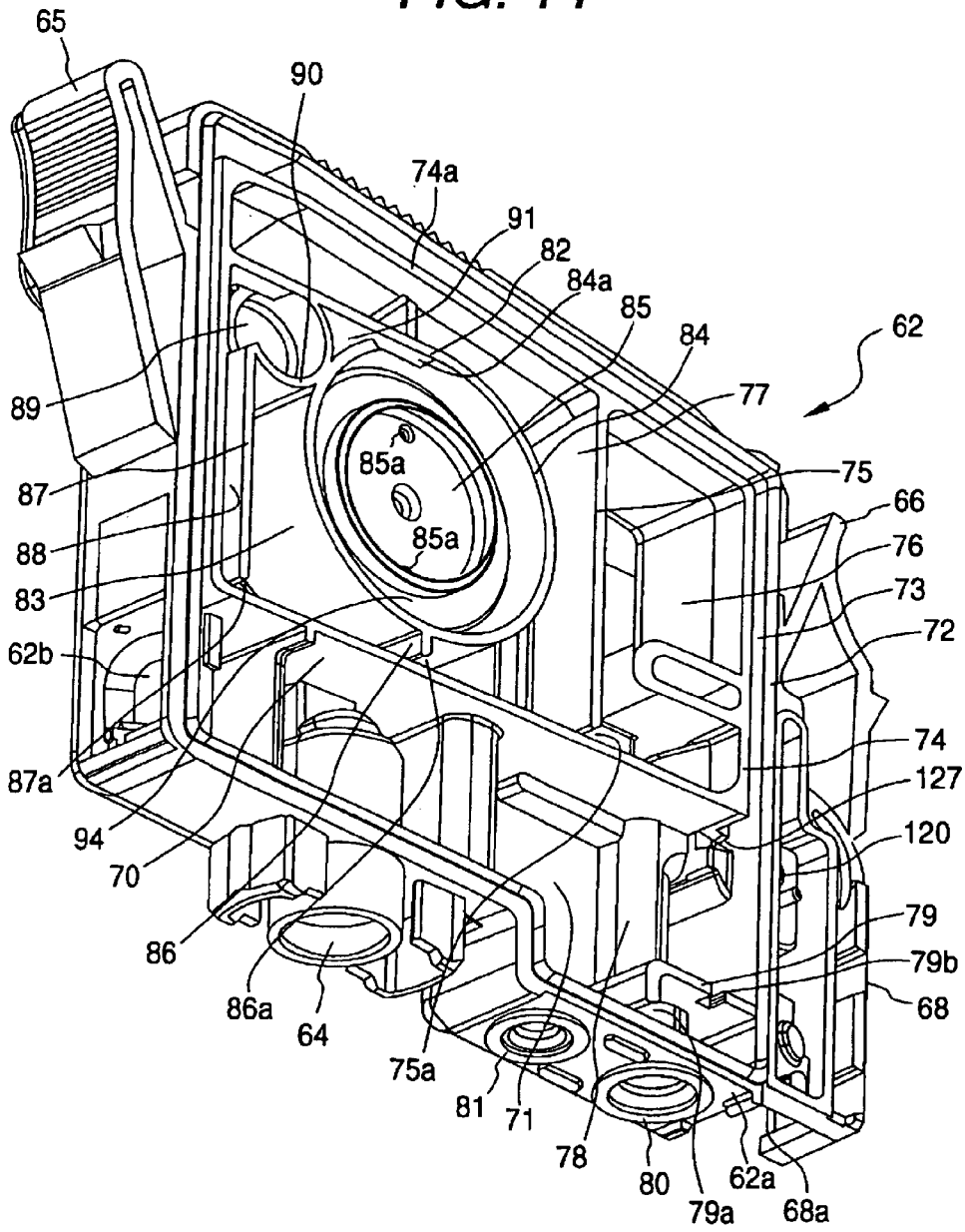
FIG. 14 is a perspective view showing a bottom surface structure of the container body of the ink cartridge of FIG. 12.

FIGS. 13 and 14 show an example of a flow passage formed in the container body 62 of the ink cartridge. The inner space of the container body 62 is divided into upper and lower sections by a wall 70, which extends substantially horizontally, in more detail, which extends so that the ink supply port 64 side is located somewhat lowered.

The lower section contains a first ink chamber 71 serving as a lower section ink chamber. The upper section is defined by a frame 74, with the wall 70 as its bottom, thereby forming an upper section ink chamber. The frame 74 is spaced apart from a wall 72 of the container body 62 so as to form an air communicating passage 73. The inner space of the frame 74 is divided, by a vertical wall 75 with a communication port 75*a* formed in the bottom thereof, into space sections. One of the space sections is used as a second ink chamber 76, while the other is used as a third ink chamber 77.

Figure 15:
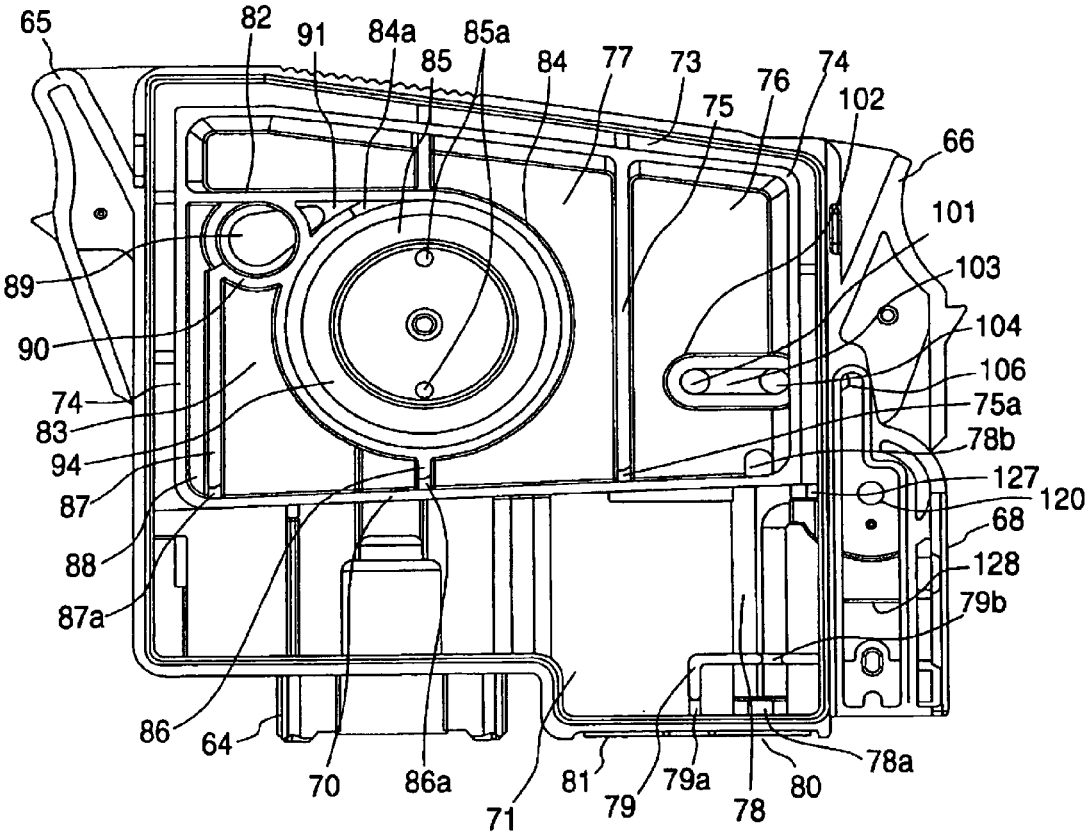
FIG. 15 is an elevational view showing the opened side structure of the container body of the ink cartridge of FIG. 12.

A suction passage 78 is formed in the second ink chamber (76) side. The suction passage 78 communicatively connects the second ink chamber 76 to a bottom surface 62*a* of the container body 62 (i.e. to a bottom region of the first ink chamber 71). A cross sectional area of the suction passage 78 is selected so as to deal with such an amount of ink as to be consumed by the recording head. As shown in FIG. 15, an ink suction port 78*a* is formed at the lower end of the suction passage. The ink suction port 78*a* is opened into the first ink chamber 71, and is capable of holding ink by a capillary force. An exit port 78*b* is formed at the upper end of the suction passage 7B. The exit port 78*b* is opened into a bottom portion of the second ink chamber 76.

A wall 79 is formed at a lower portion of the suction passage 78. The wall 79 includes communication ports 79*a* and 79*b* formed therein. An ink injection hole 80 for injecting ink into the container body 62 from an exterior is formed at a part facing the suction passage 78, and an ink injection hole 81 is communicated with the first ink chamber for injecting ink. The suction passage 78 is constructed such that a recessed part 78*c* (FIG. 16) is formed in a surface of the container body 62, and the recessed part 78*c* is sealed with an air impermeable film.

The third ink chamber 77 is defined by walls 82 and 84, which are spaced from an upper surface 74*a* of the frame 74 by a predetermined gap. A fourth ink chamber 83 is defined by walls 86, 84 and 87. A filter chamber 94 for storing a filter 115 is defined by the wall 84 continuous to the wall 82. A wall 85 defines a differential pressure valve storing chamber 93 (FIG. 16) on one side in the thickness direction of the container body, and the filter chamber 94 on the other side. Through holes 85*a* are formed in the wall 85 so as to introduce ink, which has passed through the filter, into the differential pressure valve storage chamber 93 located opposite the filter chamber 94.

The partitioning wall 86 having a communication port 86*a* is provided at the lower portion of the wall 84 so that the communication port 86*a* is located between the wall 84 and the wall 70. The partitioning wall 87 having a communication port 87*a* at its lower portion is also provided so that an ink passage 88 is formed between the partitioning wall 87 and the frame 74. The upper part of the ink passage 88 is communicated with a surface side of the ink cartridge 61 through a through hole 89. In FIG. 14, reference numeral 62*b* indicates a recess for storing the memory device 67.

Figure 16:
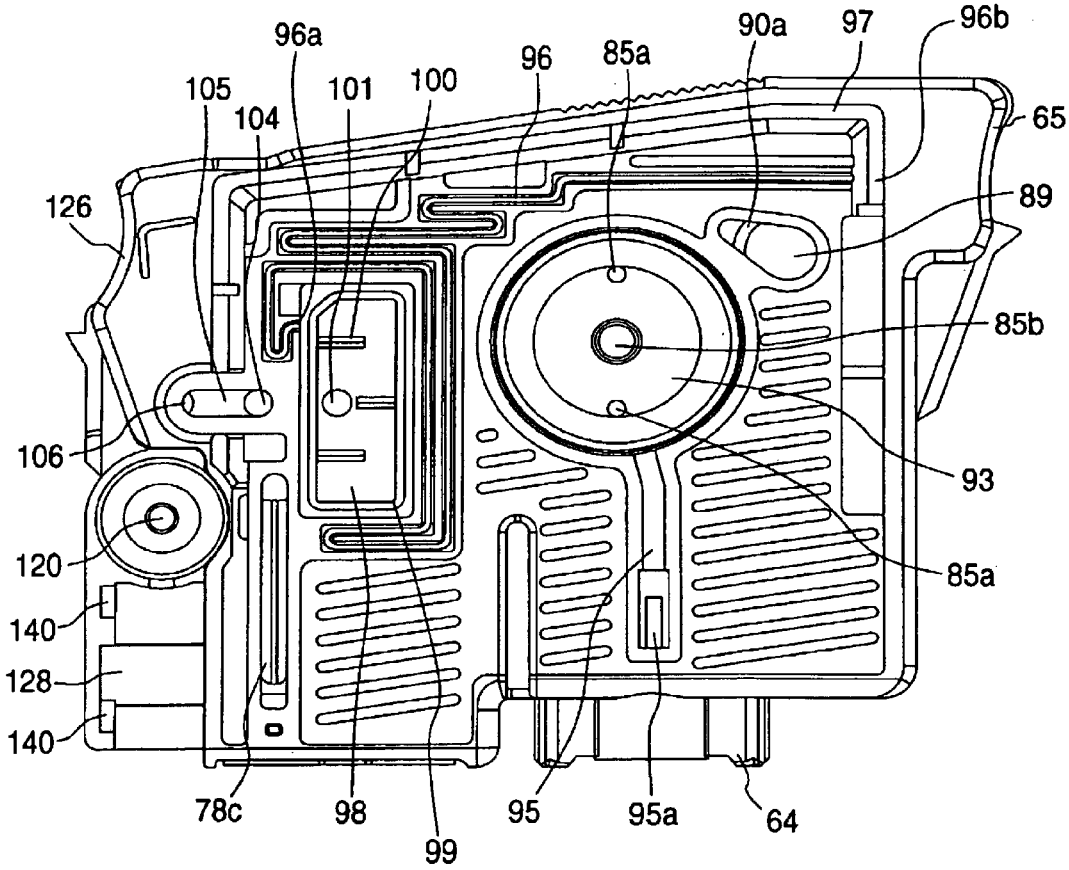
FIG. 16 is an elevational view showing a surface side structure of the container body of the ink cartridge of FIG. 12.

The through hole 89, as shown in FIG. 15, is separated by a wall 90 continuous to the partitioning wall 87. The through hole 89, as shown in FIG. 16, is communicated with the upper part of the filter chamber 94 through a recess 90*a*. In more detail, the through hole 89 is communicated with a region 91 defined by the walls 90, 84 and 82, through the recess 90*a*, and further communicated with the upper part of the filter chamber 94 through a communication port 84*a* (FIG. 14) formed at the upper part of the wall 84 defining the filter chamber 94.

A lower part of the differential pressure valve storing chamber 93 and the ink supply port 64, as shown in FIG. 16, are interconnected by a passage that is constructed by a recess 95 formed in the surface and an air impermeable film covering the recess 95. In the figure, reference numeral 95*a* represents a deep part entering the ink supply port side.

A narrow groove 96, a wide groove 97 and a recess 98 are formed in the surface of the container body 2. The narrow groove 96 meanders so as to provide the largest possible flow resistance. The wide groove 97 is disposed around the narrow groove 96. The recess 98 is rectangular in shape, and disposed in an area opposite the second ink chamber 76. A frame 99 and ribs 100 are formed in the recess 98 to be slightly lowered from an open end of the recess 98. A part of the open end of the recess 98 is communicated with one end 96*a* of the narrow groove 96. The other end 96*b* of the narrow groove 96 is opened to the atmosphere. An air permeable film having an ink repellent property and an air permeability is bonded to the frame 99 and ribs 100, thereby defining an air communication chamber. A through hole 101 is formed at the bottom of the recess 98, and communicated with a slender region 103 (FIG. 15) defined by a wall 102 of the second ink chamber 76. The narrow groove 96 is communicated with the recess 98 at a position closer to the surface side (i.e. the open end side) than the air permeable film is provided. The other end of the region 103 is communicated with the valve storage chamber 68 through a through hole 104, a communicating groove 105 and a through hole 106. In short, an air communication passage is formed to extend from the other end 96*b* of the narrow groove 96 via the one end 96*a* of the narrow groove 96, the air permeable film bonded to the frame 99 and ribs 100, the through hole 101 formed in the bottom of the recess 98, the slender region 103, the through hole 104, the groove 105, and the through hole 106 to a through hole 120 of the valve storage chamber 68. The through-hole 120 is further communicated via a flow passage (not shown, but formed in or provided in the container body 62) and a through hole 127 with the first ink chamber 71.

A window 68*a* is formed and opened at the cartridge insertion leading end of the valve storage chamber 68, i.e. the lower end of the valve storage chamber 68 in the embodiment shown in FIG. 14. The valve storage chamber 68 stores an air-open valve 125 (see FIG. 18) at its upper part, which is normally closed, but opened by a valve operating rod (not shown) provided on the recording device body to enter into the chamber. That is, the air-open valve 125 is provided at the through hole 120 so that the through-hole 106 can be communicated with and isolated from the through-hole 127.

Figure 17:
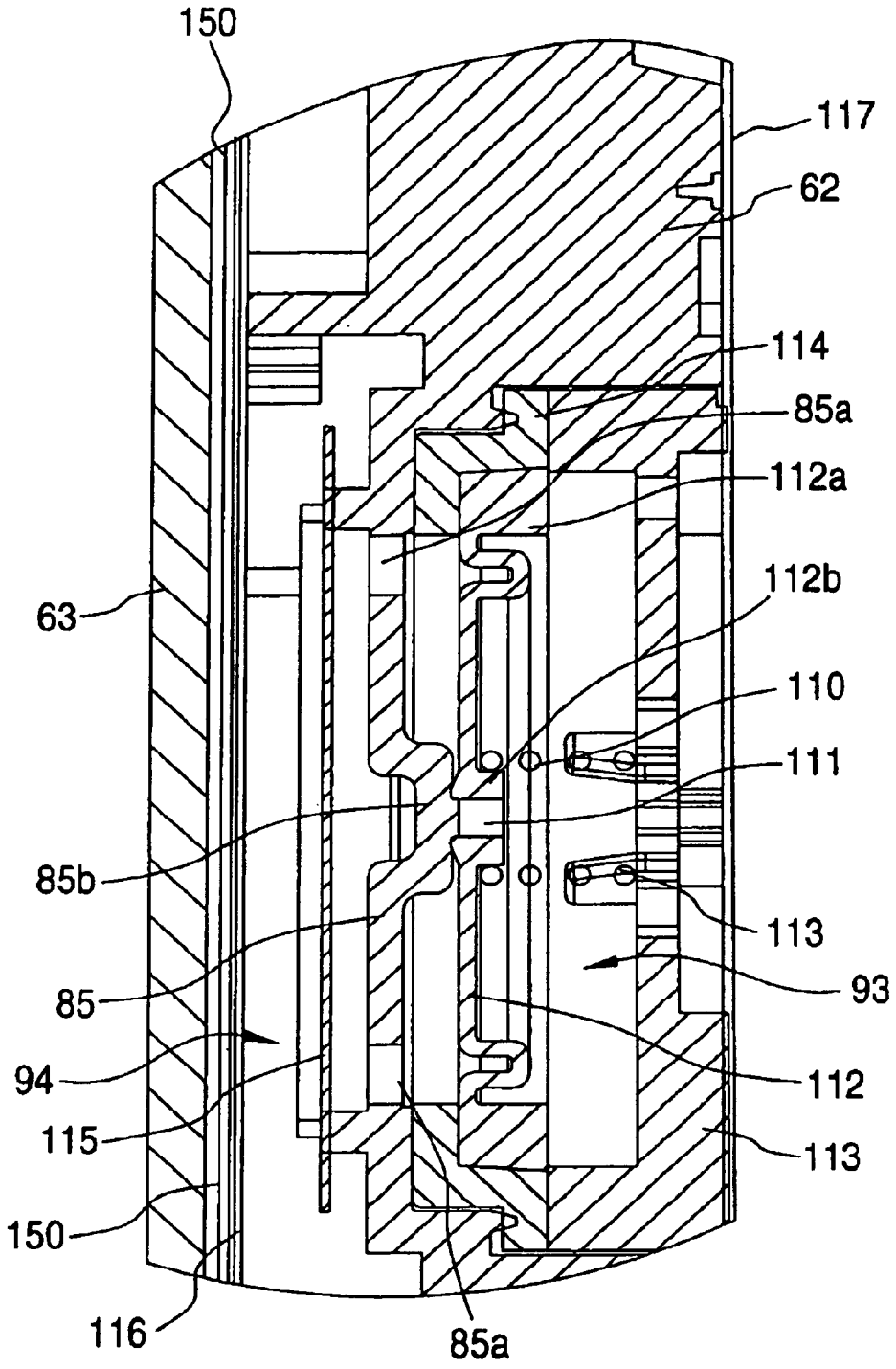
FIG. 17 is an enlarged sectional view showing a structure of a differential pressure valve storage chamber.

FIG. 17 is a sectional view showing vicinities of the differential pressure valve storage chamber 93. A spring 110 and a membrane (film) valve 112 is stored in the differential pressure valve storage chamber 93. The membrane valve 112 is formed of an elastically deformable material, such as elastomer, and has a through hole 111 at its center. The membrane valve 112 includes an annular thick part 112*a* circumferentially provided and a frame 114 formed integrally with the annular thick part 112*a*. The membrane valve 112 is fixed to the container body 62 through the frame 114. The spring 110 is supported at one end by a spring receiving part 112*b* of the membrane valve 112, and at the other end by a spring receiving part 113*a* of a lid member 113 for the differential pressure valve storage chamber.

In the figure, reference numeral 115 represents a filter provided in the filter chamber 94, an 116 and 117 are air impermeable films bonded onto the surface side and the opened surface side of the container body 62. The air impermeable film 116 is bonded to the wall 70, the frame 74, and the walls 75, 82, 84, 86, 87, 90 and 102 (FIG. 15) by welding or the like.

In this structure, ink having passed through the filter 115 passes through the ink passing ports 85*a*, and is blocked by the membrane valve 112. When, in this state, a pressure at the ink supply port 64 is lowered, the membrane valve 112 moves apart from a valve seat 85*b* against an urging force of the spring 110, so that the ink passes through the through hole 111 and flows to the ink supply port 64 via the passage formed by the recess 95.

When an ink pressure at the ink supply port 64 is increased to a predetermined value, the membrane valve 112 is brought into resilient (elastic) contact with the valve seat 85*b* by the urging force of the spring 110. As a result, the ink flow is interrupted. By repeating this operation, ink is discharged to the ink supply port 64 while maintaining a constant negative pressure.

Figure 18:
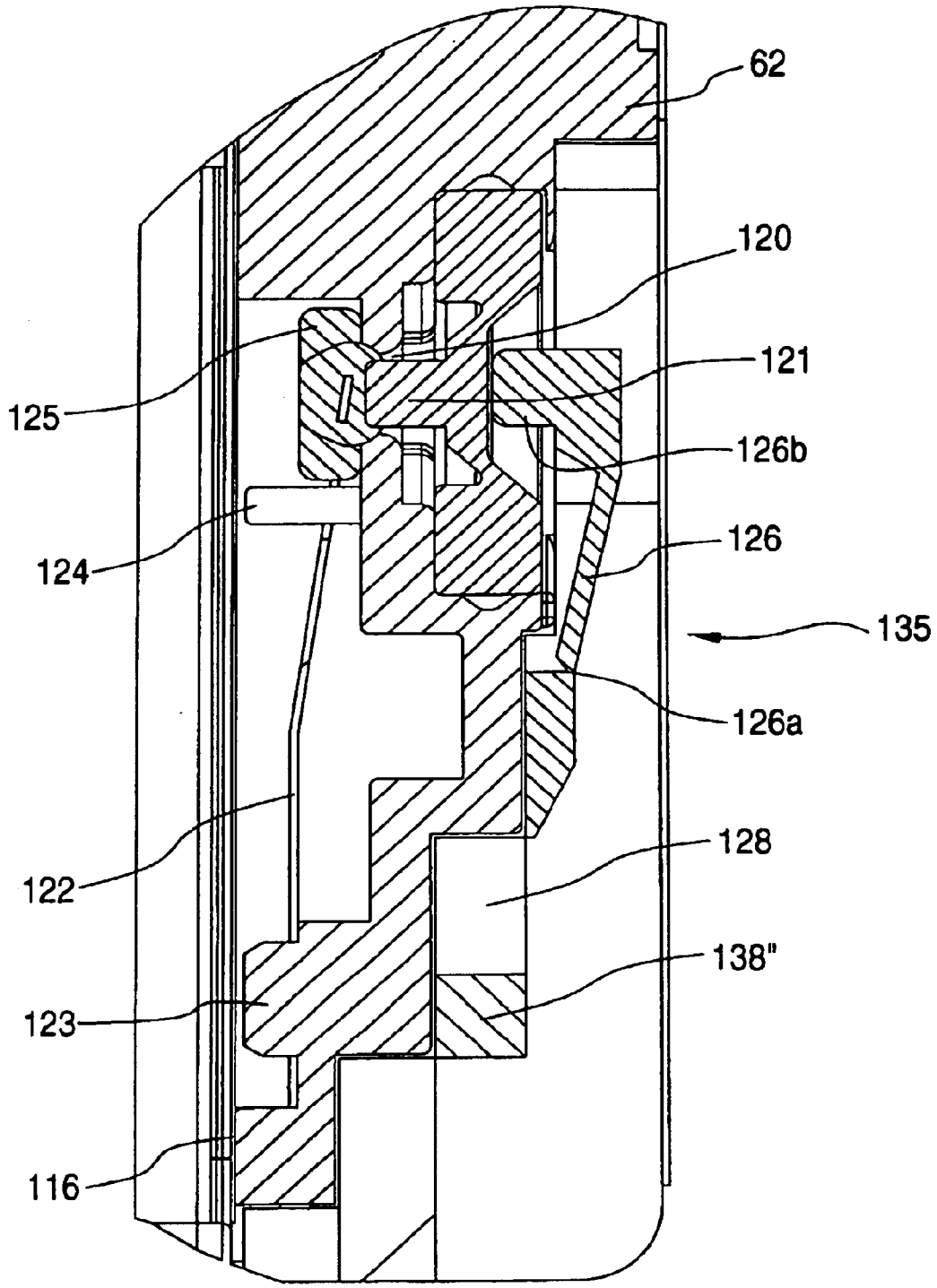
FIG. 18 is an enlarged sectional view showing a structure of a valve chamber for communication with the atmosphere.

FIG. 18 is a sectional view showing a structure of the valve storage chamber 68 for communication with the air. The through hole 120 is bored in the wall defining the valve storage chamber 68. A pressing member 121 formed of an elastic material, such as rubber, is movably inserted into the through hole 120 in a state that its circumference is supported with the container body 62. Provided on the insertion leading end of the pressing member 121 is the valve member 125, which is supported by an elastic member, such as a plate spring 122, having a lower end fixed by a protrusion 123 and a central portion restricted by a protrusion 124. The valve member 125 is constantly urged toward the through hole 120.

Figure 20A:
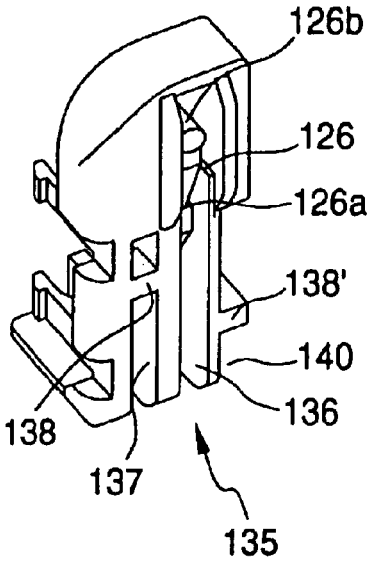
FIGS. 20A and 20B are perspective views showing an identification block.
Figure 20B:
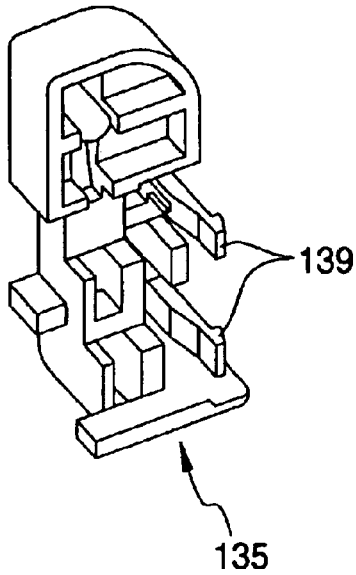

A cartridge-identifying block 135, as shown in more detail in FIGS. 20A and 20B is mounted on the other surface of the pressing member 121. The cartridge-identifying block 135 has: a fulcrum 126*a* that is formed by the ink cartridge insertion side of the block 135, i.e. the lower end thereof in the embodiment to be positioned slightly inwardly from the valve operating rod of the recording device; an arm 126 that is formed by the ink cartridge removing side of the block 135, i.e. the upper portion side thereof in this embodiment, to obliquely extending into an advancing path of the valve operating rod; and a protruded part 126*b* that is provided at the top of the arm 126 for elastically pressing the pressing member 121. With this structure, when the valve member 125 is put into a valve open state, a through hole 127 formed in the upper part of the first ink chamber 71 is brought into communication with the air communication recess 98 via the through hole 120.

A recess 128 for fixing the cartridge-identifying block for judgment as to whether the ink cartridge is compatible with a recording device is formed in the insertion side from the arm 126, i.e. a lower side in this embodiment. The identification block 135 shown in FIG. 20 is mounted to the recess 128 such that the judgment of the compatibility of the ink cartridge is complete before the ink supply port 64 is communicated with an ink supply needle and before the valve member 125 is opened. In FIG. 18, reference numeral 138" is a protruded part serving as an identifying part of the cartridge-identifying block 135.

The cartridge-identifying block 135 includes guide grooves 136, 137 and 140 (FIG. 20A) which respectively guide the entering of the valve operating rod and the identifying pieces provided in the recording device. Protrusions 138 and 138' are provided at predetermined positions in the guide grooves into which the identifying pieces enter. The protrusions 138 and 138' are provided at least at such positions as to be different from cartridge to cartridge in the insertion direction, so that if an ink cartridge incompatible with a recording device is inserted, these protrusions 138 and 138' come in contact with the identifying pieces to inhibit the further insertion.

In FIG. 20B, reference numeral 139 designates pawls for engagement with recessed parts 140 formed in the container body.

With this construction, when the ink cartridge 61 is inserted into the cartridge holder having the valve operating rod that erects on the lower surface thereof, the valve operating rod comes in contact with the slanted arm 126 of the cartridge identifying block 135. As the insertion of the ink cartridge 61 progresses, the pressing member 121 is moved toward the valve member 125. As a result, the valve member 125 is moved apart from the through hole 120, so that the first ink chamber is opened to the air via the through hole 106, groove 105, through hole 104, region 103, through hole 101 and the air permeable film.

When the ink cartridge 61 is pulled out of the cartridge holder, the arm 126 loses its support by the valve operating rod. As a result, the spring 122 causes the valve member 125 to close the through hole 120 to interrupt the communication between the first ink chamber 71 and the air.

In a state that all the parts including the valves are assembled into the container body 62, the air impermeable film 117 (FIG. 17) is bonded, by thermal welding or the like, to the surface of the container body 62 so as to cover at least the recessed parts. As a result, the capillary serving as the air communication passage is formed in the surface thereof by the narrow groove 96 and the air impermeable film 117.

The air impermeable film 116 (FIG. 17) is bonded, by thermal 10 welding or the like, onto the opened portion of the container body 62 so as to mainly seal the second ink chamber 76, third ink chamber 77 and fourth ink chamber 83 hermetically. Consequently, the regions defined by the walls 70, 74, 75, 82, 84, 86, 87, 90 and 102 are sealed so as to communicate with one another, only through the suction passage 78 and the communication ports 75*a*, 86*a* and 87*a*.

Then, the opening side of the valve storage chamber 68 is also sealed with the air impermeable film 116' (FIG. 18). Finally, the sealing cover member 63 is fixed, by welding or the like, so as to secure a predetermined gap between the cover member 63 and the film 116, preferably such a gap as to allow the film 116 to be deformed by an ink pressure variation. As a result, the first ink chamber 71 is sealingly closed, and the assembling of the ink cartridge is completed.

By adopting such a structure that the ink storage regions are sealed with the film 116, the container body 62 can be formed using a simple process, i.e., injection molding of high polymer, to have a plurality of partitioned ink storage chambers and regions, and further a movement of ink caused by the reciprocal motion of the carriage can be absorbed through a deformation of the film 116.

Subsequently, using the ink injection holes 80 and 81, air is discharged from the cartridge, and then sufficiently degassed ink is injected into the cartridge. After the ink injection is completed, the ink injection holes 80 and 81 are sealed with a film(s) or a plug member(s). In this state, the spaces ranging from the first to fourth ink chambers 71, 76, 77, 83, suction passage 78, filter chamber 94, differential pressure valve storage chamber 93, recessed portion 95 to the ink supply port 104 are filled with the ink.

The lower ink storage region, i.e., the first ink chamber 71, is sealed with the container body 62 and the cover member 63. The upper ink storage regions, i.e., the second ink chamber 76, third ink chamber 77, fourth ink chamber 83 and filter chamber 94 in the second embodiment, are defined by the film 116 located between the container body 62 and the cover member 63. In this case, a space 150 (FIG. 17) communicated with the first ink chamber 71 is present. Accordingly, there is a case that some amount of ink also enters into this space when an amount of the filled ink reaches any of some specific amounts of the ink.

In the thus constructed ink cartridge, the ink is stored therein while being isolated from the air by the valve and the like. Accordingly, in case that degassed ink is stored, the degassed rate of ink is fully maintained.

When the ink cartridge 61 is loaded into the cartridge holder, the ink supply port 64 advances until it receives the ink supply needle if the cartridge is compatible with the cartridge holder. The through hole 120 is opened by the valve operating rod as already stated, the first ink chamber 71 (the ink storage regions) are communicated with the air, and the valve member of the ink supply port 64 is also opened with the ink supply needle.

When the ink cartridge is not compatible with the cartridge holder, the insertion of the ink cartridge is inhibited before the ink supply port 64 reaches the ink supply needle, at least before the valve member in the ink supply port is opened by the ink supply needle. The valve member 125 keeps the sealing state of the ink cartridge to prevent an unnecessary replacement of the air within the ink storage regions, to thereby prevent the ink solvent from evaporating.

When the ink cartridge is normally loaded into the cartridge holder and the ink is consumed by the ink jet recording head, a pressure at the ink supply port 64 drops below a predetermined pressure value. Accordingly, the membrane valve 112 is opened as stated above. When the pressure at the ink supply port 64 rises more than a predetermined value, the membrane valve 112 is closed. Ink that is kept at a predetermined negative pressure flows into the recording head (FIG. 19I; the hatched areas in FIGS. 19I to 19V indicate the ink contained in the first to fourth ink chambers 71 to 83 and the like).

As the consumption of the ink by the recording head progresses, the ink in the first ink chamber 71 flows into the second ink chamber 76 via the suction passage 78. Air bubbles, which have flowed, together with the ink, into the second ink chamber 76, rise by a buoyant force, so that only the ink flows into the third ink chamber 77 via the lower communication port 75*a*.

The ink in the fourth ink chamber 83, having passed through the communication port 86*a* of the partitioning wall 86 defining the filter chamber 94, rises through the ink passage 88 and flows into the upper part of the filter chamber 94, from the region 91. The ink having passed through the filter 115 flows into the differential pressure valve storage chamber 93 through the through holes 85*a*, and as mentioned above, flows into the ink supply port 64 under a predetermined negative pressure through the opening and closing operations of the membrane valve 112.

The first ink chamber 71 is communicated with the air through the through hole 127, and is kept at atmospheric pressure. The second ink chamber 76 is communicated with the third ink chamber 77 through only the communication port 75*a*. Therefore, an amount of ink, which corresponds to an ink amount reduced through the ink consumption by the recording head, flows from the first ink chamber 71 to the second ink chamber 76.

Even if the ink of the first ink chamber 71 flows back and reaches the recess 98, the air permeable and ink repellent film provided in the recess 98 maintains the communication with the atmosphere while preventing ink leakage therefrom. With this feature, the ink cartridge is free from such an unwanted situation that the ink that has flowed into the narrow groove 96 is solidified there to close the air communication passage. Subsequently, in a state that the ink is present in the first ink chamber 71, a negative pressure acting on the ink supply port 64 is gradually increased in accordance with an ink level H in the first ink chamber 71.

Thus, the ink in the bottom area of the first ink chamber 71 located at a lower part is sucked up to an area near the bottom of the upper ink chamber; more exactly the second ink chamber 76. Consequently, the water head pressure in the ink chambers 76, 77 and 83 located in the upper section is substantially constant. That is, the change of the water head pressure, caused by a height of the ink cartridge, is limited only to the change of the water head pressure H of the first ink chamber 71 located in the lower section, and the thus limited change directly acts on the membrane valve 112.

Therefore, a pressing force to keep the membrane valve 112 in a closed state can be set in accordance with the change of the water head pressure H of the first ink chamber 71. Accordingly, even if the amount of stored ink is increased without increasing the bottom area, that is, the height of the container body 62 is increased, the cartridge is capable of supplying the ink without applying an excessive negative pressure to the recording head and the negative pressure generating mechanism. As a result, the ink stored in the ink cartridge can effectively be utilized while keeping high print quality.

When the ink in the first ink chamber 71 is sucked through the suction passage 78 to the second ink chamber 76, and consumed completely (FIG. 19II), the ink suction port 78*a* of the suction passage 78 holds ink by its capillary force (i.e. the force of meniscus formed at the ink suction port 78*a*). Accordingly, no ink flows from the second ink chamber 76 to the first ink chamber 71. Further, even if the cartridge is pulled out in a state that no ink is left in the first ink chamber 71, ink in the upper ink storage regions can be prevented from flowing into the first ink chamber 71.

When the ink is consumed by the recording head and a negative pressure acts on the second ink chamber 76, then the ink intermittently flows from the second ink chamber 76 into the third ink chamber 77 via the communication port 75*a*, while sucking air from the first ink chamber 71 opened to the air. A constant pressure acts on the membrane valve 112 serving as the negative pressure generating mechanism regardless of ink level in the second ink chamber 76, third ink chamber 77 and fourth ink chamber 83 while ink in the second ink chamber 76, third ink chamber 77 and fourth ink chamber 83 is consumed. Accordingly, the ink in the ink cartridge can effectively be supplied to the recording head without degrading the print quality.

Figure 19:
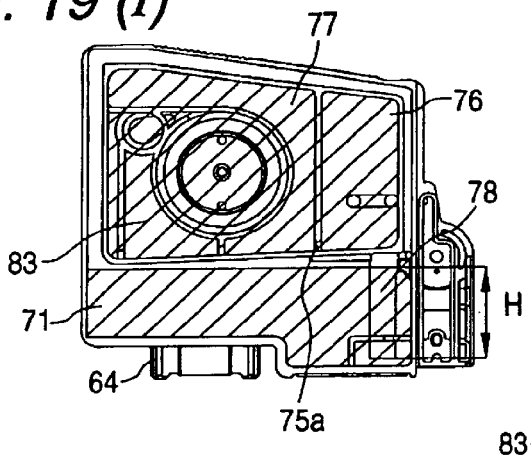
FIGS. 19I to 19V are schematic views for showing change in ink amount of the ink cartridge.
Figure 19:
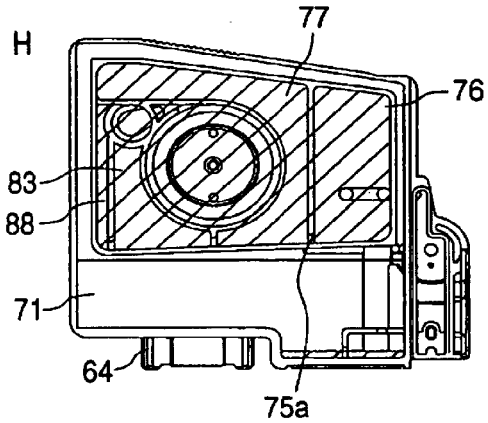
Figure 19:
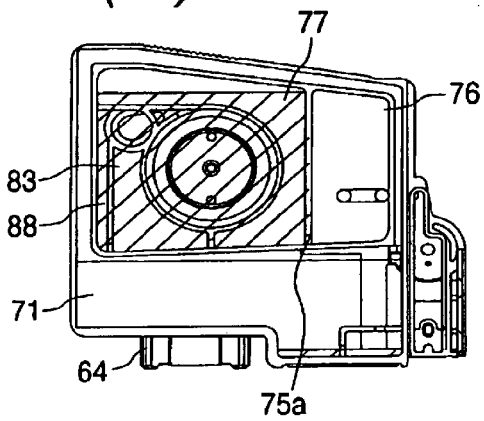
Figure 19:
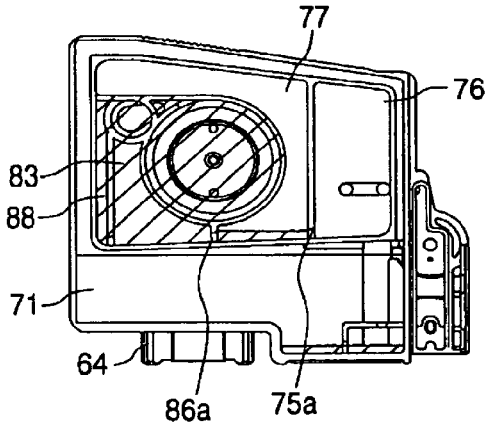
Figure 19:
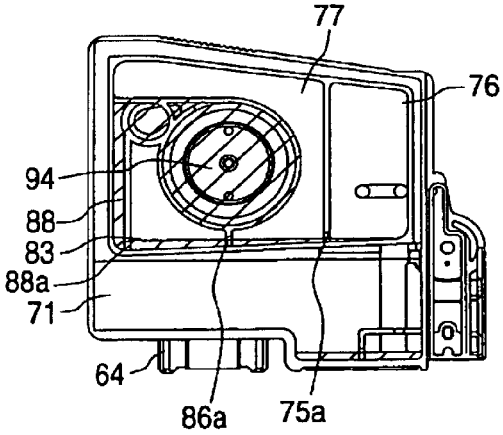

When no ink is left in the second ink chamber 76. (FIG. 19III), the ink left in the third ink chamber 77 is supplied through the communication port 86*a* to the recording head. When the ink in the third ink chamber 77 is consumed completely, the ink in the fourth ink chamber 83 is then consumed (FIG. 19IV). In addition, each of the communication ports 75*a*, 86*a* and 88*a* has such a size as to be capable of forming a meniscus to hold ink at the communication port 75*a*, 86*a*, 88*a* during the ink consumption process as illustrated.

Even if the ink in one of the regions partitioned by the partitioning wall 86 is lowered down to the communication port 86*a* (FIG. 19IV), and further the ink of the fourth ink chamber 83 is consumed (FIG. 19V), the filter chamber 94 is not opened to the air since the ink flow passage 88 side of the wall 70 is located at a lower position and hence the lower end 88*a* of the ink passage 88 is left immersed in the ink. Therefore, if the ink consumption by the recording head is stopped in this state, then the air bubbles are prevented from flowing into the recording head.

As described above, the ink storage region in the upper section is partitioned into a plurality of regions by the walls 75 and 86 to define a plurality of the ink chambers 76, 77 and 83 in the upper section, and those chambers are communicated with one another at least at the bottom regions. This arrangement can maintain the water head pressure acting on the membrane valve 112 within a substantially constant range regardless of decrease of ink in the ink chambers 76, 77 and 83. In the process ranging from the FIGS. 19II to 19IV, that is, in a state that the ink in the first ink chamber 71 is used up and the ink in the second to fourth chambers 76, 77 and 83 is supplied to the recording head, a variation of the negative pressure at the ink supply port 64 is greatly suppressed in comparison with a state that the ink is left in the first ink chamber 71.

In addition, the lower section ink chamber (i.e. the first ink chamber 71 in this, embodiment) serves as a buffer chamber. That is, during the use of the ink cartridge, even if air bubbles trapped in the upper section ink storage portion (i.e. the second to the fourth ink chambers 76, 77, 78 in this embodiment) are expanded due to temperature change, ink in the upper section ink storage portion is returned through the ink suction passage (the flow passage 78 in this embodiment) into the lower section ink storage portion (the first ink chamber 71 in this embodiment) communicated with the atmosphere without being forced into the differential pressure valve storage chamber. Therefore, it is possible to avoid the leakage of the ink from the ink supply port. The ink returned to the lower section ink storage portion is again sucked up by the ink suction passage into the upper section ink storage portion as ink is consumed by the recording head, and therefore ink in the ink cartridge can be consumed efficiently.

More specifically, during ink consumption process in the second and subsequent ink chambers, even if the air layer formed in the upper portion of, for example, the second ink chamber is expanded due to increase of the ambient temperature to cause reverse ink flow into the first ink chamber, the ink of the reverse flow is trapped by the first ink chamber. Further, the ink of the reverse flow, trapped by the first ink chamber, can be sucked up again into the second ink chamber, and thus consumed.

Figure 21A:
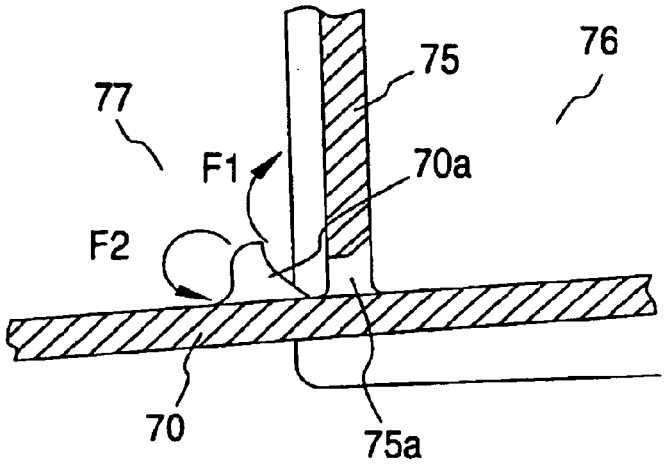
FIGS. 21A and 21B are sectional views showing modifications for an ink flow passage and an ink chamber, which are directed to but not limited to the ink cartridge of the second embodiment.

FIG. 21A shows another example of the flow passage connecting the second ink chamber 76 to the third ink chamber 77. In this example, a vertically extending slope 70*a* is formed at the outflow side of the communication port 75*a* partitioning the second ink chamber 76 and the third ink chamber 77, i.e. at a part of the wall 70 in the third ink chamber 77. A slope angle of the slope 70*a* is gradually increased to be closer to a vertical direction as it is closer to the upper end thereof.

Ink flowing out from the communication port 75*a* flows along the slope 70*a* as shown by an arrow F1 to cause a vortex flow behind the slope 70*a* as shown by an arrow F2. Therefore, in case of pigment ink in which coloring components or the like are likely to be concentrated at a lower portion in comparison to dye ink, such concentration or precipitation can be eliminated.

Figure 21B:
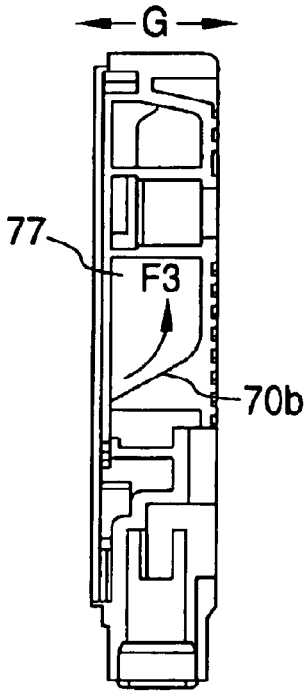
Figure 22A:
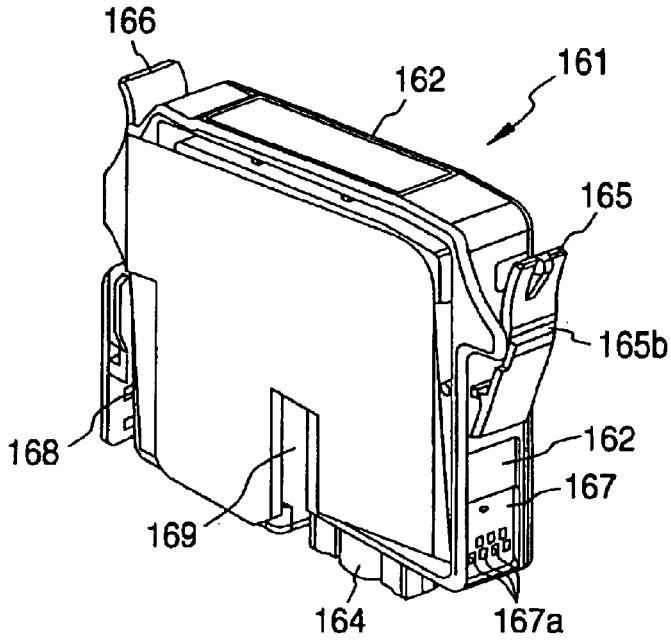
FIGS. 22*a* and 22B are perspective views showing an external appearance of surface and reverse sides of an ink cartridge, which constitutes a third embodiment.
Figure 22B:
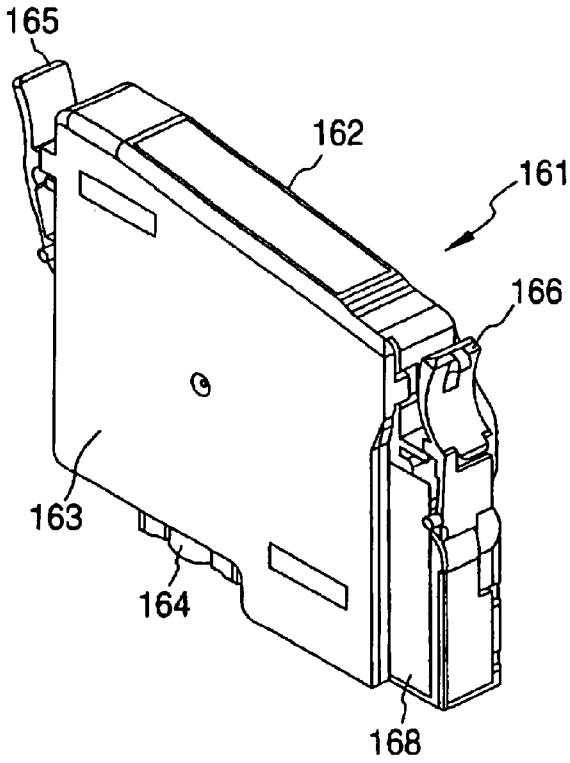
Figure 23A:
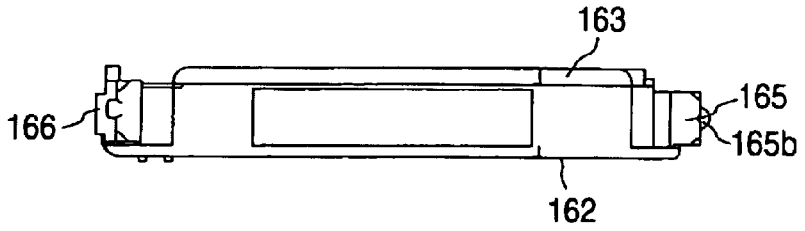
FIGS. 23A, 23B, 23C and 23D are an upper surface view, an elevational view, a bottom surface view and a side surface view of the ink cartridge.
Figure 23B:
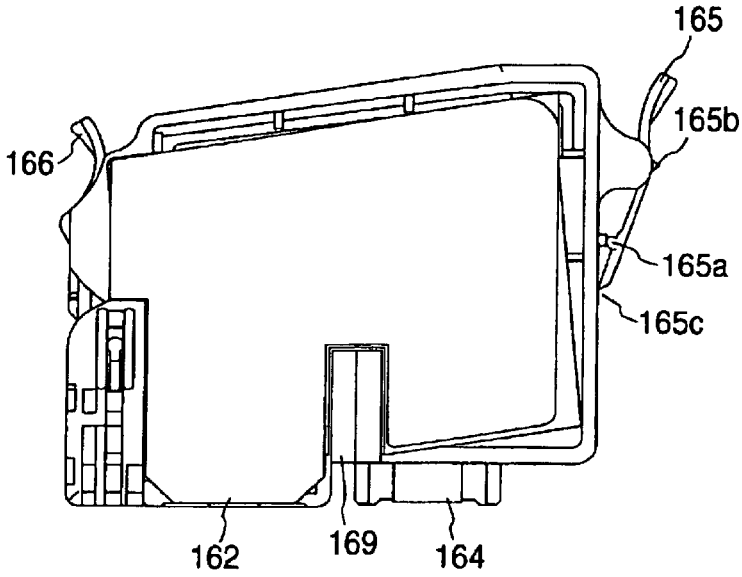
Figure 23D:
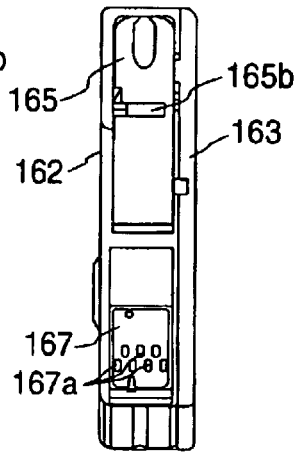
Figure 23C:
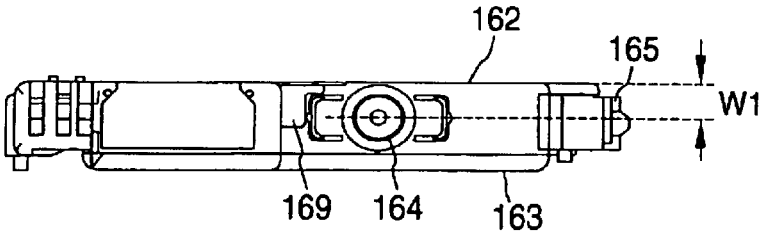

FIG. 21B shows a modification of the ink chamber, by taking the third ink chamber 77 as an example. In this modification, a slope 70*b* is formed on the wall 70 so as to face a movement direction (indicated by an arrow G) of the carriage when the ink cartridge is mounted to the carriage of the recording device.

When the ink cartridge 61, mounted to the carriage of the recording device, receives acceleration/deceleration caused by the reciprocating motion of the carriage, the slope 70*b* causes an ascending flow, indicated by F3 in FIG. 21B, thereby preventing the concentration or precipitation similarly to the example shown in FIG. 21A. It is apparent that the similar effect can be obtained if such a slope 70*a*, 70*b* is formed in at least one of the first is to third (fourth) ink chambers.

Third Embodiment

FIGS. 22A, 22B and 23A to 23D show an external appearance of another example of the ink cartridge according to the present invention, which constitutes a third exemplary embodiment. The ink cartridge 161 is mainly constructed of a flat, rectangular, box-like container body 162, one surface of which is open and the other opposite surface is closed, and a cover member 163 for closing the opening of the container body 162. An ink supply port 164 is formed at a longitudinally offset position in the leading end side of the insertion direction, i.e. in the bottom surface in this embodiment. Retaining members 165 and 166 are formed integrally with the container body 162 at upper lateral portions.

The retaining member 165 located closer to the ink supply port 164 has, a rotation fulcrum 165*a* located slightly above the leading end side of the retaining member 165 in the insertion direction, i.e. the lower end of the retaining member 165 in this embodiment, so that the upper portion of the retaining member 165 can be opened outwardly about the fulcrum 165*a*. The opposite retaining member 166 is designed to assist the holding of the ink cartridge in cooperation with the retaining member 165.

Each of these retaining members 165 and 166 has a width corresponding to a width of an insertion port provided to a carriage so that a side surface of the retaining member 165, 166 can serve, as a guide member for restricting a widthwise position of the ink cartridge.

A memory device 167 is provided below the retaining member 165 located closer to the ink supply port. The memory device 167 includes a board, a plurality of electrodes 167*a* formed on one surface of the board, and a semiconductor memory element formed on the other surface of the board. A valve chamber 168 is formed below the other retaining member 166.

A slit portion 169 is formed in the vicinity of the ink supply port 164 and in a central region side of the container. The slit portion 169 extends in the insertion/removal direction of the ink cartridge, and at least the leading end side thereof is open. The slit portion 169 has such a length and a width as to restrict the opening surface of the ink supply port to be perpendicular to an ink supply needle of the carriage at least before the leading end of the ink supply port 164 reaches the ink supply needle.

Figure 24:
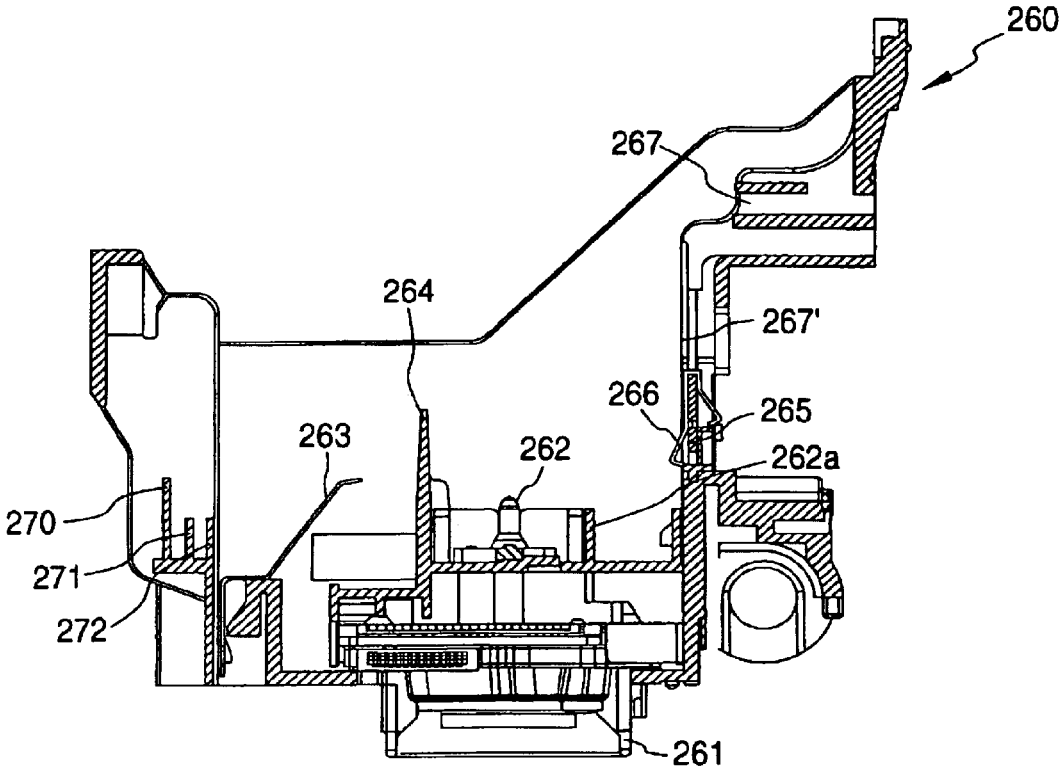
FIG. 24 is a sectional view showing an example of a carriage to which an ink cartridge is to be mounted.

On the other hand, the carriage 260 to which the ink cartridge is to be mounted has a recording head 261 provided to the bottom surface thereof, and an ink supply needle 262 communicated with the recording head 261, as shown in FIG. 24. A pressing member, i.e. a plate spring 263 in this embodiment, is provided at a region distanced from a region where the ink supply needle 262 is provided. A positioning protruded piece 264 is formed between the pressing member and the ink supply needle 262 to extend in the insertion/removal direction of the ink cartridge. Electrodes 266 are disposed on a side wall 265 located at the ink supply needle (262) side. A recessed portion 267 is formed above the electrodes 266 so as to be engaged with a protrusion 165*b* of the retaining member 165.

Figure 25A:
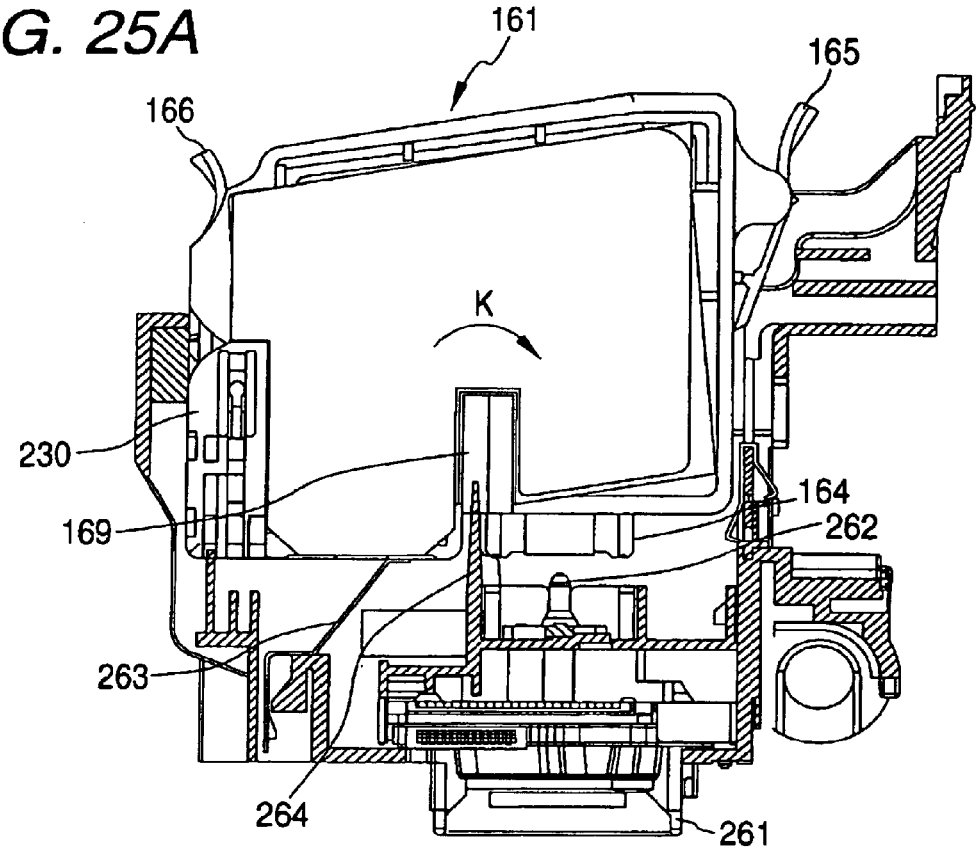
FIGS. 25A and 25B show a process for mounting an ink cartridge onto the carriage.

By adopting this structure, as shown in FIG. 25A, when the ink cartridge is inserted with the ink supply port 164 located at a deeper side, and pushed in against the urging force of the plate spring 263, the slit portion 169 is restricted by the protruded piece 264. Therefore, even if the ink cartridge receive such a rotational force (an arrow K in FIG. 25A) as to lower the ink supply port 164 side by the action of the plate spring 263 provided at an off set position, the posture of the ink cartridge is restricted to be in a specified insertion/removal direction, i.e. in a direction parallel to the vertical direction in this embodiment. The ink cartridge 161 is further pushed in against the urging force of the spring 263, and the protrusion 165*b* of the retaining member 165 falls into and engages with the recessed portion 267 by the entire elasticity of the retaining member 165. Therefore, a clear click feeling is transmitted to a finger holding the retaining member 165, and a user can judge that the ink cartridge 161 is surely mounted to the carriage 260.

In the mounted state of the ink cartridge 161 the surface of the memory device 167 where the electrodes 167*a* are provided is pressurized onto the electrodes 266 of the carriage 260 by the urging force (the force indicated by an arrow K in the drawing) of the spring 263 while the position of the surface in the insertion/removal direction is restricted by the protrusion 165*b* of the retaining member 165. Therefore, the reliable contact can be maintained regardless of vibrations caused during printing.

In case where the ink cartridge 161 is to be detached from the carriage 260 for exchange or the like, the retaining member 165 is elastically pressed toward the container body (162) side so that the retaining member 165 is rotated about the rotational fulcrum 165*a* located slightly above the lower end thereof, whereby the protrusion 165*b* of the retaining member 165 is disengaged from the recessed portion 267. Under this condition, the ink cartridge 161 is guided by the guide piece 264 and moved parallel to the ink supply needle 262 due to the urging force of the spring 263. Therefore, the ink cartridge can be detached from the carriage without causing a bending force or the like on the ink supply needle 264.

Figure 26A:
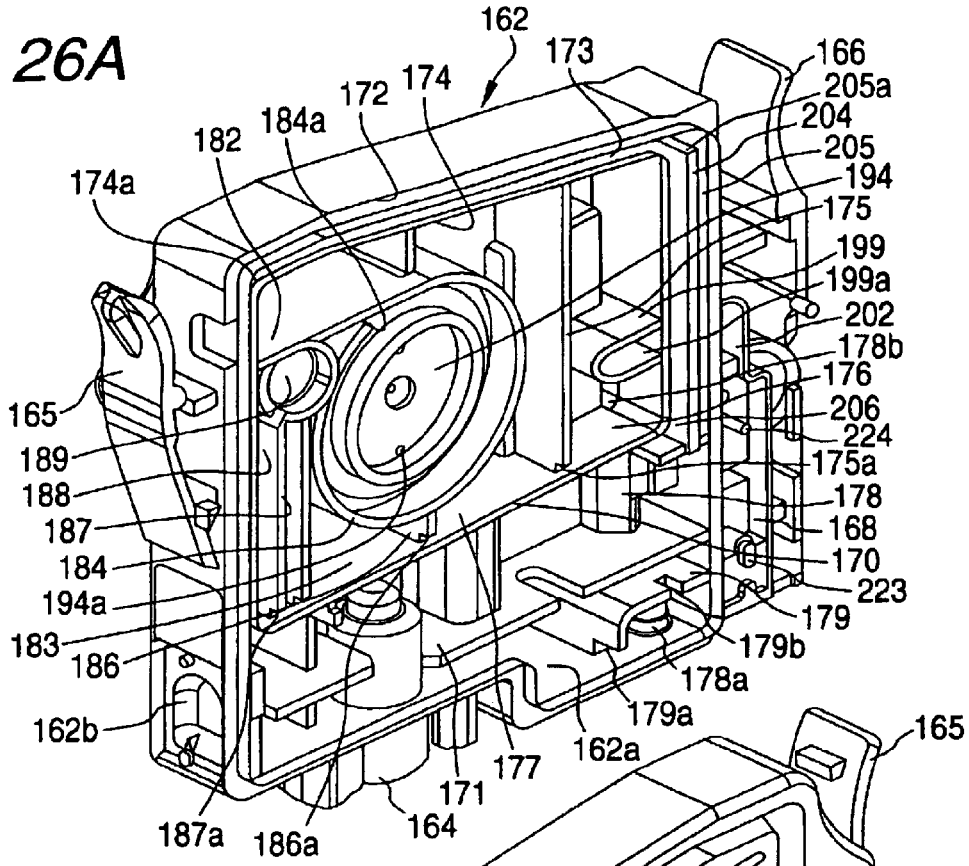
FIGS. 26A and 26B are perspective views showing opened side and surface side structures of a container body of the ink cartridge, which constitutes the third embodiment of the present invention.
Figure 26B:
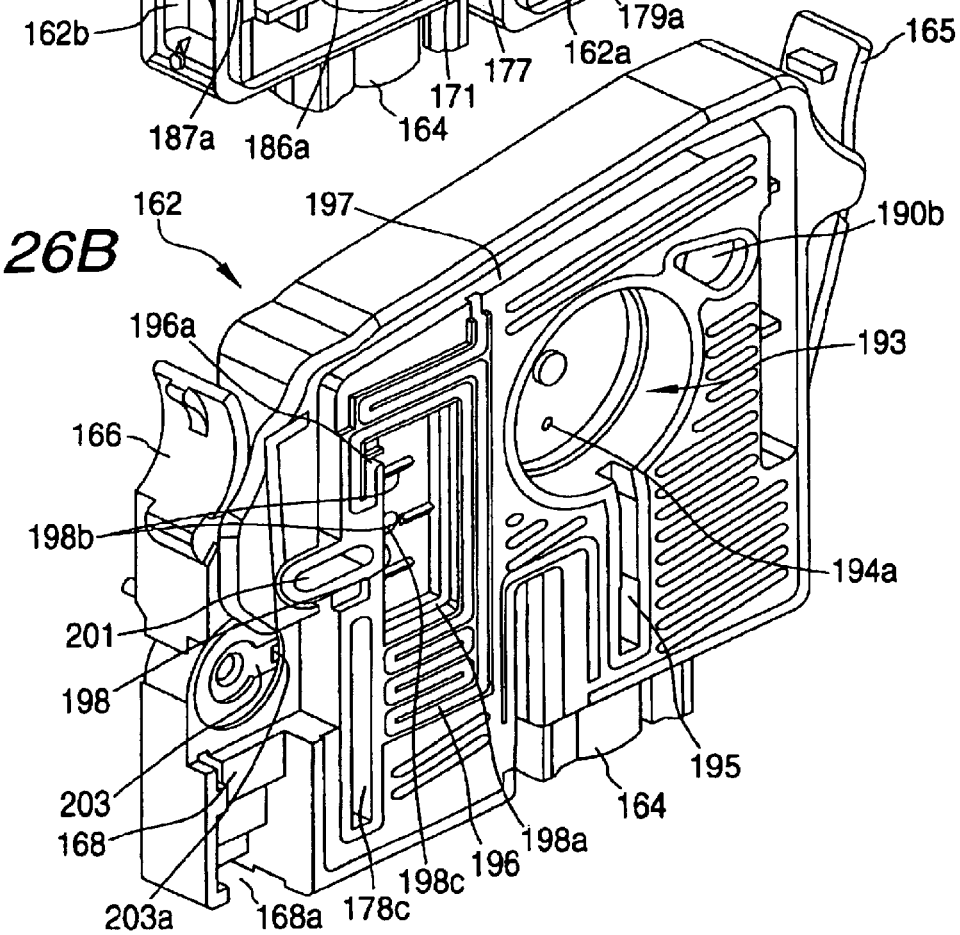

FIGS. 26A and 26B show front and rear structures of the container body 162 for constructing the ink cartridge according to the third embodiment of the present invention. The interior of the container body 162 is vertically divided by a wall 170 into upper and lower section regions. The wall 170 extends substantially horizontally, in more detail, the wall 170 extends in such a manner that the ink supply port (164) side thereof is slightly lowered.

The lower section region contains a first ink chamber 171. The upper section region is partitioned by a frame 174 with the wall 170 serving as a bottom surface. The frame 174 is spaced at a predetermined space or distance from a wall 172 of the container body 162 to define an air communication passage 173. The interior of the frame 174 is divided by a vertical wall 175 having a communication port 175*a* at its bottom portion so that one side region serves as a second ink chamber 176, and the other side region serves as a third ink chamber 177.

In a region toward one end of the first ink chamber 171, there is formed a suction passage 178 for connecting the second ink chamber 176 to a bottom surface 162*a* of the container body 162 (i.e. to a bottom portion of the first ink chamber 171). The suction passage 178 has such a cross-sectional area as to handle the ink amount consumed by a recording head. The lower end of the suction passage 178 is formed into a suction port 178*a* that is opened to the first ink chamber 171 and that can hold ink by capillary force. The upper end of the suction passage 178 is formed into outflow port 178*b* that is opened to be communicated with a bottom portion of the second ink chamber 176.

Figure 27:
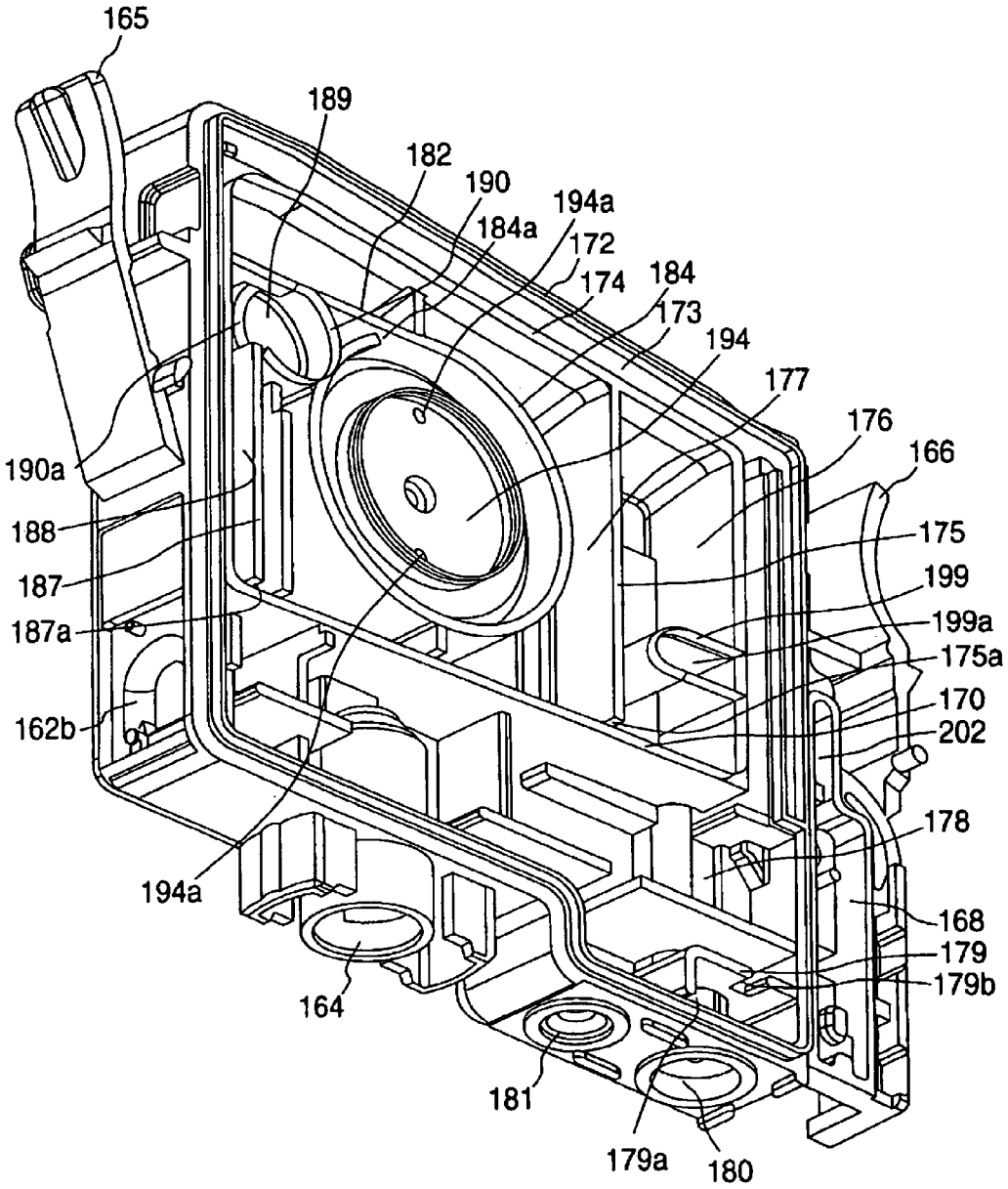
FIG. 27 is a perspective view showing a bottom surface structure of the container body of the ink cartridge of FIG. 26 as viewed from the opened surface side.

A wall 179 having communication ports 179*a* and 179*b* is formed in the vicinity of the suction port 178*a* of the suction passage 178. As shown in FIG. 27, an opening 180 for injecting ink from the exterior into, the container body 162 is formed at a location opposite to the suction passage 178, and an opening 181 is communicated with the first ink chamber 171. The suction passage 178 is formed with a recessed portion 178*c* (see FIG. 26B) in the surface of the container body 162, and this recessed portion 178*c* is sealed by an air impermeable film 255 (see FIGS. 29 and 30)

Figure 30:
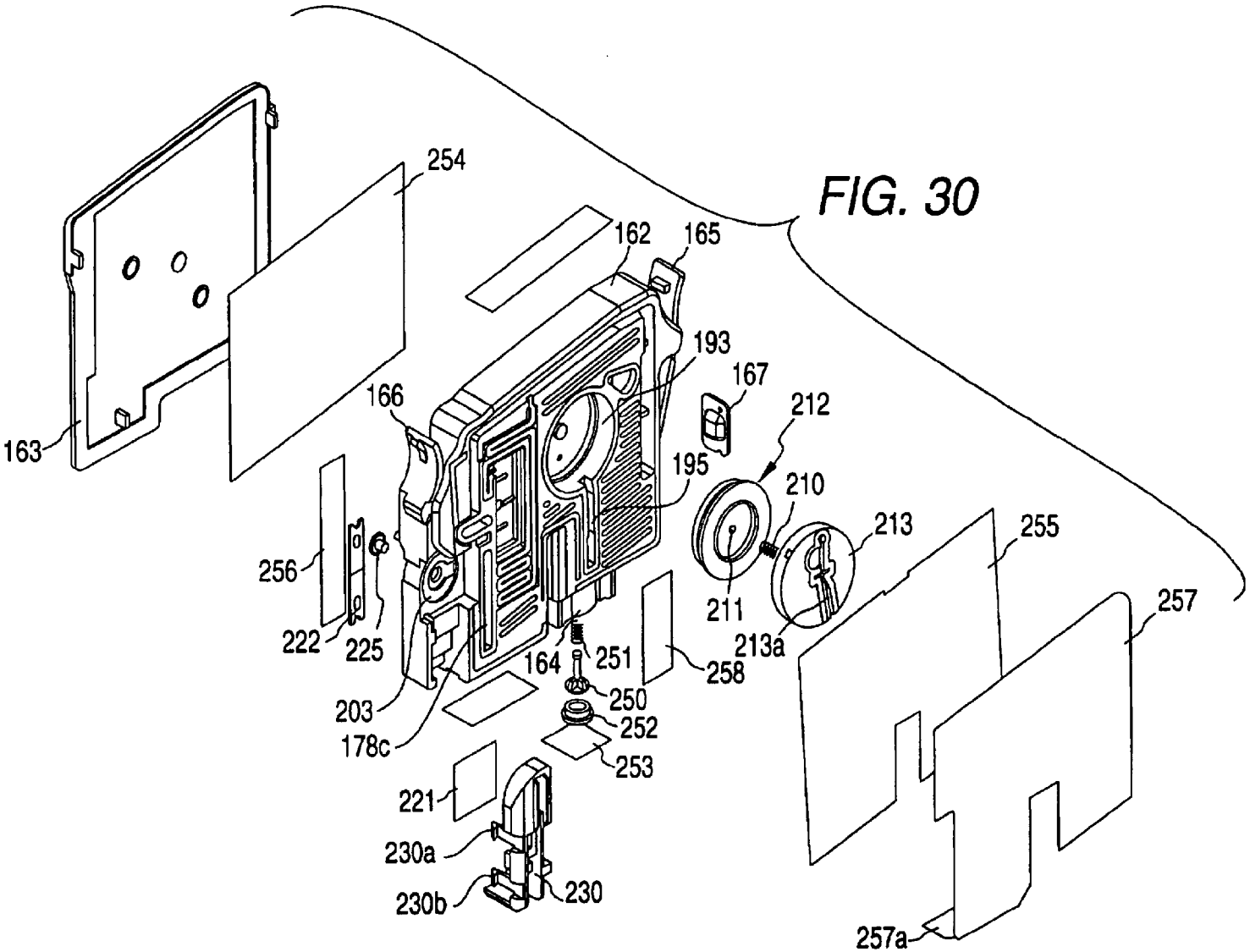
FIG. 30 is an exploded, perspective view showing the ink cartridge of FIG. 26.

The third ink chamber 177 is defined by forming walls 182, 184 and 186 (FIG. 26A) spaced at predetermined spaces from an upper surface 174*a* of the frame 174. A fourth ink chamber 183 is defined by walls 170, 184, 186 and 187. The wall 184 continuous to the wall 182 defines a flow passage communicated with a back side of a differential pressure valve storage chamber 193 (FIG. 30).

The partitioning wall 186 having a communication port 186*a* (FIG. 26A) is provided between a lower portion of the wall 184 and the wall 170. The partitioning wall 187 having a communication port 187*a* at its lower portion is provided to define an ink flow passage 188 between the wall 187 and the frame 174. The upper portion of the ink flow passage 188 is communicated with the other side of the ink cartridge 161 via a through-hole 189 that serves as a filter chamber. A filter 215 (FIG. 29) made of porous material, such as a foamed resin, is inserted into this through-hole 189. In the drawings, a reference numeral 162*b* designates a recessed portion for storing a memory device 167.

Figure 28:
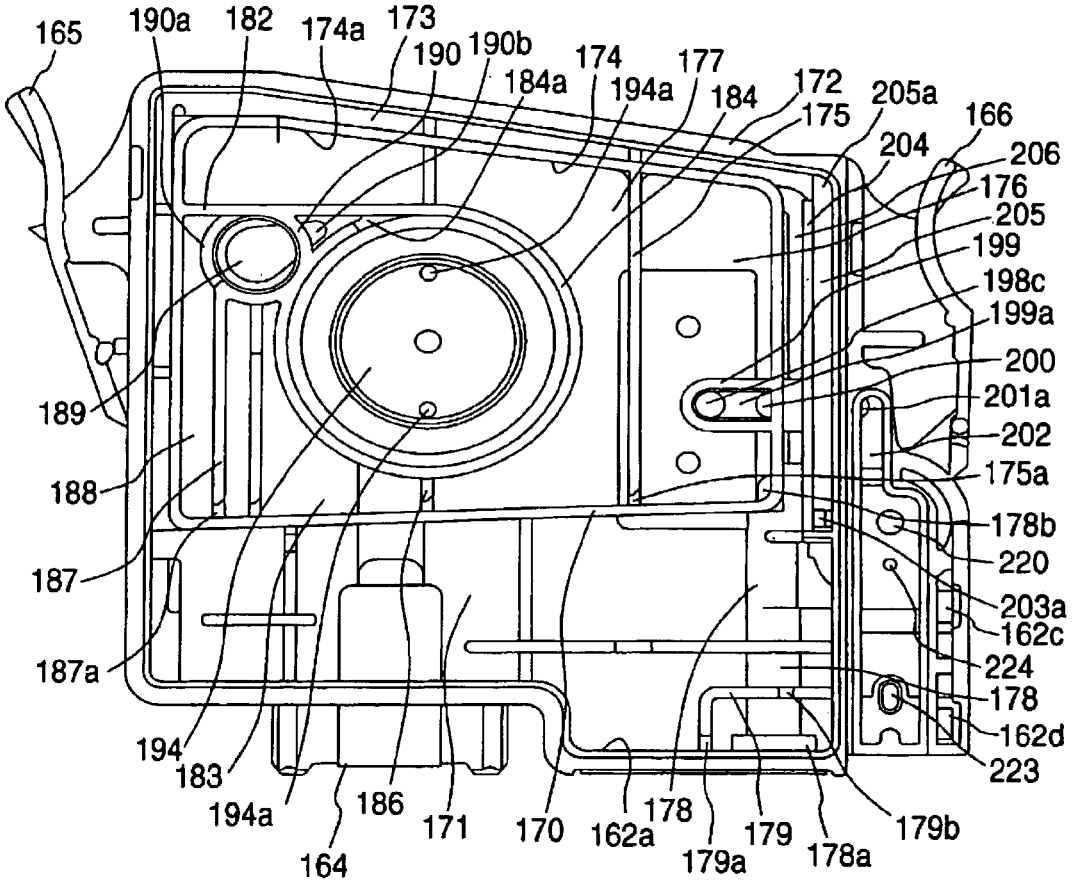
FIG. 28 is an elevational view showing the opened surface structure of the container body of the ink cartridge of FIG. 26.

As shown in FIG. 27, the through-hole 189 is separated by a wall 190 continuous to the wall 187, and the through-hole 189 is communicated via a recessed or notched portion 190*a* with the upper end of the ink flow passage 188. On the other side of the container body 162, a tear-drop-shaped recess 190*b* (see FIGS. 26B) is formed to communicate the thorough-hole 189 with a recessed portion 184*a* provided to an upper portion of the flow passage (or chamber) defined by the back side wall 194 of the differential pressure valve storage chamber 193 and the wall 184 as shown in FIG. 28.

As shown in FIG. 26B, a lower portion of the differential pressure valve storage chamber 193 and the ink supply port 164 are connected to each other via a flow passage that is defined by a recessed portion 195 formed in the surface of the container body 162 and by the air impermeable film 255 (FIG. 30) covering the recessed portion 195.

A narrow groove 196, a wide groove 197, and a rectangular recessed portion 198 are formed in the surface of the container body 162 as shown in FIG. 26B. The narrow groove 196 meanders to provide the largest possible flow resistance. The wide groove 197 is formed around the narrow groove 196. The recessed portion 198 is provided in a region on the opposite side to the second ink chamber 176. The recessed portion 198 has a frame 198*a* and ribs 198*b* that are slightly lowered from an open end off the recessed portion 198. The ribs 198*b* are disposed separately from one another. An ink repellent, air permeable film 258 is fixed by this frame 198*a* in a stretched state to define an air communication chamber.

A through hole 198*c* is formed in the bottom surface of the recessed portion 198 as shown in FIG. 26B. This through hole 198*c* is communicated with a slender region 199*a* (FIGS. 26A and 28) defined by a wall 199 of the second ink chamber 176. The recessed portion 198 is also communicated with one end 196*a* of the narrow groove 196 at a region closer to the surface side than a region where the air permeable film 258 is provided. That is, the through hole 198*c* is communicated via the air permeable film 258 with one end 196*a* of the narrow groove 196. The slender region 199*a* is communicated via a through hole 200 (FIG. 28) provided at the other end of the region 199*a*, a groove 201 (FIG. 26B) formed in the surface of the container body 162 and a through-hole 201*a* (FIG. 28) with a valve storage chamber 168 (FIG. 27).

As shown in FIGS. 26B and 30, a recessed portion 203 is formed in the back surface of the valve storage chamber 168, and a leading end of the recessed portion 203 is formed with a through hole 203*a* that is opened in the vicinity of the second ink chamber 176. A region where these recessed portion 203 and through hole 203*a* are provided is sealed by a film 221 to define a passage for air communication. The through hole 203*a* is communicated with a flow passage 205 (FIG. 26A) defined by a vertically extending wall 204, spaced at a predetermined space from the frame 174, and the cover member 163. An upper end 205*a* of the flow passage 205 is communicated via a flow passage 206 formed by the wall 204 and the frame 174 or the air communication passage 173 with an upper end(s) of the first ink chamber 171.

By adopting this flow passage structure, it is possible to prevent the flow of ink from the first ink chamber 171 into the valve storage chamber 168 and the evaporation of ink stored in the first ink chamber 171, while keeping the communication of the first ink chamber 171 with the atmosphere.

The leading end of the valve storage chamber 168 in the cartridge insertion direction, i.e. the lower portion of the valve chamber 168 in this embodiment, is opened by a window 168*a* as shown in FIG. 26B. An identification block 230 (to be described later) is mounted to the lower portion of the valve storage chamber 168, and an air open valve 225 (FIG. 29) is mounted to the upper portion thereof. The identification block 230 permits entry of plural identification pieces 270, 271, 272 (FIG. 24) and an valve operation rod that are provided on the carriage 260 of the recording device main body.

Figure 29:
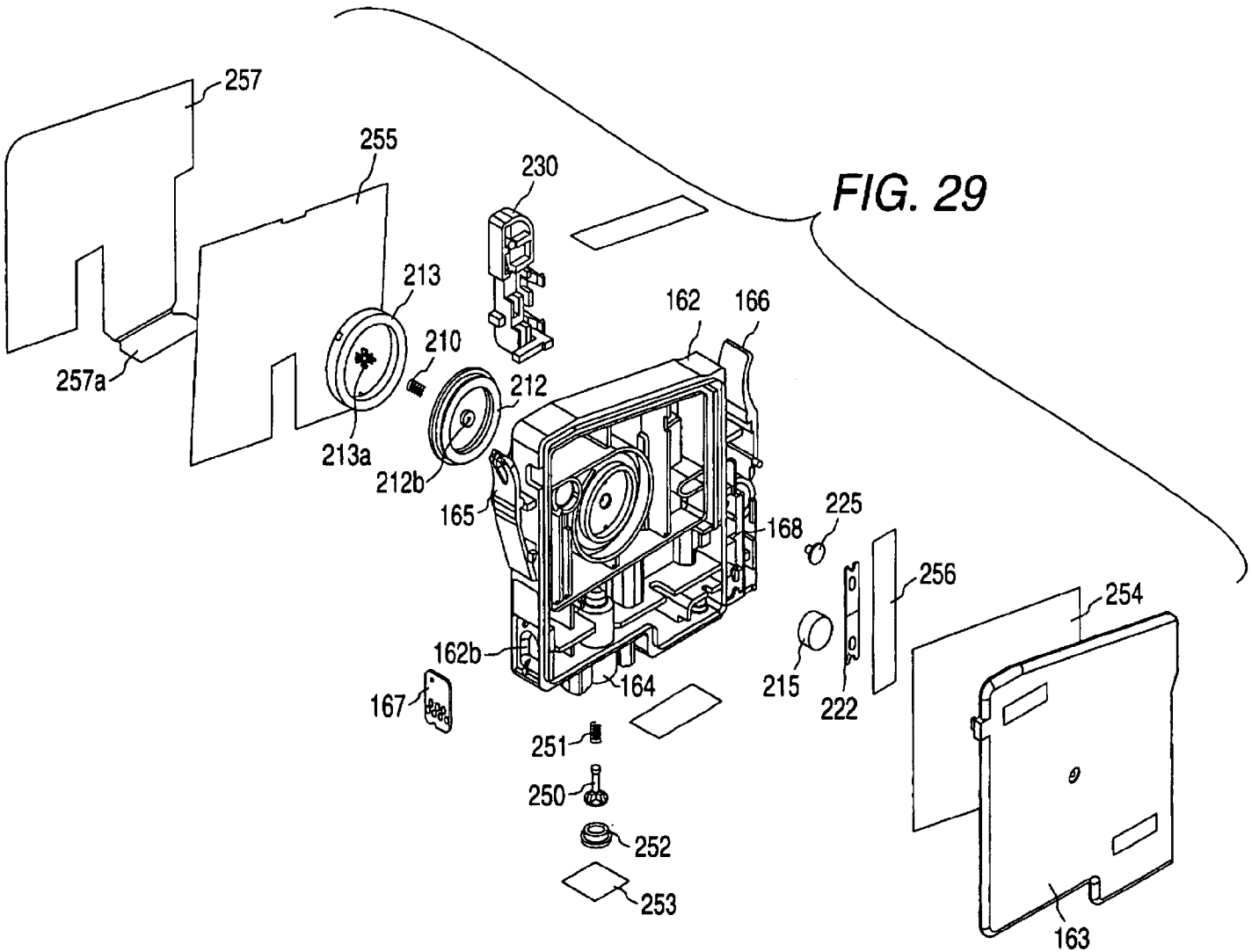
FIG. 29 is an exploded, perspective view showing the ink cartridge of FIG. 26.

Under this condition, as shown in FIG. 29, the film 254 is bonded by thermal welding or the like onto the frame 174 and the walls 170, 175, 182, 184, 186, 187, 190 and 199 in the opened side of the container body 162 so that the ink chambers (176, 177, 183) are formed in the upper section region. The cover member 163 is hermetically fitted in a state that the upper section region ink chambers are separated from the lower section region ink chamber (171). The film 256 is bonded to the valve storage chamber 169 in a state that the valve member 225 and a plate spring 222 are stored in the valve storage chamber 168.

On the other hand, in the surface side of the container body 162, as shown in FIG. 30, a membrane valve 212, a spring 210 and a membrane valve holding member (lid member) 213, having a groove 213*a* communicating the outlet side of the membrane valve 212 with the recessed portion 195, are mounted and stored in the differential pressure valve storage chamber 193, and then the single air impermeable film 255 having such a size as to cover the differential pressure valve chamber 193, the narrow groove 196, the groove 201, the recessed portion 190*b*, the recessed portion 195, the recessed portion 198 and the recessed portion 178*c* is bonded to the surface side of the container body 162.

The air impermeable film 221 easily deformable by the operation rod is bonded to a region opposed to the recessed portion 203 of the valve storage chamber 168, and further the identification piece 230 is mounted and fixed to the surface side of the valve storage chamber 168 by pawls 230*a*, 230*b*.

A valve member 250 opened by the insertion of the ink supply needle (FIG. 24) is inserted in the ink supply port 164 so that the valve member 250 is urged by a spring 251 to be normally closed. A packing 252 is further inserted into the ink supply port 164 to ensure a hermetic state between each of the valve member 250 and the ink supply port and the container body 162. In the drawings, reference numeral 253 designates a protective film which is bonded to the ink supply port to prevent leakage of ink during commercial distribution stage, and which permits the insertion of the ink supply needle 262.

Figure 31:
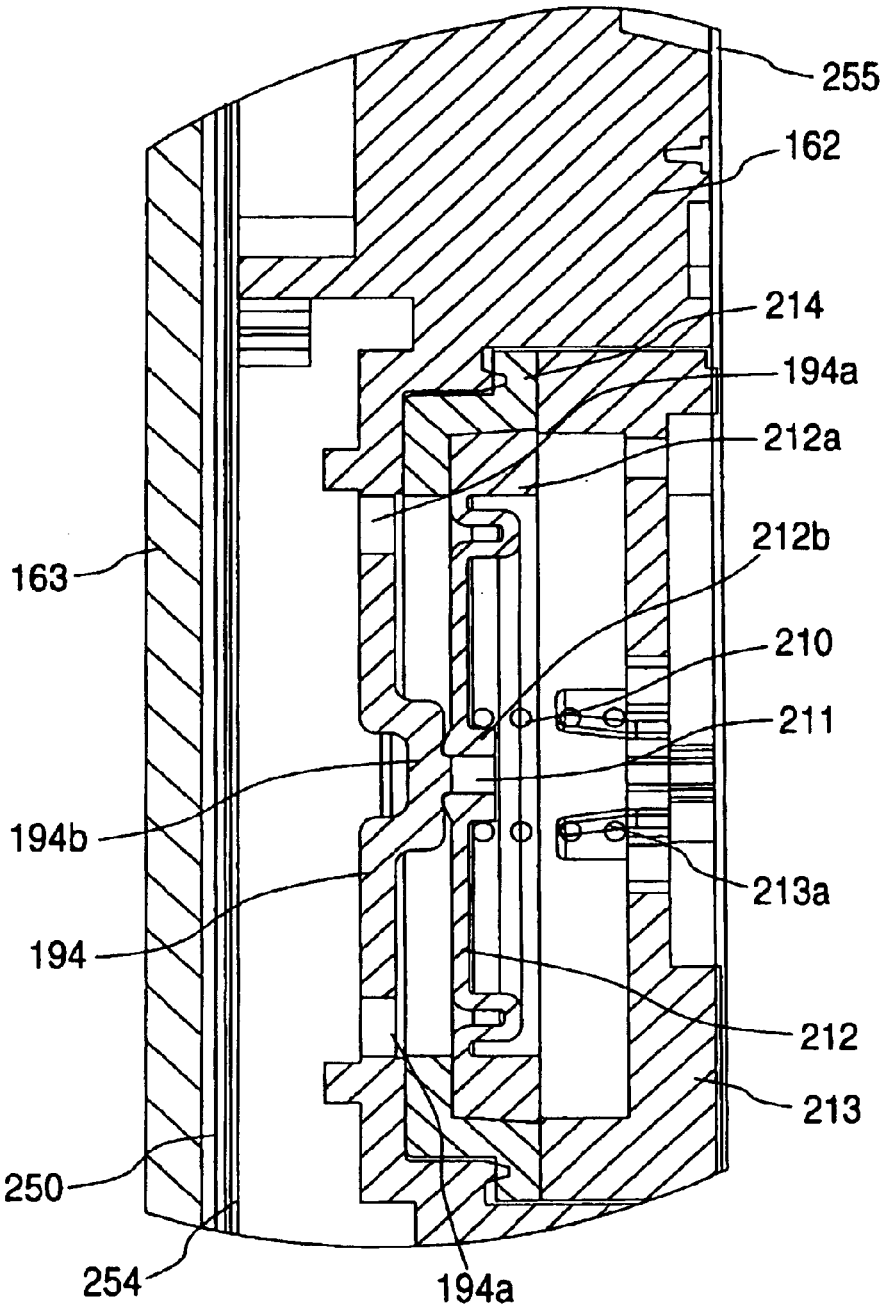
FIG. 31 is an enlarged sectional view showing a structure in the vicinity of a differential pressure valve storage chamber.

FIG. 31 shows a cross-sectional structure in the vicinity of the differential pressure valve storage chamber 193. The spring (coil spring) 210 and the membrane valve 212 are stored in the differential pressure valve storage chamber 193. The membrane valve 212 is formed of elastically deformable material, such as elastomer, and has a through hole 211 at its center. The membrane valve 212 includes an annular thick portion 212*a* circumferentially provided, and a frame 214 formed integrally with the annular thick portion 212*a*. The membrane valve 212 is fixed to the container body 162 through the frame 214. The spring 210 is supported at one end by a spring receiving portion 212*b* of the membrane valve 212, and at the other end by the membrane valve holding plate 213 fittingly fixed to the container body 162.

In this arrangement, ink which has passed through the filter 215 (FIG. 29) passes through the ink flow ports 194*a* and is blocked by the membrane valve 212. In this state, when a pressure in the ink supply port 164 is lowered, the membrane valve 212 is separated from a valve seat 194*b* against the urging force of the spring 210, so that ink passes through the through hole 211 to be supplied, via the flow passage formed by the recessed portion 195, to the ink supply port 164.

When the ink pressure in the ink supply port 164 is increased to a predetermined valve, the membrane valve 212 is elastically contacted with the valve seat 294*b* by the urging force of the spring 210, and thus the flow of ink is inhibited. By repeating this operation, ink is discharged to the ink supply port 164 while maintaining a constant negative pressure.

Figure 32A:
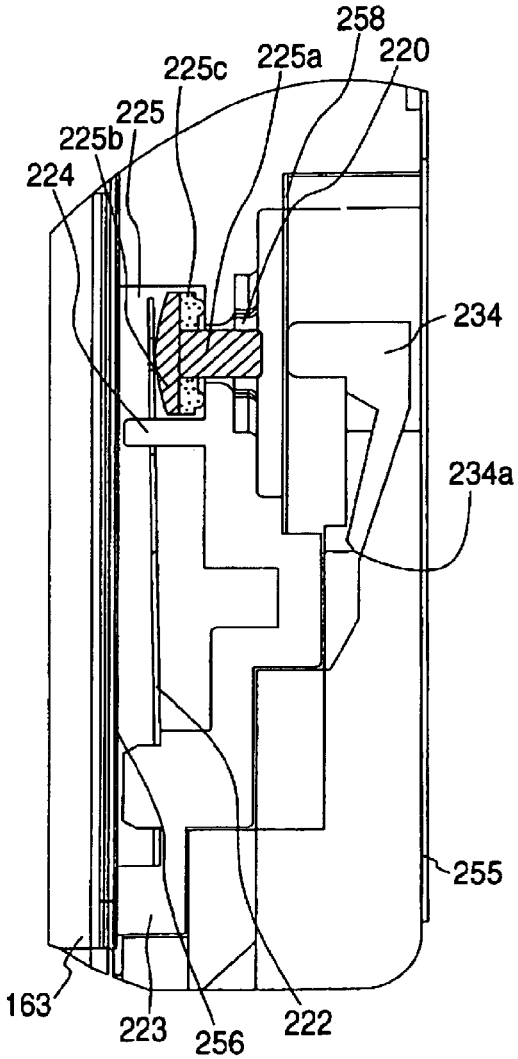
FIGS. 32A and 32B are sectional view showing a valve closed state and a valve open state in an air communication valve storage chamber.
Figure 32B:
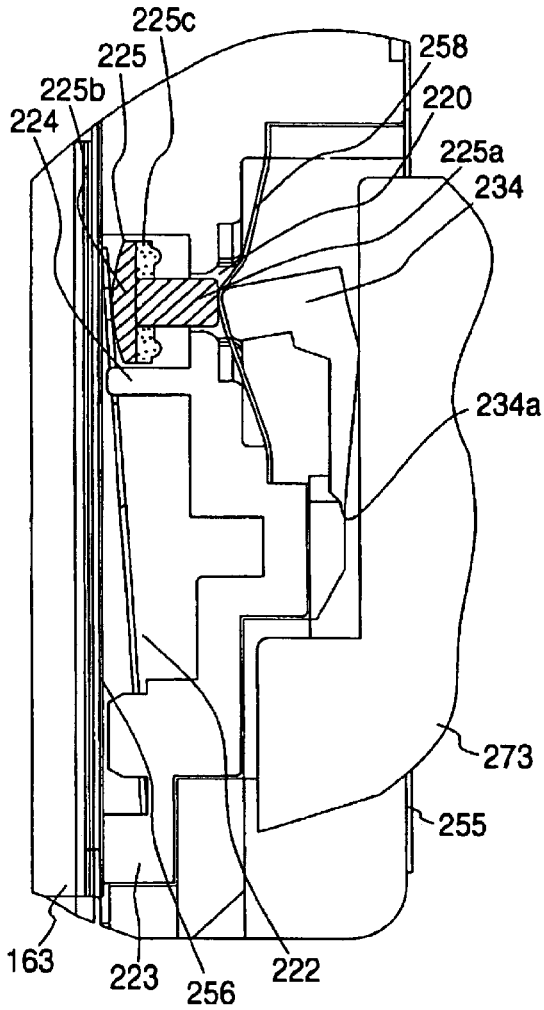

FIGS. 32A and 32B show a cross-sectional structure of the valve storage chamber 168 for air communication. The wall defining the valve storage chamber 168 is formed with a through hole 220, and a protruded portion 225*a* of the valve member 225 is movably installed in the through hole 220. A body 225*b* of the valve member 225 is pressed by an elastic member 222, such as a plate spring, so that the valve member 225 normally closes the through hole 220. The lower end of the elastic member 222 is fixed by a protrusion 223, and the central portion thereof is restricted by a protrusion 224. The valve member 225 is preferably provided with a sealing portion 225*c*, made of relatively soft material, such as elastomer, on the through hole (220) side.

Figure 33A:
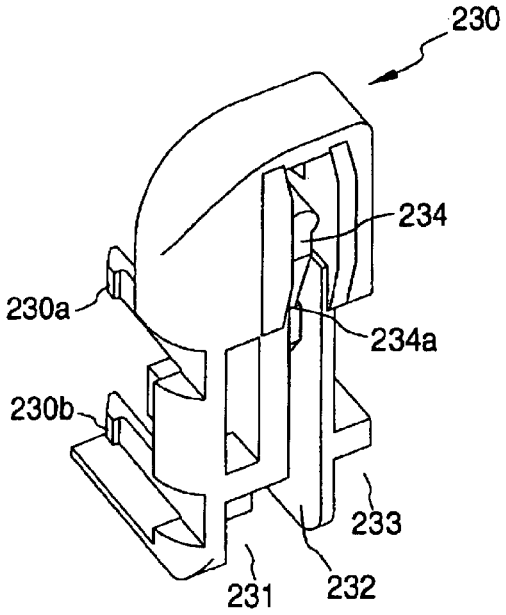
FIGS. 33A and 33B are a perspective view and a bottom surface view of an example of an identification block.
Figure 33B:
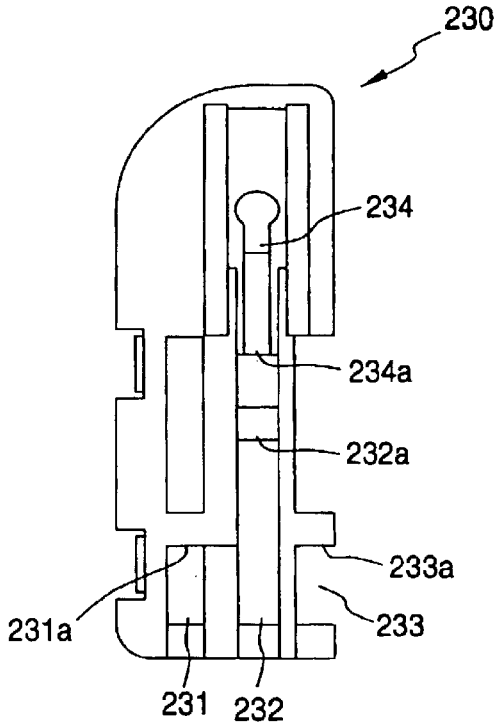

The identification block 230 (FIGS. 33A and 33B) provided on the other side of the film 258 is fixed to holes 162*c*, 162*d* (FIG. 28) of the container body 162 by the pawls 230*a*, 230*b* (FIG. 33A), and is formed with a plurality of grooves (FIGS. 33A and 333B: three grooves 231, 232, 233 in this embodiment) parallel to the cartridge insertion direction. One of these grooves, i.e. the groove 232 in this embodiment, is formed with an arm 234 for pressing the protruded portion 225*a* of the valve member 225. The arm 234 is supported at the ink cartridge insertion direction side, i.e. the lower end in this embodiment, by the identification block 230.

Figure 25B:
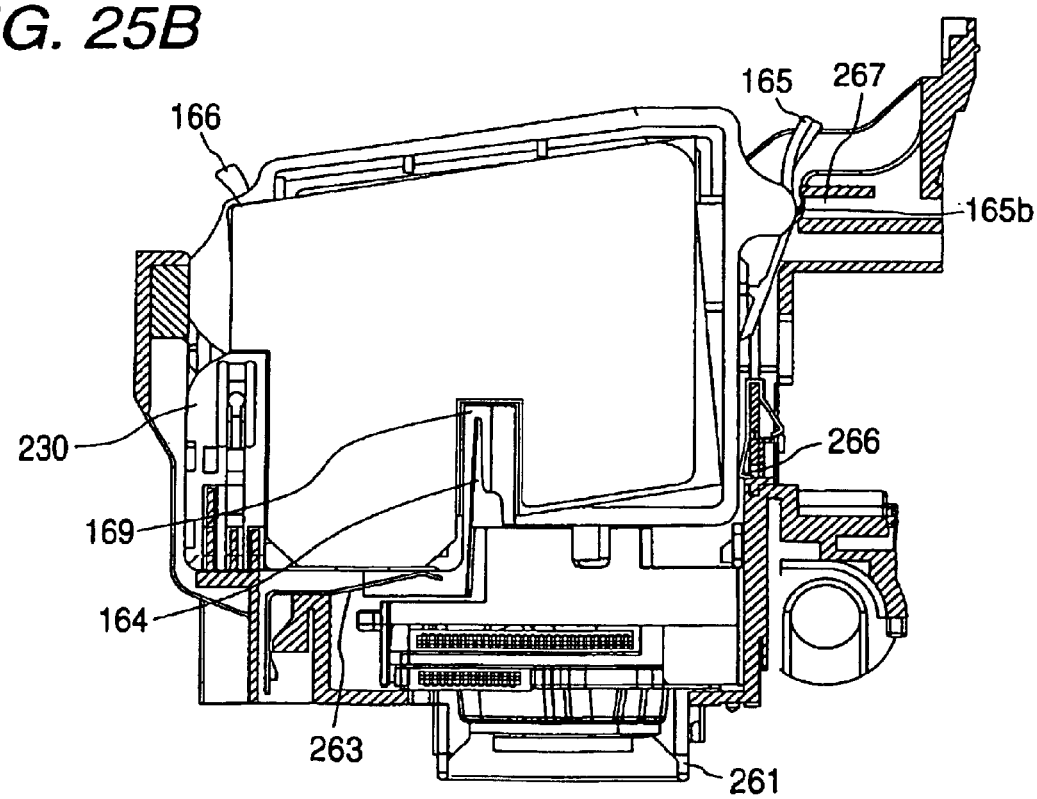

The arm 234 has a fulcrum 234*a* about which the arm 234 is rotatable to be located slightly inwardly. The cartridge removing side, i.e. the upper portion side in this embodiment, of the arm 234 extends obliquely into an advancing path of an operation rod 273 (FIG. 32B) The grooves 231 to 233 are respectively formed with protruded portions 231*a*, 232*a*, 233*a* to be opposed to the leading ends of the identification pieces 270, 271, 272 of the carriage 260 (FIGS. 24 and 25).

By this arrangement, it is possible to make the position of the arm 234 constant, while preventing erroneous mounting of an ink cartridge such that positions of the protruded portions 231*a*, 232*a*, 233*a* and positions of the leading ends of the identification pieces 270, 271, 272 are set in accordance with a kind of ink in the cartridge. The protruded portions 231*a*, 232*a*, 233*a* may be arranged in such a three-dimensional manner that the positions of these protruded portions are varied not only in the cartridge insertion/removal direction but also in the cartridge thickness direction. This makes it possible to identify a large number of ink kinds or types without increasing an area where the identification region is formed.

This identification block 230 is used by the recording device to identify ink kind based on the positions of the protruded portions. To ease the identification of ink kind by a user or during assembly, the identification block may have the same or similar color as ink, or may be provided with a mark indicative of ink kind.

When the ink cartridge is mounted to the holder and the arm 234 is pressed by the operation rod 273, the valve member 225 is moved to establish a valve open state. Consequently, the upper ends of the first ink chamber 171 at both sides thereof are opened to the atmosphere via: the air communication passage formed by the through hole 203*a* opened in the vicinity of the second ink chamber 176 and the film 221; the flow passage 205 defined by the vertically extending wall 204, which may be spaced at a constant distance from the frame 174, and the cover member 163; the flow passage 206; and the air communication passage 173.

That is, the valve chamber 168 is communicated via the through hole 201*a* with the groove 201 of the container body 162, and is further communicated via the other end through hole 200, the region 399*a* covered by the film, and the through hole 198*c* with the bottom surface of the recessed portion 198. The recessed portion 198 is communicated via the air permeable film 258 with the one end 196*a* of the narrow groove 196 forming the capillary of the container body, thereby being opened to the atmosphere.

Figure 34A:
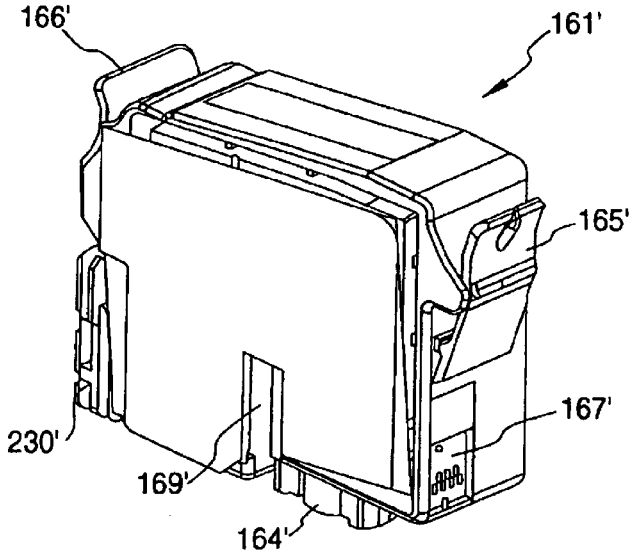
FIGS. 34A and 34B are perspective view showing a large capacity type ink cartridge, which is a modification directed to but not limited to the ink cartridge of the third embodiment.
Figure 34B:
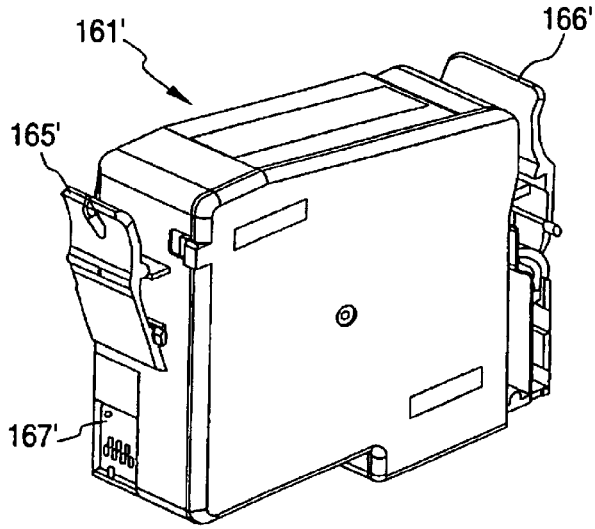
Figure 34C:
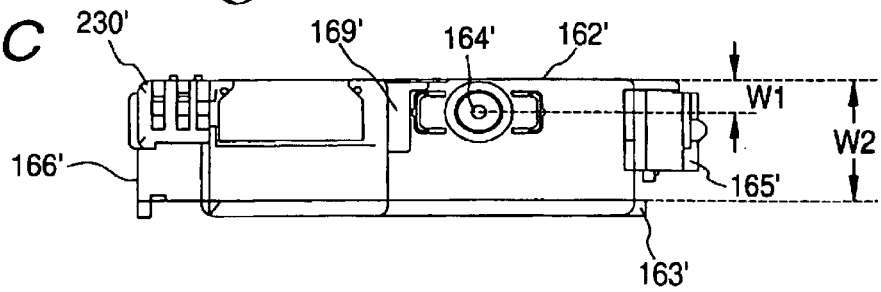
FIG. 34C is a bottom surface view of the large capacity type ink cartridge.
Figure 35:
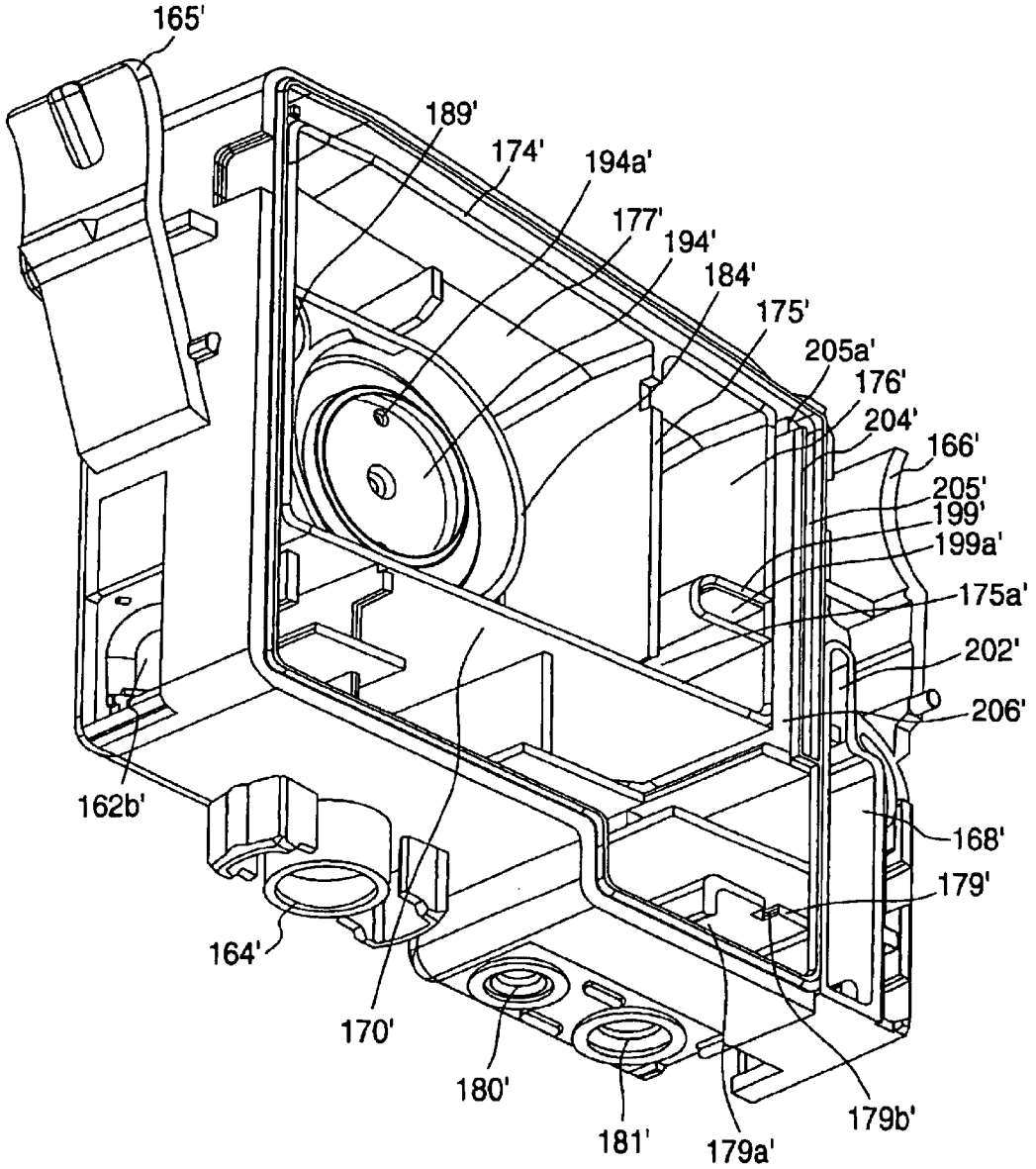
FIG. 35 is a perspective view showing a bottom surface structure of a container body of the large capacity type ink cartridge of FIG. 34 as viewed from an opened surface side.

There may be an ink cartridge that is mounted to the same recording device as other ink cartridges are mounted and that stores ink, out of which the rate of consumption is larger than for ink in the other ink cartridges. For example, an ink cartridge storing black ink is such an ink cartridge. Such an ink cartridge is preferably designed to have a larger ink storing capacity as shown in FIG. 34, and this is convenient for a user because the exchange cycle of the ink cartridge can be made substantially equal to the other ink cartridges.

The cartridge is constructed such that the configuration of the opened surface of the container body 162 is the same but only a depth W2 is large. By simply varying the depth W2 of the container body 162', the ink amount that can be stored in the container body 162' can be increased.

The distance from the surface of the container body 162' to the arrangement center of the ink supply port 164 and the memory device 167' is set to be a constant value W1 which is equal to that of the other ink cartridge. In addition, the identification block 230' is mounted to the surface side of the container body 162', and thus the identification block 230' is disposed at the same position as that of the other ink cartridge. Note that, in order to surely apply the pressing force to the ink supply port 164' when the ink cartridge is mounted, the retaining member 165' is located at an offset position toward the surface side of the container body 162' similarly to the ink supply port 164'. In addition, the retaining member 166' does not have such an offset arrangement as shown, for example, in FIGS. 34A and 34B.

Figure 36:
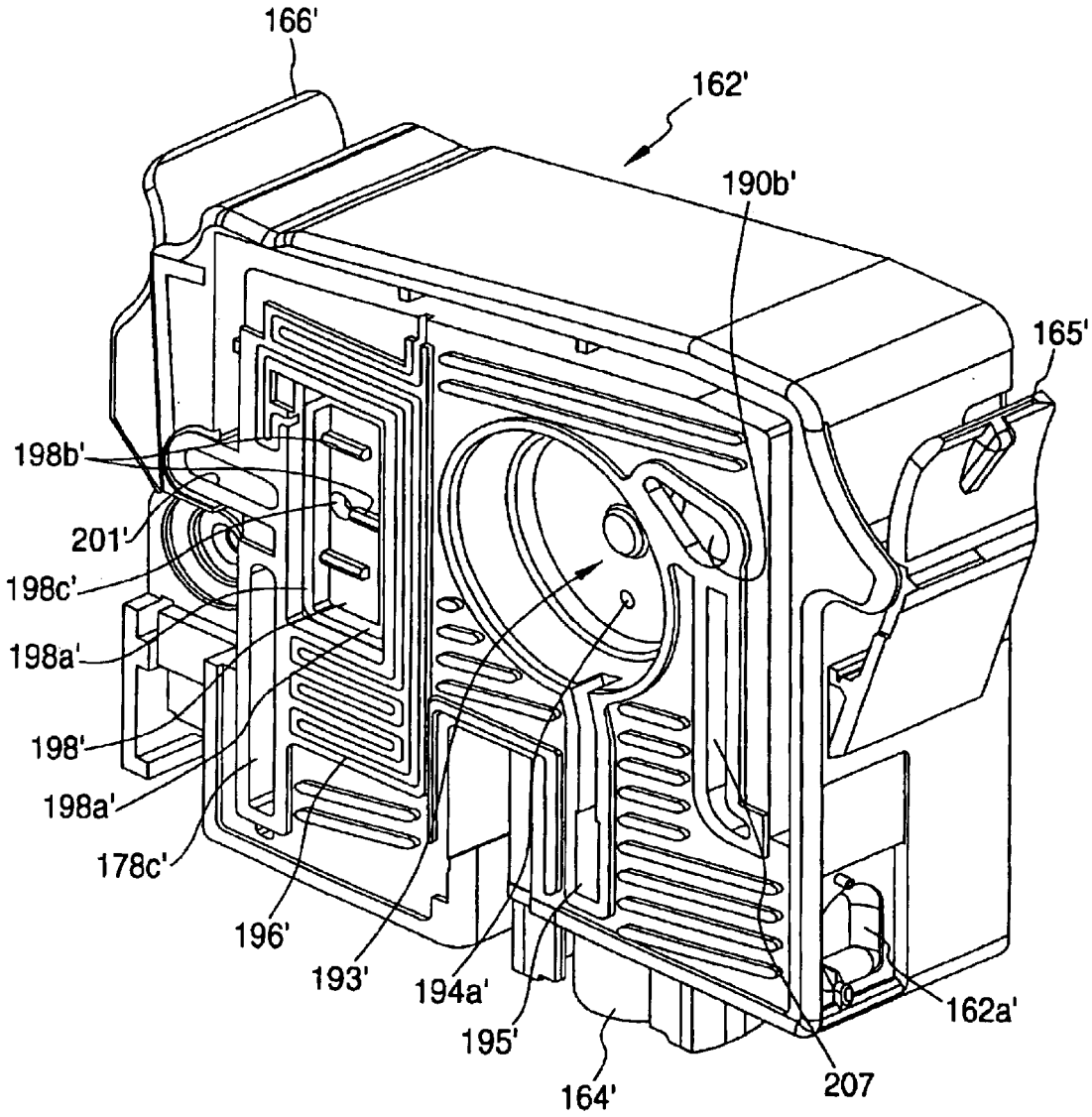
FIG. 36 is a perspective view showing a surface side structure of the container body of the large capacity type ink cartridge of FIG. 34.

Even if the thickness W2 of the container body 162' is larger, it is sufficient that a cross-sectional area of an ink flow passage for inducing ink from the fourth ink chamber 183' (FIG. 37) to the differential pressure valve storage chamber (i.e. a cross-sectional area of an ink flow passage corresponding to the ink flow passage 188 in the aforementioned embodiment) and the membrane valve 212' (FIG. 38) constructing the differential pressure valve are the same as or similar to those of the aforementioned thin ink cartridge. For this reason, the ink flow passage corresponding to the ink flow passage 188 of the aforementioned embodiment is formed such that a recessed portion 207 (FIG. 36) is provided on the surface side of the container body 162', and the recessed portion 207 is sealed by the film 255' (FIG. 38) bonded to the surface of the container body 162'. The recessed portion 207 is communicated at its lower end via a through hole 207*a* (FIG. 37) with the fourth ink chamber 183' and at its upper end via a through hole 207*b* (FIG. 37) with the through hole 189' serving as the filter chamber. That is, the recessed portion 207 is communicated at its upper and lower end with the inner side of the container body 162'.

Figure 39A:
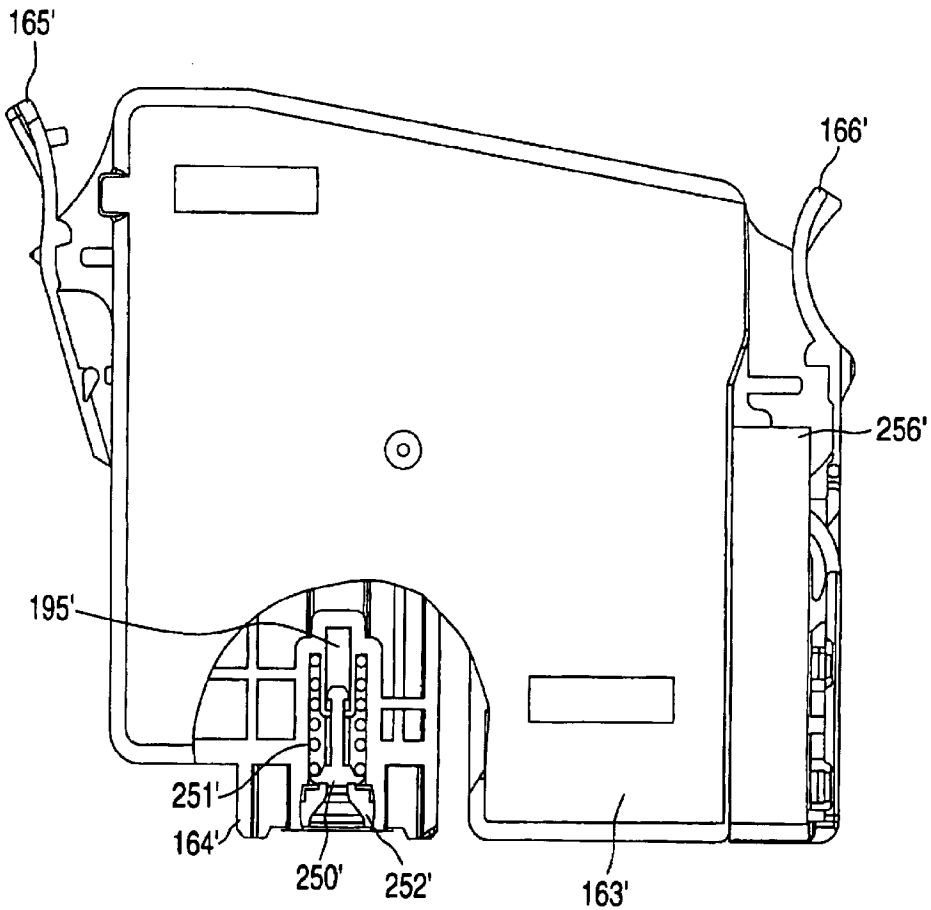
FIGS. 39A and 39B are a partially sectional view showing a structure of an ink supply port of the large capacity type ink cartridge of FIG. 34, and a sectional view showing a structure around the ink supply port.
Figure 39B:
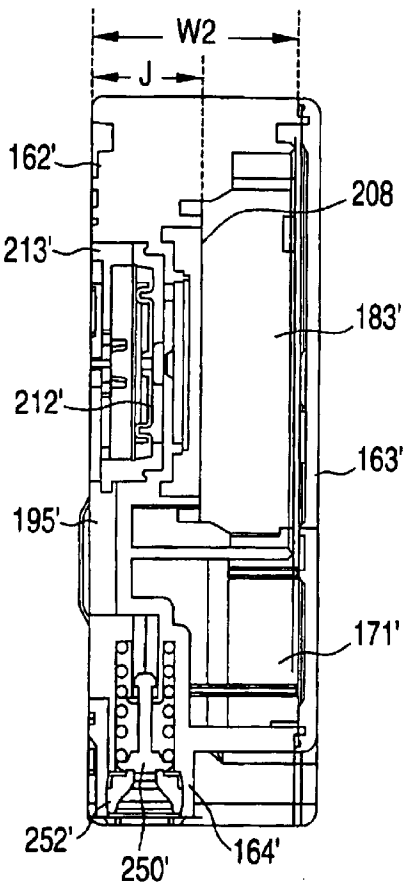

The wall 184' defining the flow passage behind the differential pressure valve storage chamber 193' has a height J from the surface of the container body 162', which is smaller than the width W2 of the container body 162', as shown in FIG. 39B. A film 208 is sealingly bonded to the wall 184'.

Figure 37:
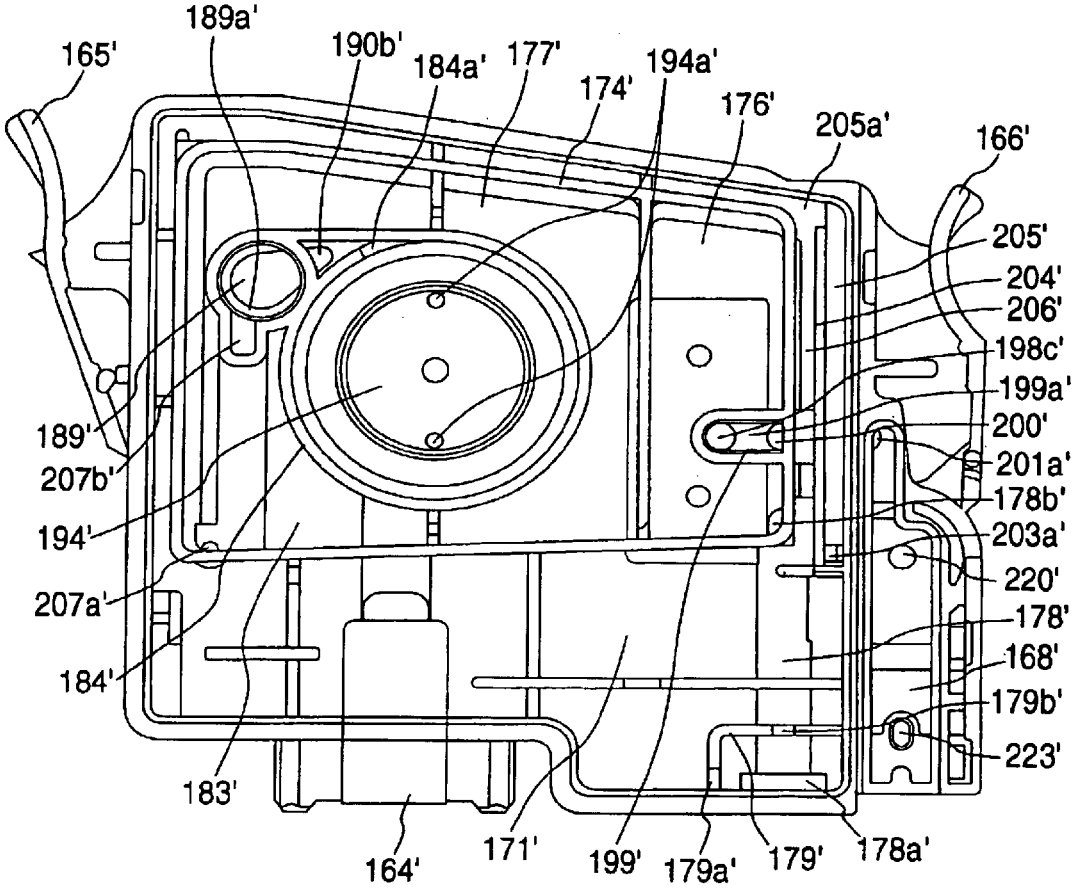
FIG. 37 is an elevational view showing an opened surface side structure of the container body of the large capacity type ink cartridge of FIG. 34.

In this arrangement, ink is sucked up from the through hole 207*a* at the bottom of the fourth ink chamber 183' to upwardly flow in the ink flow passage defined by the recessed portion 207 and the film 255', flows out from the through hole 207*b* at the upper end of the recessed portion 207 and passes through the filer 215' to flow out to the surface side of the container body 1621. In addition, the through hole 207*b* and the through hole 189' are communicated with each other via the recessed portion 189*a'* (FIG. 37).

Subsequently, the ink passes through the tear-drop-shaped recess 190*b'* (FIG. 36) in the surface side of the container body 162', and flows via the recessed portion 184*a'* into a region defined by the walls 184' and the film 208, i.e. the back side of the differential pressure valve storage chamber 193'. Subsequently, similarly to the aforementioned embodiment, the ink flows into the ink supply port 164' by opening and closing the membrane valve 212' in accordance with a negative pressure in the ink supply port 164'.

If the flow passage from the fourth ink chamber 183' to the differential pressure valve storage chamber 193' is constructed as mentioned above, a dead space can be reduced and ink can be effectively used in comparison to case where the wall 184' is simply formed to have the same height as that of the container body 162'.

In the illustrated example, since the height of the wall 184' defining the flow passage behind the differential pressure valve storage chamber is lower than the height of the frame 174' and wall 170' defining the upper section ink storage chambers, the third and fourth ink storage chambers 177' and 183' substantially form a single ink storage chamber in the thickness direction of the container body.

Figure 38:
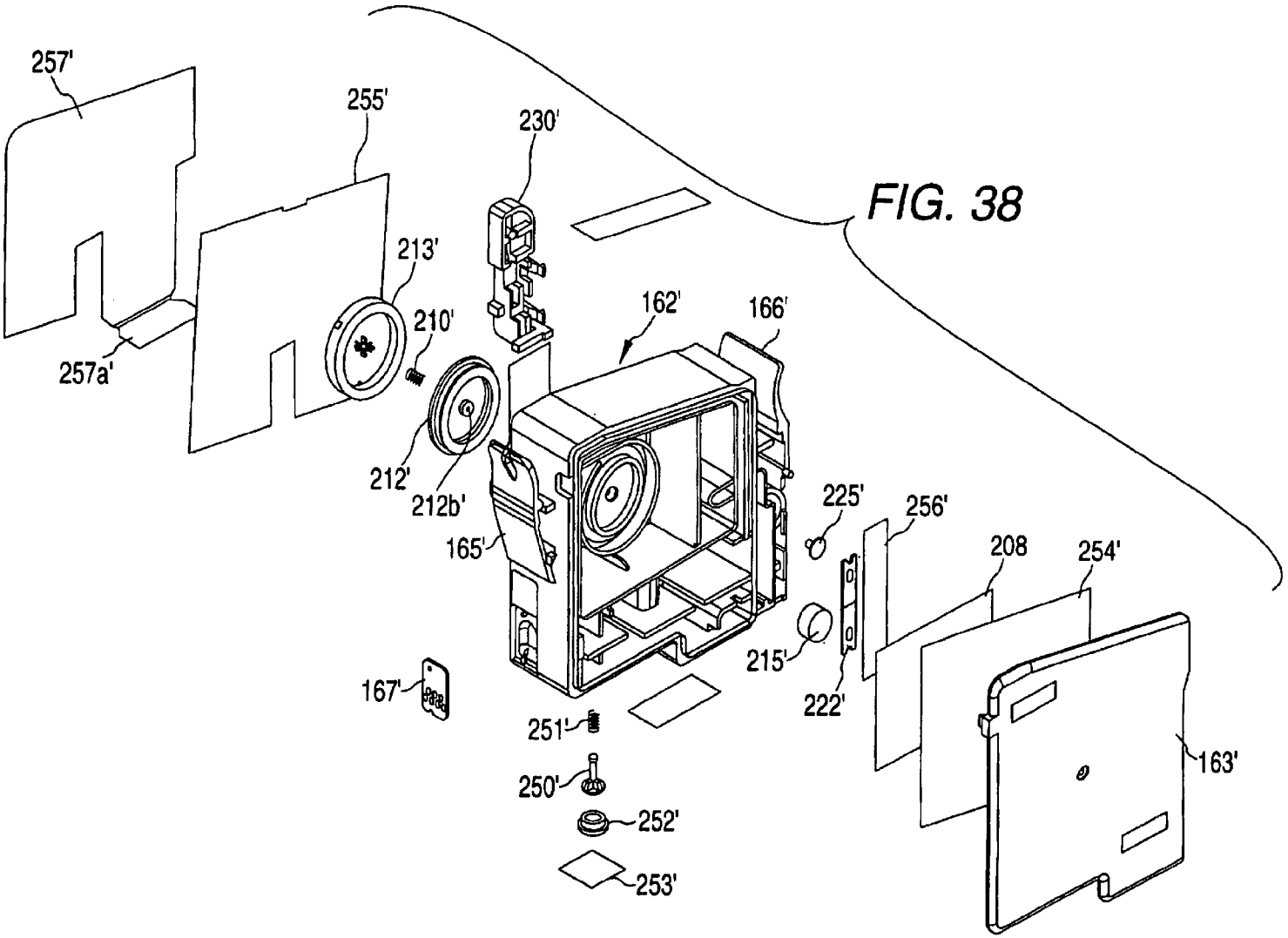
FIG. 38 is an exploded perspective view showing the large capacity type ink cartridge of FIG. 34.

The ink cartridge thus constructed is finished as a commercial product by overlapping and bonding a decorative film 257, 257' onto the film 255, 255' bonded to the surface of the container body 162, 162' as shown in FIGS. 29, 30 and 38.

This decorative film 257, 257' is preferably formed with a tab 257*a*, 257*a'* corresponding in position to the ink injection ports 180, 181, 180', 181' so that ink injection ports 180, 181, 180', 181' can be sealed by the tab 257*a*, 257*a'*.

Figure 40:
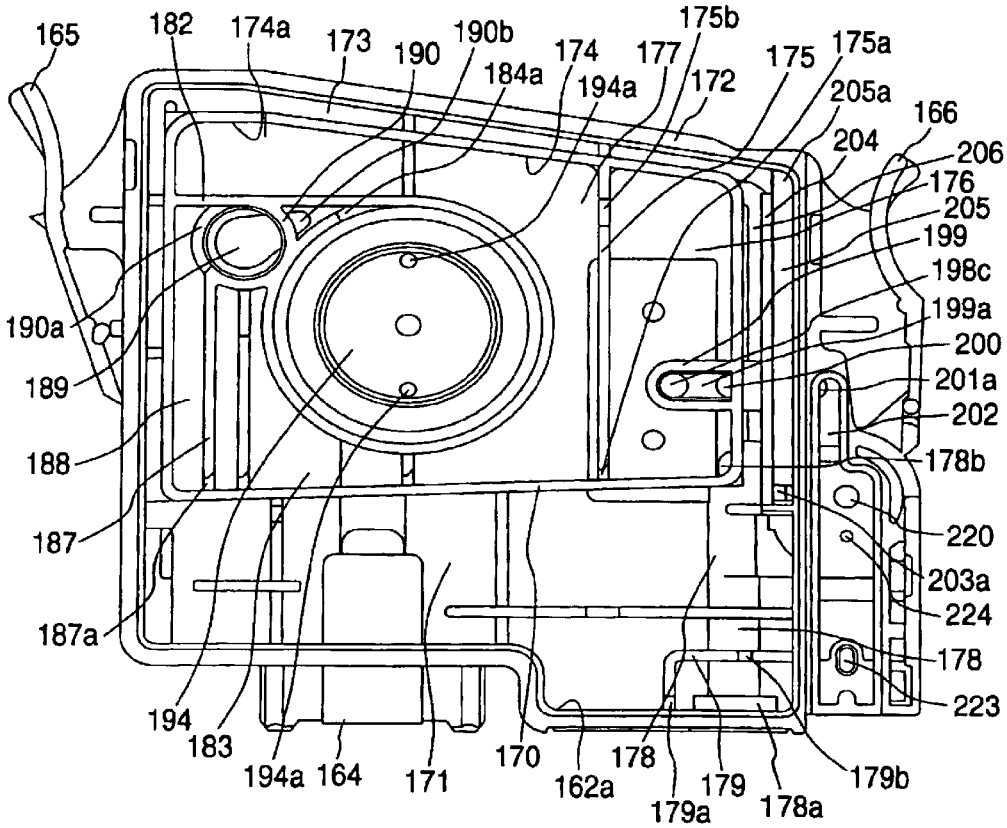
FIG. 40 is an elevational view showing a structure of a container body of a small capacity type ink cartridge, which is a modification directed to but not limited to the ink cartridge of the third embodiment.
Figure 41:
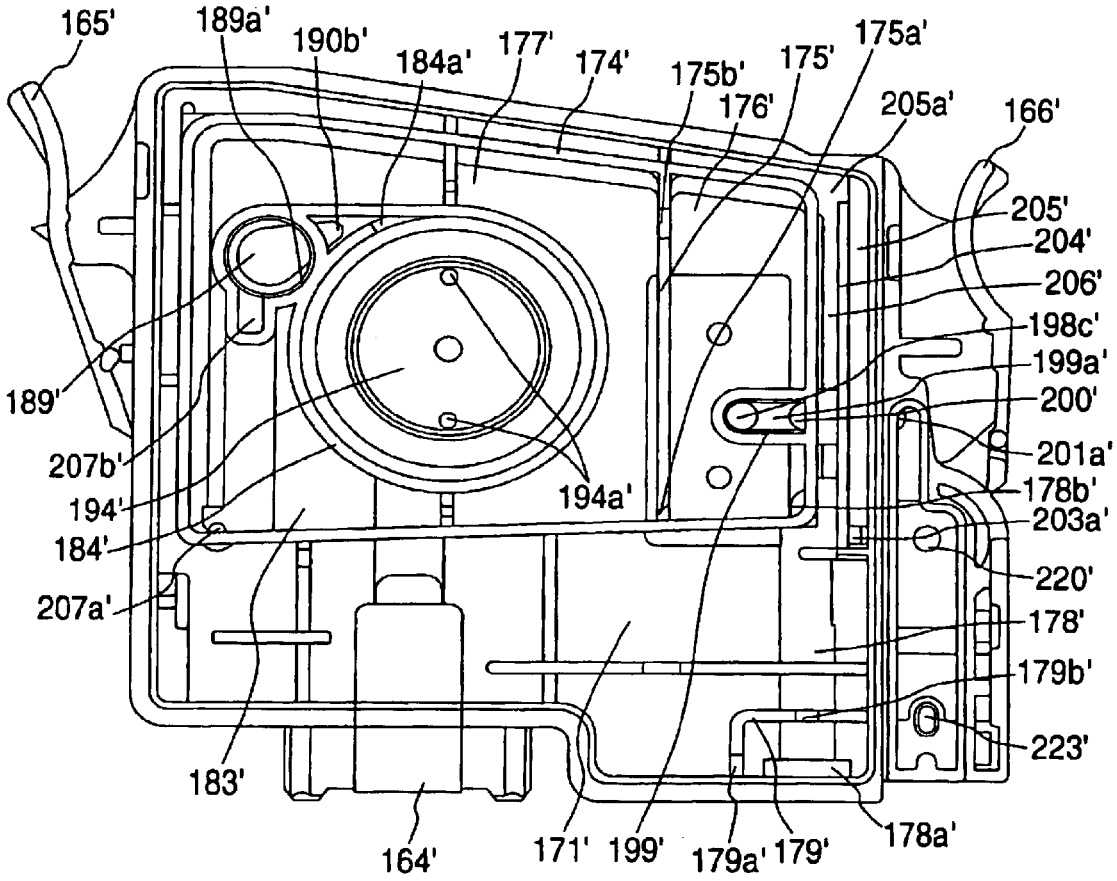
FIG. 41 is an elevational view showing a structure of a container of a large capacity type ink cartridge, which is a modification directed to but not limited to the ink cartridge of the third embodiment.

In the aforementioned embodiment, the second ink chamber 176, 176' and the third ink chamber 177, 177' are communicated with each other only through the recessed portion 175*a*, 175*a'* formed in the lower portion of the wall 175, 175' so that function of an air bubble trap chamber is added to the second ink chamber 176, 176' (see FIGS. 40 and 41). However, as shown in FIGS. 40 and 41, a recessed portion 175*b*, 175*b'* may be also formed in the upper portion of the wall 175, 175'. In this case, even in case of such ink as to be likely to be concentrated or precipitated at a lower portion, for example, pigment ink, concentrated pigment in the second ink chamber 176 is allowed to flow into the third ink chamber 183, 183' through the recessed portion 175*a*, 275*a'* while the solvent component is allowed to flow into the third ink chamber 177, 177' through the upper recessed portion 175*b*, 175*b'*, thereby facilitating agitation of the pigment and the solvent component. That is, the ink concentration can be made uniform.

In the aforementioned embodiment, the differential pressure valve storage chamber is disposed in the upper section ink storage chamber in view of convenience of the layout. The similar effect can be obtained even if the differential pressure valve storage chamber is disposed in the lower section ink storage chamber, or disposed to extend across the upper and lower section ink storage chambers. In this case, the flow passages are arranged to communicate ink in the upper section ink storage chamber with the inflow side of the membrane valve, and to communicate the outflow side of the membrane valve with the ink supply port.

Figure 42:
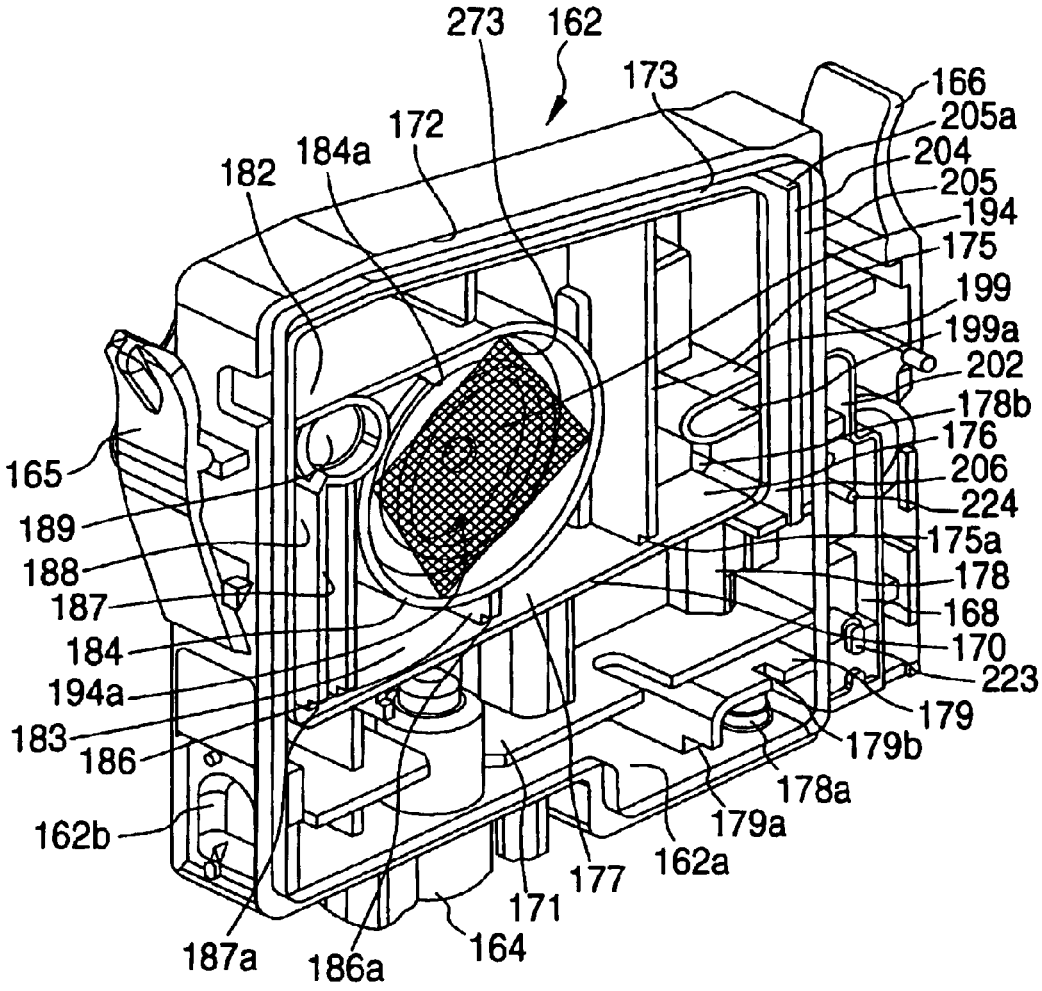
FIG. 42 is a perspective view showing another example of a filter in an ink cartridge according to the present invention.

Further, in the aforementioned embodiment, the filter 215, 215' of porous material is installed in the through hole 189 in the vicinity of the differential pressure valve storage chamber. The similar effect can be obtained even if a plate-like mesh filter 273 is provided in a stretched manner to cover the through holes 194*a* of the wall 194 of the differential pressure valve storage chamber 193 (see FIG. 42).

Selected one, or both of the filter types made of the porous material and the plate-like filter may be used depending on a kind of ink to be stored in the ink cartridge.

In this embodiment, three ink storage chambers are formed in the upper section, but even if a single ink storage chamber is formed in the upper section, it is possible to obtain the effect of reducing the variation of the water head pressure acting on the membrane valve as mentioned above. By forming two or more ink storage chambers, and by communicating these ink storage chambers one another at the bottom portion(s), a space created in each ink storage chamber as a consequence of ink consumption can be allowed to function as an air bubble trap space, thereby eliminating entry of the air bubbles into the negative pressure generating mechanism as much as possible. That is, the lowering of print quality can be avoided.

In the aforementioned embodiment, the ink supply port is formed in the bottom surface of the cartridge, but the similar effect can be obtained even if the ink supply port is formed in the side surface. In case where this arrangement is adopted, a member operated in conjunction with the ink cartridge insertion process is modified and oriented to match with the insertion direction. This is a matter of design modification.

As the film having air impermeability and ink impermeability properties discussed above (for example, the film 37, 255, etc.), a film made of PP (polypropylene), a mixture of PP and PET (polyethylene terephthalate) or a mixture of PP and PE (polyethylene) is preferably used in case the container body is made of PP, since the film made of such material provides excellent adhesion to the container body made of PP. The film may have a laminate structure of layers, each made of any of the above-listed material, because an adhesive layer interposed between the layers of the above-listed material can further enhance the air impermeability property. In addition, one or more layer(s) of PET may be laminated on an exposed side (i.e. a side not bonded to the container body) of the film.

As the film having air permeability and ink impermeability properties discussed above (for example, the film 24*a*, 258, etc.), a film having a laminate structure in which a layer of a non-woven fabric sheet, made, for example, of PE is laminated on a layer that is made of Teflon (polytetrafluoroethylene) or fluorine-group material, that has ink repellent function and that has fine pores, is preferably used.

As described above, according to the present invention, since ink in the upper section is supplied via the negative pressure generating means to the recording head, the pressure variation stemming from the change in ink amount can be positively prevented.

What is claimed is:

1. A method of injecting ink into an ink cartridge for an ink jet recording device having a recording head, the method comprising the steps of:

providing the ink cartridge comprising:

a container including:

a lower section ink chamber;

an upper section ink chamber;

an ink supply port, disposed on a bottom wall of the container, for supplying ink to the recording head;

an ink suction passage fluidly connecting the lower section ink chamber to the upper section ink chamber, and having an upper end opening disposed proximate a bottom of the upper section ink chamber and a lower end opening disposed proximate a bottom of the lower section ink chamber;

a first ink injection port formed through the bottom wall of the container, opened at the bottom of the lower section ink chamber, and facing the lower end opening:

a second ink injection port formed through the bottom wall of the container, and opened at the bottom of the lower section ink chamber;

an ink flow passage fluidly connecting the upper section ink chamber to the ink supply port; and an air communication passage for fluid communication with the lower section ink chamber and the ambient atmosphere;

a differential pressure valve having a membrane member, which is disposed in the container and disposed within the ink flow passage; and an air communication valve disposed in the container and disposed within the air communication passage;

injecting ink from the lower end opening through the ink suction passage and the upper end opening into the upper section ink chamber using the first ink injection port.

2. The method according to claim 1, further comprising the step of sealing the first ink injection port.

3. The method according to claim 2, wherein the step of sealing the first ink injection port includes sealing the first ink injecting port by closing the first ink injection port with a film member.

4. The method according to claim 2, wherein the step of sealing the first ink injection port includes sealing the first ink injection port by closing the first ink injection port with a plug member.

5. The method according to claim 1, further comprising the steps of:

injecting ink into the lower section ink chamber using the second ink injection port;

sealing the first ink injection port; and sealing the second ink injection port.

6. The method according to claim 5, wherein the step of sealing the second ink injection port includes sealing the second ink injecting port by closing the second ink injection port with a film member.

7. The method according to claim 5, wherein the step of sealing the second ink injection port includes sealing the second ink injecting port by closing the second ink injection port with a plug member.

8. The method according to claim 5, wherein the steps of sealing the first and second ink injection ports includes sealing the first and second ink injection ports by closing the first and second ink injection ports with a common film member.

9. The method according to claim 5, wherein the steps of sealing the first and second ink injection ports includes sealing the first and second ink injection ports by closing the first and second ink injection ports with a common plug member.

10. The method according to claim 5, further comprising sealing the ink supply port.

11. The method according to claim 5, further comprising the step of bonding a decorative film member onto the container so that a part of the decorative film member covers the first and second ink injection ports.

12. An ink cartridge for an ink jet recording device having a recording head, the ink cartridge comprising:

a container including:

an ink chamber;

an ink supply port for supplying ink to the recording head;

an ink flow passage connecting the ink supply port to the ink chamber:

an air communication passage for fluid communication with the ink chamber and the ambient atmosphere, the air communication passage having an opening serving as a valve seat; and a window;

an elastically deformable film member sealing the window; and an air communication valve including:

a slider having a first end proximate the elastically deformable film member and a second end proximate the opening;

a valve body disposed at the second end of the slider and urged to close the opening, wherein the slider can be pressed via the elastically deformable film member and the first end from a position exterior to the ink cartridge to move the valve body via the second end, to thereby open the opening.

13. The ink cartridge according to claim 12, wherein the valve body is urged in a direction from the ink chamber toward the air communication passage.

14. The ink cartridge according to claim 12, wherein the air communication passage has a first air communication chamber defined in a recess of the container by an air permeable and ink repellent film member, a second air communication chamber defined in the recess of the container between the air permeable and ink repellent film member and an air impermeable and ink repellent film member, and a capillary formed in a surface of the container, and wherein the ink chamber communicates with the ambient atmosphere via the opening, the first air communication chamber, the second air communication chamber and the capillary when the valve body opens the opening.

* * * * *

UNITED STATES PATENT AND TRADEMARK OFFICE

CERTIFICATE OF CORRECTION

PATENT NO. : 6,905,199 B2
DATED : June 14, 2005
INVENTOR(S) : Hisashi Miyazawa et al.

It is certified that error appears in the above-identified patent and that said Letters Patent is hereby corrected as shown below:

Title page,
Item [63], Related U.S. Application Data, "Continuation of application No. 10/045,703, filed on Oct. 19, 2001, now abandoned." should read -- Continuation of application No. 10/826,918, filed on Apr. 16, 2004, which is a continuation of application No. 10/045,703, filed on Oct. 19, 2001, now abandoned. --.

Signed and Sealed this

Twenty-seventh Day of September, 2005

JON W. DUDAS
*Director of the United States Patent and Trademark Office*